US012600387B2

(12) United States Patent
Baltzer

(10) Patent No.: US 12,600,387 B2
(45) Date of Patent: Apr. 14, 2026

(54) SAWTOOTH STATION, BIDIRECTIONAL SAWTOOTH PLATFORM, CAR TETHER, AND ELEVATED AUTONOMOUS PEOPLE MOVER SYSTEM

(71) Applicant: Karsten Baltzer, San Diego, CA (US)

(72) Inventor: Karsten Baltzer, San Diego, CA (US)

( * ) Notice: Subject to any disclaimer, the term of this patent is extended or adjusted under 35 U.S.C. 154(b) by 605 days.

(21) Appl. No.: 18/120,574

(22) Filed: Mar. 13, 2023

(65) Prior Publication Data

US 2023/0311954 A1 Oct. 5, 2023

Related U.S. Application Data

(60) Provisional application No. 63/326,095, filed on Mar. 31, 2022.

(51) Int. Cl.

| | |
|---|---|
| ***B61B 13/00*** | (2006.01) |
| ***B61B 1/02*** | (2006.01) |
| ***B61B 5/00*** | (2006.01) |
| ***E01B 25/28*** | (2006.01) |

(52) U.S. Cl.
CPC ..... *B61B 13/00* (2013.01); *B61B 1/02* (2013.01); *B61B 5/00* (2013.01); *E01B 25/28* (2013.01)

(58) Field of Classification Search
CPC .. B61B 1/02; B61B 13/00; B61B 5/00; E01B 25/28
See application file for complete search history.

(56) References Cited

U.S. PATENT DOCUMENTS

| | | | | |
|---|---|---|---|---|
| 7,681,505 | B2 * | 3/2010 | Lowson | B61B 1/02 104/27 |
| 9,020,660 | B2 * | 4/2015 | Mudalige | G05D 13/00 701/2 |
| 9,802,633 | B1 * | 10/2017 | Nishinaga | B61L 15/0062 |
| 2005/0011399 | A1 * | 1/2005 | Skoblenick | B61B 13/04 105/144 |
| 2010/0168948 | A1 | 7/2010 | Edwards | |

(Continued)

FOREIGN PATENT DOCUMENTS

| | | | |
|---|---|---|---|
| CN | 1309605 | C | 4/2007 |
| CN | 110835871 | A | 2/2020 |

(Continued)

OTHER PUBLICATIONS

International Search Report and Written Opinion dated Aug. 9, 2023 in International Patent Application No. PCT/US2023/015319.

(Continued)

*Primary Examiner* — Jason C Smith
(74) *Attorney, Agent, or Firm* — Procopio, Cory, Hargreaves & Savitch LLP

(57) ABSTRACT

A sawtooth station comprising a passenger waiting area; an autonomous vehicle area sized to allow autonomous vehicles to simultaneously travel in opposite directions of travel and turn around; and one or more sawtooth berths separating the passenger waiting area from the autonomous vehicle area, whereby autonomous vehicles traveling in opposite directions use the one or more sawtooth berths and the autonomous vehicles furthest from the one or more sawtooth berths can turn around in the autonomous vehicle area in order to stop at the one or more sawtooth berths.

25 Claims, 61 Drawing Sheets

(56) References Cited

U.S. PATENT DOCUMENTS

| | | | | |
|---|---|---|---|---|
| 2013/0327244 | A1* | 12/2013 | Robbert | B61B 13/08 105/150 |
| 2021/0237780 | A1* | 8/2021 | Holbrooke | B61B 13/08 |
| 2022/0055864 | A1* | 2/2022 | Roberts | B66B 7/02 |
| 2023/0311954 | A1* | 10/2023 | Baltzer | B61B 5/00 104/287 |
| 2024/0092406 | A1* | 3/2024 | Younkins | B61L 99/002 |

FOREIGN PATENT DOCUMENTS

| | | | | | |
|---|---|---|---|---|---|
| CN | 214656490 | U | | 11/2021 | |
| CN | 215322522 | U | | 12/2021 | |
| CN | 109383538 | B | * | 5/2025 | B60W 30/00 |
| EP | 4467412 | A1 | * | 11/2024 | B61B 12/02 |
| ES | 1229975 | U | * | 5/2019 | |
| ES | 2973780 | T3 | * | 6/2024 | B61L 29/24 |
| FR | 3148976 | A1 | * | 11/2024 | B61B 12/02 |
| JP | 7444457 | B2 | * | 3/2024 | B61L 11/02 |
| KR | 10-2006-0052023 | A | | 5/2006 | |
| KR | 20060052023 | A | * | 5/2006 | E04H 1/1211 |
| KR | 101297073 | B1 | * | 8/2013 | B60K 6/52 |
| KR | 10-1473408 | B1 | | 12/2014 | |
| WO | WO-9819954 | A1 | * | 5/1998 | B66B 9/00 |

OTHER PUBLICATIONS

European Search Report dated Feb. 9, 2026 in European Patent Application No. 23781566.7.

* cited by examiner

SAWTOOTH STATION, BIDIRECTIONAL SAWTOOTH PLATFORM, CAR TETHER, AND ELEVATED AUTONOMOUS PEOPLE MOVER SYSTEM

FIELD OF THE INVENTION

The invention relates to sawtooth vehicle platforms systems and method, systems and method for controlling autonomous vehicle operation, and elevated autonomous people mover systems.

BACKGROUND OF THE INVENTION

Prior Art Automated People Mover

Automated people mover systems are a type of small scale automated guideway transit systems. The system normally includes a 1 to 2 mile long alignment to serve small areas such as airports, downtown districts, or theme parks. The automated people mover system includes one or more vehicles that move along an elevated driving surface guided by a rail system. The vehicle(s) can be equipped with either rubber tires or steel wheel. The vehicle(s) use a third rail to supply electricity to propel the vehicle along the rail system. The vehicle(s) can also be moved by a cable system, similar to cable cars. The alignment is an elevated guideway structure. The guideway structure is constructed utilizing steel and/or concrete materials. There are elevated stations along the alignment for passengers to embark and disembark the vehicle(s).

An example of an prior art automated people mover system 100 is shown in FIG. 1 through FIG. 8. A description of the prior art can be found in National Academies of Sciences, Engineering, and Medicine 2010. Guidebook for Planning and Implementing Automated People Mover Systems at Airports, ISBN 978-0-309-15498-7.

FIG. 1 show the alignment consisting of elevated stations 200 connected by elevated guideway structure 104 and 106, to accommodate the automated movement of vehicles 110 between stations 200, thereby allowing for passenger transportation between stations 200. The vehicle 110 direction of travel is indicated by the arrow.

The automated people mover system 100 includes one or more automated people mover vehicles 110, which can have any passenger occupancy, with any number of doors and windows. The vehicles 110 can be connected to form longer units, FIG. 1 shows six vehicles 110 joined together to form a longer unit.

When the vehicle 110 is at the end of the alignment and starts the return trip the vehicle 110 need to move to the opposite side to avoid any vehicles 110 coming to the station 200. To cross over to the other side the vehicle 110 utilizes the guideway switch 102.

In urban areas the station 200 is normally placed adjacent to a street 190 to facilitate easy transfer between different transportation methods. At this location an elevated passenger walkway 230 is provided over the adjacent street 190 to provide unobstructed connectivity to the other side of the adjacent street 190.

The minimum alignment radius R for the operation of the automated people mover system 100 is around 80 feet. This requires obtaining significant area for the automated people mover system 100 to operate, this is especially problematic in an urban area where property has to be acquired to make space for the elevated guideway structure 104 and 106.

FIGS. 2 through 4 shows the elevated guideway structure 104 and 106 for the prior art automated people mover system 100. FIG. 2 shows the elevation view, FIG. 3 shows cross sections for a two vehicle 110 elevated guideway structure 104 and FIG. 4 shows cross sections for a one vehicle 110 elevated guideway structure 106, as described below.

The automated people mover system 100 includes one or more automated people mover vehicles 110. The tires 112 of the vehicles 110 can be pneumatic, non-pneumatic or steel wheels (running on steel rails), the automated people mover vehicle 110 can have any number of wheels, a running surface 142, which is the surfacer on top of the deck 140, the running surface 142 can be elevated above a deck 140 utilizing longitudinal extended sills under the tires, the running surface 142 can be made of concrete, steel or other material used for vehicular driving surfaces, a guide structure 120 that can be made from steel, concrete or other material and is designed to withstand horizontal load from the automated people mover vehicle 110, guide wheels 114 attached to automated people mover vehicle 110 and running against guide structure 120, a "third rail" 130 for power supply, an optional center barrier/railing 146 and side barrier/railing 144 for containment during accidental incident, the deck 140 is spanning about 100 feet between the columns 160, the deck 140 can be made from steel, concrete, or other material, the deck 140 can be simply supported on the columns 160 or be continues over the columns 160, if required a cap beam (spreader beam) 150 can be disposed on top of the column 160 to support the deck 140, the deck 140 and column 160 can be connected to make an integral structure, foundation 170 supporting the column(s) 160, the foundation can be spread footing, piles, etc. and surface of the ground 180.

The guide structure 120 (e.g., guidance rail or other similar guidance systems) is used to guide the vehicle 110 as it moves along the alignment. The guide structure controls the side movement of the vehicle 110 to keep the vehicle 110 in the center of the alignment.

The "third rail" 130 used to supply the power to move the vehicle 110, the "third rail" 130 can also be used for communication between the operation system and the vehicle 110

The height H is the distance from the ground 180 to the running surface 142. The minimum required height H is around 40 feet. These is mainly due to the connection to the elevated passenger walkway 230 over the adjacent street 190, as the elevated passenger walkway 230 has to go over the adjacent street 190 and under the deck 140, as shown on FIGS. 6 and 8.

FIGS. 5-8 show plan and cross sectional views of the stations 200 for the prior art automated people mover system, FIGS. 5 and 6 shows station 200 with center passenger platform 210, FIGS. 7 and 8 shows station 200 with side passenger platforms 212.

The station 200 with center passenger platform 210 have a one vehicle 110 elevated guideway structure 106 on both sides, and the station 200 with side passenger platform 212 have a two vehicle 110 elevated guideway structure 104 in the center. The station 200 is covered by the roof 250.

Normally a partition is placed on the edge of the center passenger platform 210, with automatic doors that open when the vehicle are present, the partition is normally transparent for the passengers to be able to see the vehicle as it arrives. Likewise, there is a partition between the side passenger platform 212 and the elevated guideway structure 104.

The vehicles 110 enter 260 the station 200 at one end and continue along the elevated guideway structure 104 and 106, the vehicles 110 stop to embark and disembark passengers, then the vehicles 110 continue on the elevated guideway structure 104 and 106 where vehicle 110 exit 270 the station 200.

The station 200 consist of 3 floors, there are escalators 240, stairways and elevator between all floors, the $1^{st}$ floor, is located on the ground 180, where passengers take escalators to the $2^{nd}$ floor, $2^{nd}$ floor consist of the elevated passenger walkway 230 and the mezzanine 220, from the $2^{nd}$ floor passengers take escalators to the $3^{rd}$ floor where the center passenger platform 210 or side passenger platform 212 are located, from her the passengers can board the vehicles 110.

The passengers are embark and disembark the vehicles 110 at the center passenger platform 210 or side passenger platform 212 at the $3^{rd}$ floor, from her passengers go down escalators 240 to the mezzanine 220 on the $2^{nd}$ floor, from the mezzanine 220 passengers can go down escalators 240 to the $1^{st}$ floor located on the ground 180, or use the elevated passenger walkway 230 to go over the adjacent street 190 and continue down escalators 240 to the $1^{st}$ floor located on the ground 180 on the other side of the adjacent street 190.

The elevated passenger walkway 230, located on the $2^{nd}$ floor, is going over the adjacent street 190 and under the deck 140 to connect to the mezzanine 220, located on the $2^{nd}$ floor, this allows passengers to go from elevated passenger walkway 230 to the mezzanine 220 and then via escalators 240 up to the center passenger platform 210 or side passenger platform 212 located on the $3^{rd}$ floor. Because the elevated passenger walkway 230 has to go above the adjacent street 190 and under the deck 140 the minimum required height H is around 40 feet.

When the vehicle 110 as is passes over the deck 140 the deflection the prior art automated people mover system 100 can accommodate is limited, therefore the deck 140 are normally a box or truss structure to increase stiffness and thereby limited the deflection as the vehicle 110 passes over the deck 140.

Prior Art Sawtooth Platform

Sawtooth platform 320 systems in the past were designed for a vehicle to move along a driving surface in one direction to enter a sawtooth berth 324. Then vehicle will continue in the same direction to exit the sawtooth bay 324. Thus, the sawtooth platform 320 systems were designed for unidirectional vehicle flow or traffic flow in one direction. Consequently, the vehicle 310 must follow the directional flow to enter the sawtooth bay 324. It is also notable that the sawtooth bay is designed for the vehicle 310 to stop to embark and disembark passengers at the sawtooth bay 324 and then continue in the same direction without the need for reversing the vehicle to continue.

An example of prior art FIG. 9 show a vehicle 310 station 300. A description of prior art can be found in AASHTO (American association of state highway and transportation officials) 2014. Guide for Geometric Design of Transit Facilities on Highways and Streets, ISBN: 978-1-56051-522-7.

The vehicle station 300 design is for the vehicle 310 to move along the sawtooth platform 320 in one direction. The vehicle 310 enters at entry 330 then continues to the sawtooth berth 324, where passengers can embark and disembark the vehicle 310 to the passenger waiting area 322. The vehicle 310 then continues in the same direction to the exit 340.

Prior Art Controlling Autonomous Vehicle Operation

The prior art systems and method for controlling autonomous vehicle operation are designed for the control of autonomous vehicles on public roads, where the autonomous vehicle interact with public road users (cars, pedestrian, etc.).

SUMMARY OF THE INVENTION

Aspects of the disclosure involve a sawtooth station comprising a passenger waiting area; an autonomous vehicle area sized to allow autonomous vehicles to simultaneously travel in opposite directions of travel and turn around; and one or more sawtooth berths separating the passenger waiting area from the autonomous vehicle area, whereby autonomous vehicles traveling in opposite directions use the one or more sawtooth berths and the autonomous vehicles furthest from the one or more sawtooth berths can turn around in the autonomous vehicle area in order to stop at the one or more sawtooth berths.

One or more implementation of the aspect of the disclosure described immediately above include one or more of the following: the autonomous vehicle area is a bidirectional sawtooth platform along a single side of the sawtooth station; one or more entries and one or more exits that may be the same or different from the one or more entries, whereby an autonomous vehicle enters the sawtooth station at the one or more entries and exits the sawtooth station at the one or more exits; the sawtooth station is a sawtooth terminal including an end that both the one or more entries and one or more exits are located at; the sawtooth station is a sawtooth junction including opposite ends that the one or more entries and one or more exits are respectively located at; and/or a method of using the sawtooth station comprising providing the sawtooth station of the aspect of the disclosure described immediately above; receiving autonomous vehicles traveling in opposite directions within the sawtooth station; allowing the autonomous vehicles to turn around within the sawtooth station; receiving the autonomous vehicles at the one or more sawtooth berths.

Another aspect of the disclosure involves an autonomous vehicle tether system for controlling interaction between a plurality of autonomous vehicles located in a control area, the plurality of autonomous vehicles each having control parameters and respective desired destinations or exit points comprising at least one hardware processor; and one or more software modules that are configured to, when executed by the at least one hardware processor: take control of the plurality of autonomous vehicles in the control area; obtain the control parameters and desired destination or exit point for each autonomous vehicle; optimize control parameters of each autonomous vehicle to optimize travel through the control area to the respective desired destinations or exit points; determine if the autonomous vehicle is at its desired destination or exit point; return control of the autonomous vehicle back to the autonomous vehicle after determining that the autonomous vehicle is at its desired destination or exit point.

A further aspect of the disclosure involves a method of controlling interaction between a plurality of autonomous vehicles located in a control area, the plurality of autonomous vehicles each having control parameters and respective desired destinations or exit points comprising taking control of the plurality of autonomous vehicles in the control area; obtaining the control parameters and desired destination or exit point for each autonomous vehicle; optimizing control parameters of each autonomous vehicle to optimize travel through the control area to the respective desired destinations or exit points; determining if the autonomous vehicle is at its desired destination or exit point; returning control of the autonomous vehicle back to the autonomous vehicle after determining that the autonomous vehicle is at its desired destination or exit point.

One or more implementation of the two aspects of the disclosure described immediately above include one or more of the following: the autonomous vehicle tether system controls interactions between all of the plurality of autonomous vehicles located in the control area; when traffic lanes merge the autonomous vehicle tether system controls interactions between the control of the autonomous vehicles to provide relative distance between the autonomous vehicles to create a seamless merger; wherein at intersections the autonomous vehicle tether system controls interactions between the control of the autonomous vehicles to provide relative distance between the autonomous vehicles to create a seamless traffic flow for all autonomous vehicles going through the intersection; wherein the intersections may be any size intersection that the autonomous vehicle tether system controls; wherein the control area is a predetermined control area; wherein the control area is a non-predetermined control area; wherein autonomous vehicle tether system controls interaction between autonomous vehicles in an elevated autonomous people mover system; wherein most of the vehicles in the control area are autonomous; wherein all of the vehicles in the control area are autonomous; wherein the control parameters are at least travel route, speed, acceleration, and global positioning; wherein the control parameters are other than travel route, speed, acceleration, and global positioning; and/or wherein autonomous vehicle tether system controls one or more autonomous vehicles to stop if stopping provides an improved overall traffic flow.

A still further aspect of the disclosure involves an elevated autonomous people mover system comprising an elevated guideway structure with a running surface; a plurality of autonomous vehicles; a plurality of elevated stations along the guideway structure for passengers to enter and exit the autonomous vehicles, whereby the elevated autonomous people mover system does not include a third rail for supplying electric power to the vehicles nor a guidance structure to guide the vehicles.

One or more implementation of the aspect of the disclosure described immediately above include one or more of the following: the plurality of elevated stations include sawtooth stations configured to allow the autonomous vehicles to turn around therein; the plurality of elevated stations include sawtooth junctions and sawtooth terminals; the plurality of autonomous vehicles include self-powered and self-guided autonomous vehicles; and/or a method of using the elevated autonomous people mover system, comprising providing the elevated autonomous people mover system of the aspect of the disclosure described immediately above; receiving the plurality of autonomous vehicles on the running surface of the elevated guideway structure without a third rail for supplying electric power to the vehicles nor a guidance structure to guide the vehicles; receiving the plurality of autonomous vehicles at the plurality of elevated stations for passengers to enter and exit the autonomous vehicles.

BRIEF DESCRIPTION OF THE DRAWINGS

Prior Art

Elevated Autonomous People Mover

Figure 10:
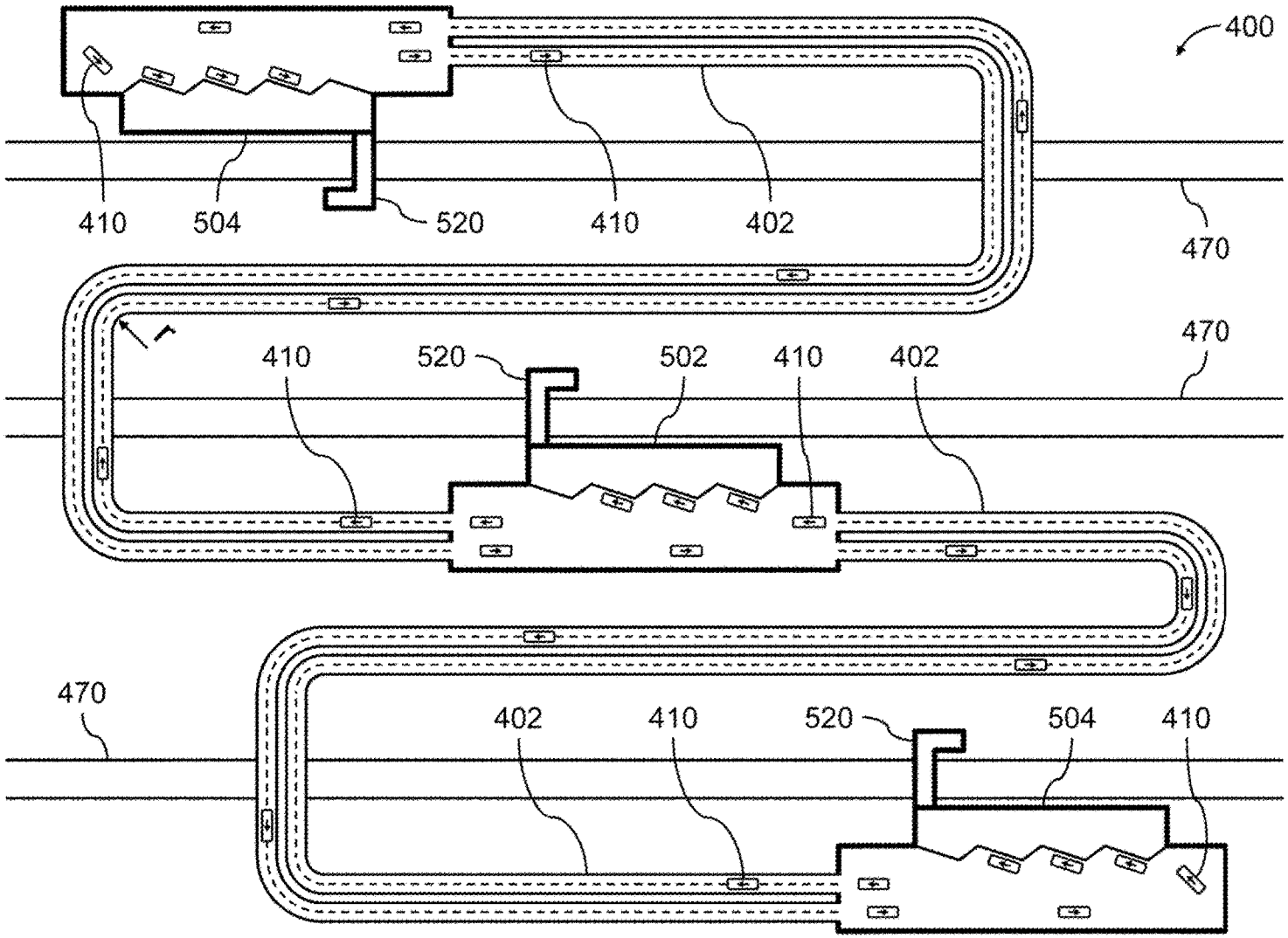
Figure 11:
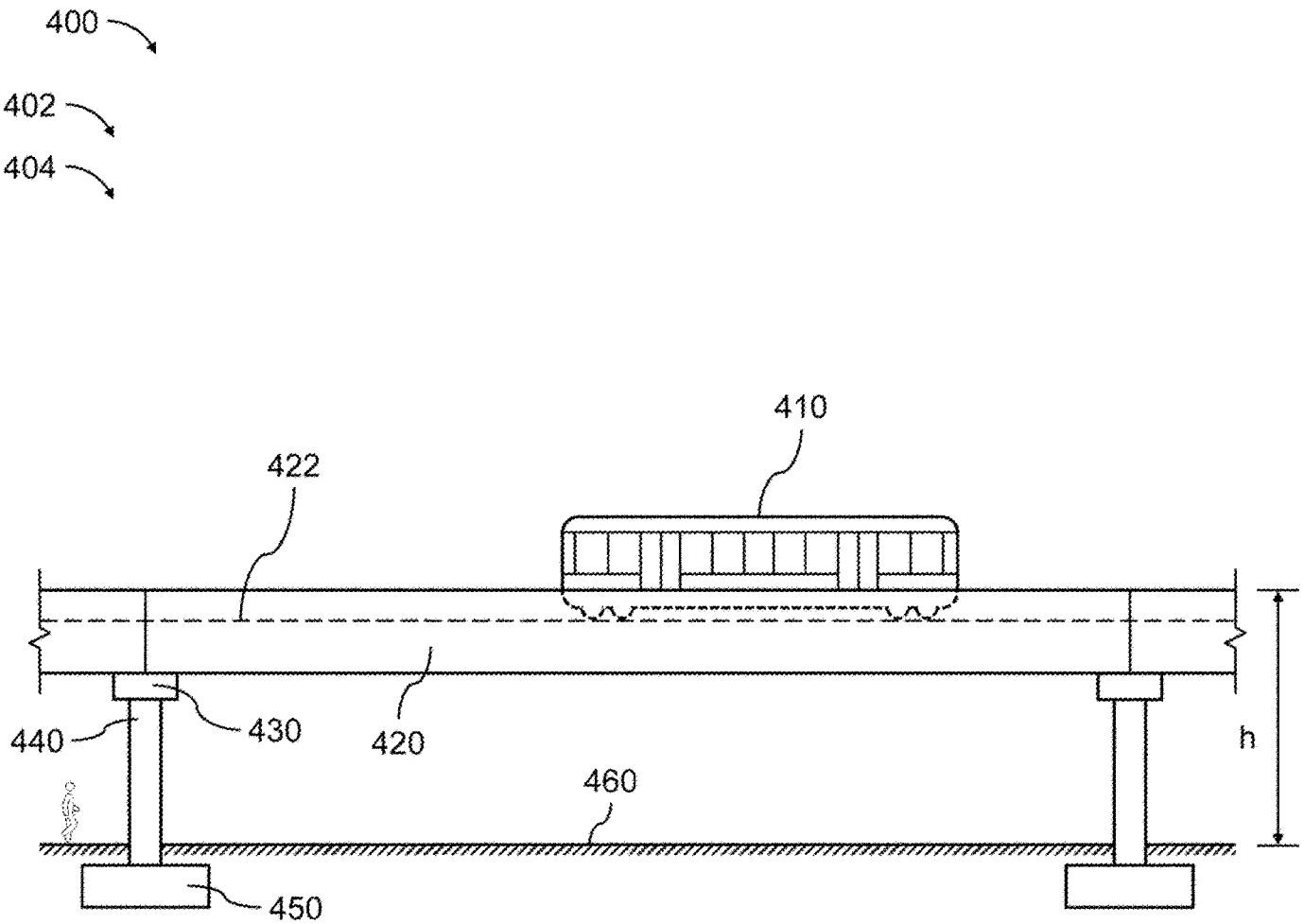
Figure 12:
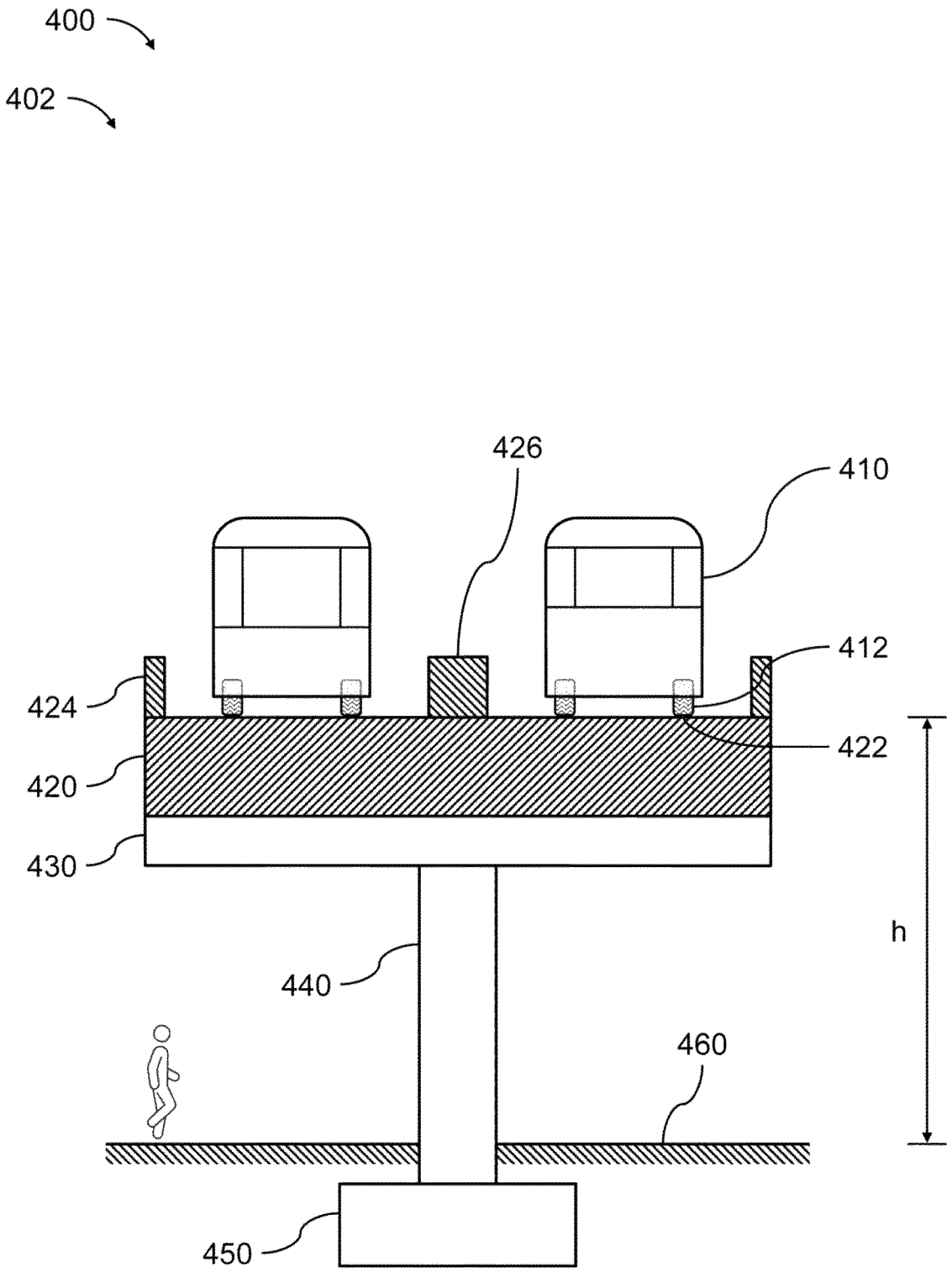
Figure 13:
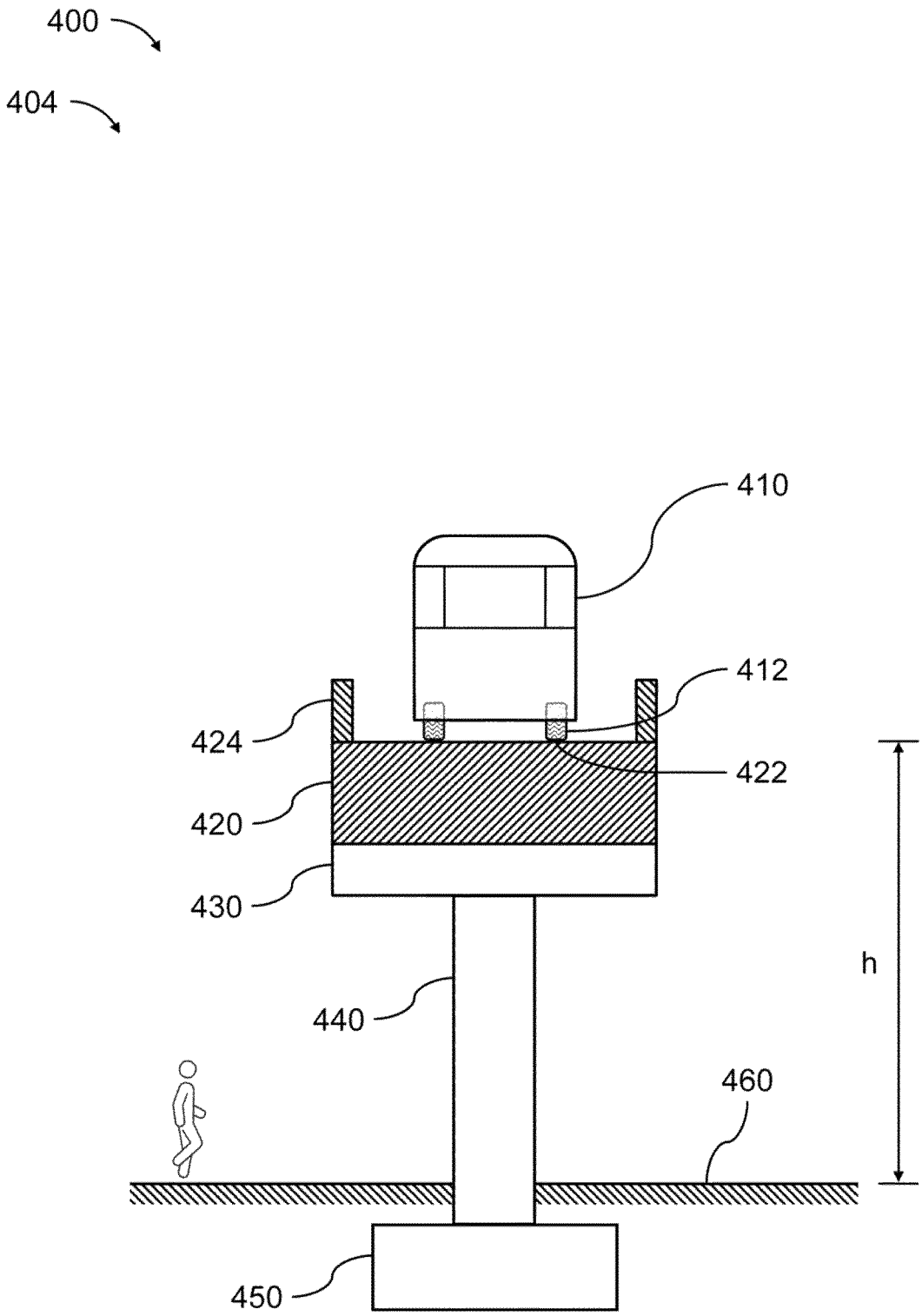
Figure 14:
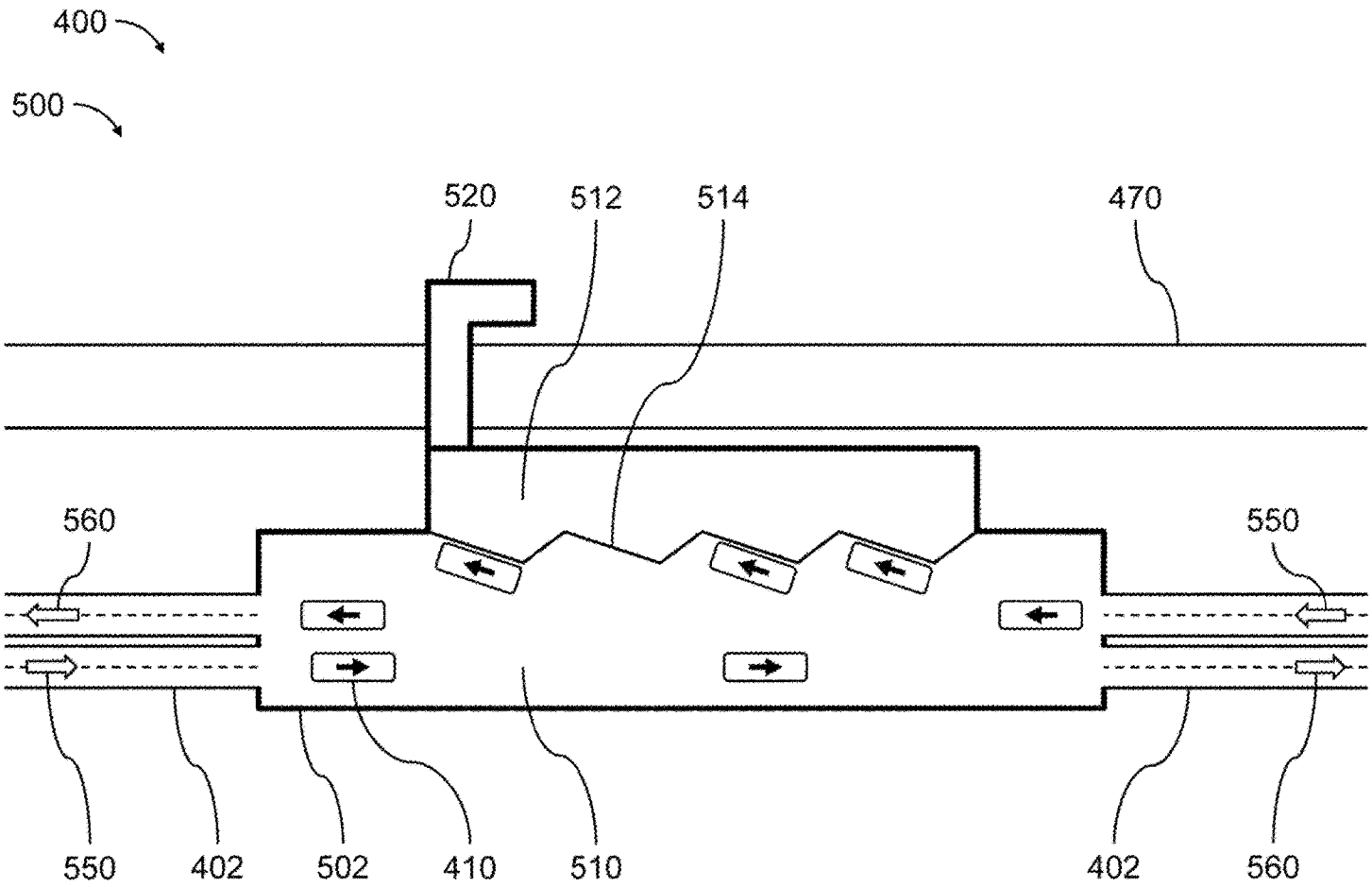
Figure 15:
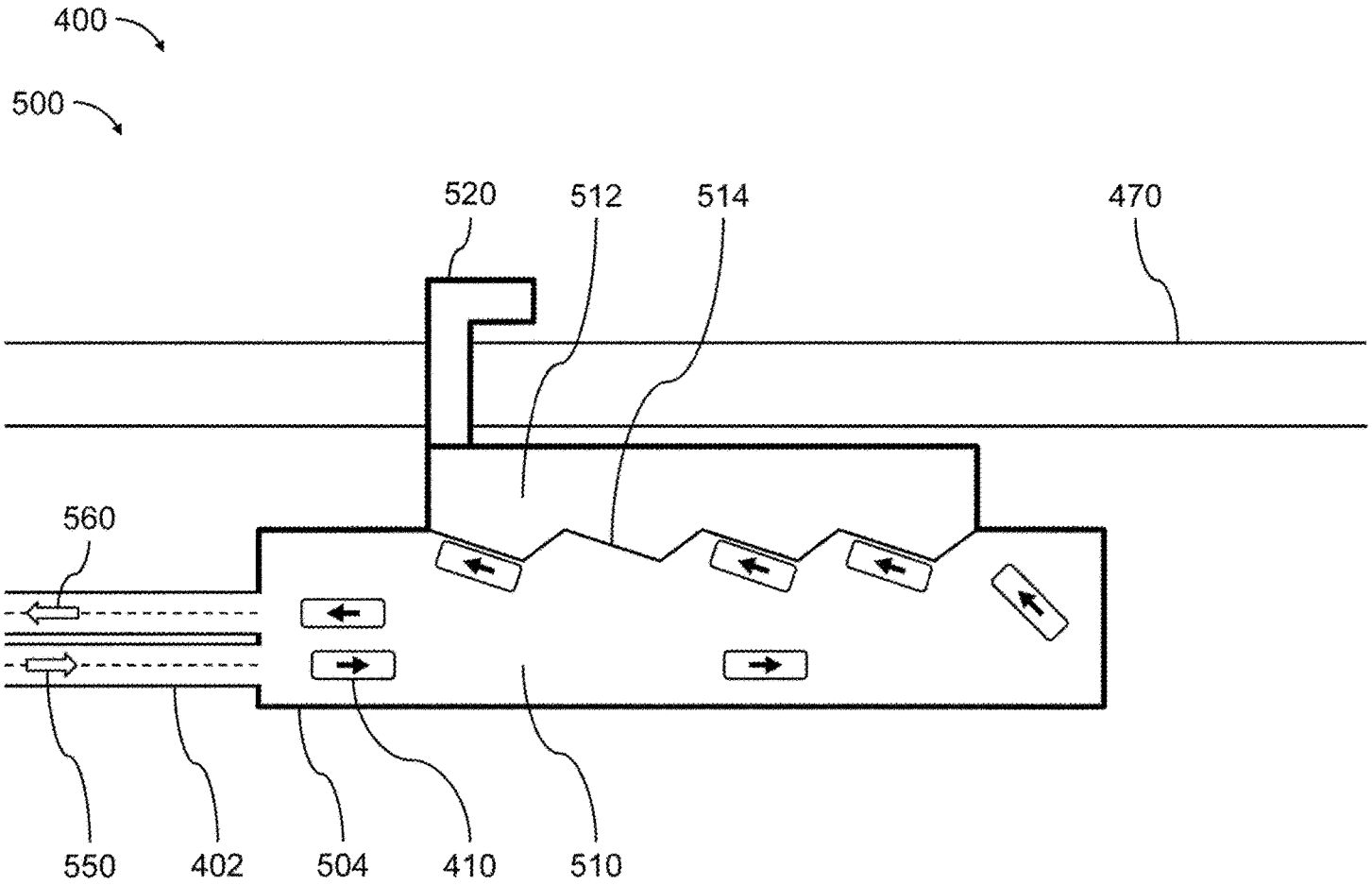
Figure 16:
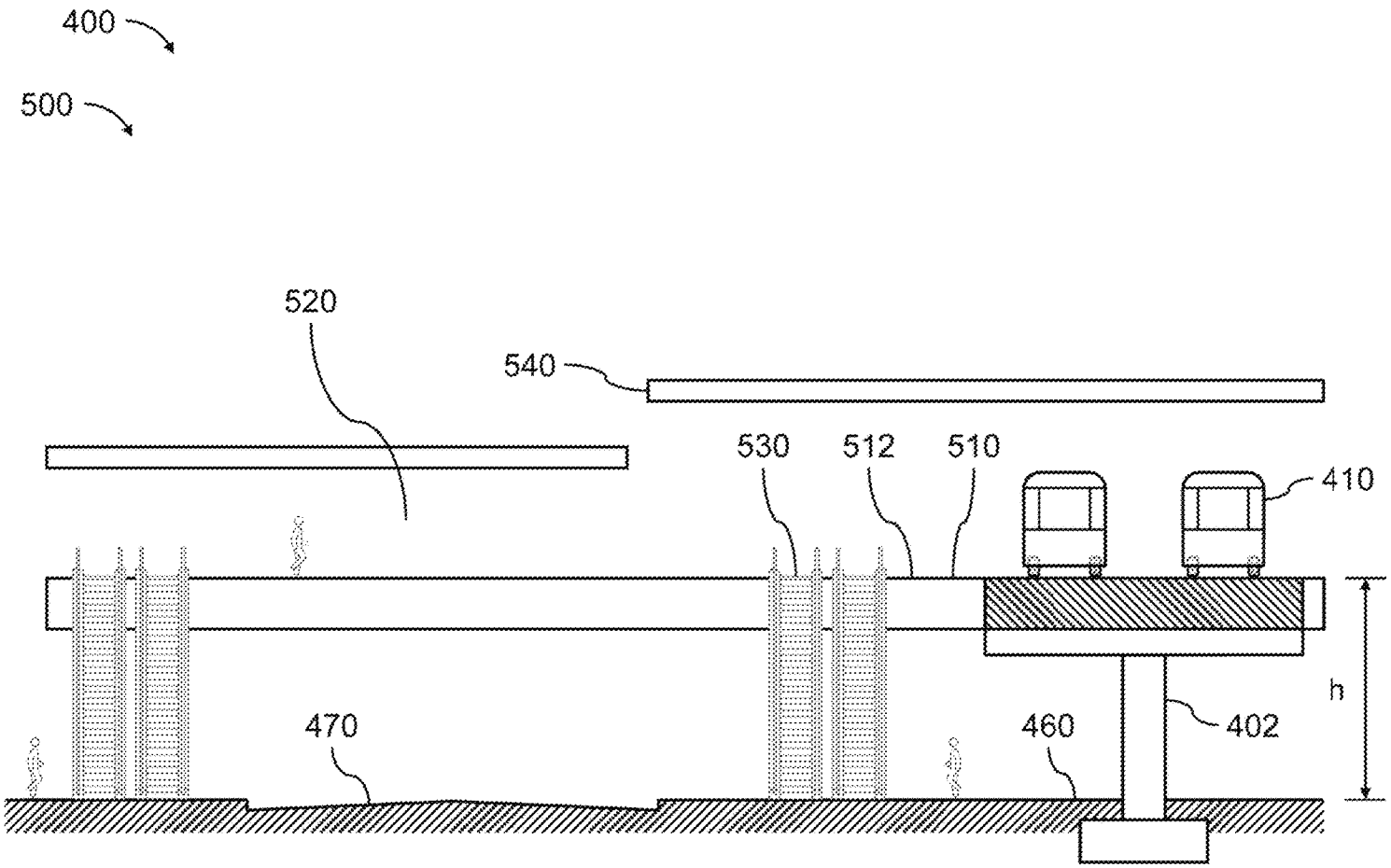

FIG. 10 is a schematic alignment of an elevated autonomous people mover system;

FIG. 11 is an elevational view of the elevated guideway structure used for the elevated autonomous people mover system of FIG. 10;

FIG. 12 is a cross-sectional view of the two vehicle elevated guideway structure used for the elevated autonomous people mover system of FIG. 10;

FIG. 13 is a cross-sectional view of the one vehicle elevated guideway structure used for the elevated autonomous people mover system of FIG. 10;

FIG. 14 is a plan view of a sawtooth junction with 4 bidirectional sawtooth berths used for the elevated autonomous people mover system of FIG. 10;

FIG. 15 is a plan view of a sawtooth terminal with 4 bidirectional sawtooth berths used for the elevated autonomous people mover system of FIG. 10;

FIG. 16 is a cross-sectional view of a sawtooth junction and sawtooth terminal with 4 bidirectional sawtooth berths used for the elevated autonomous people mover system of FIG. 10;

Sawtooth Station and Bidirectional Sawtooth Platform

Figure 17:
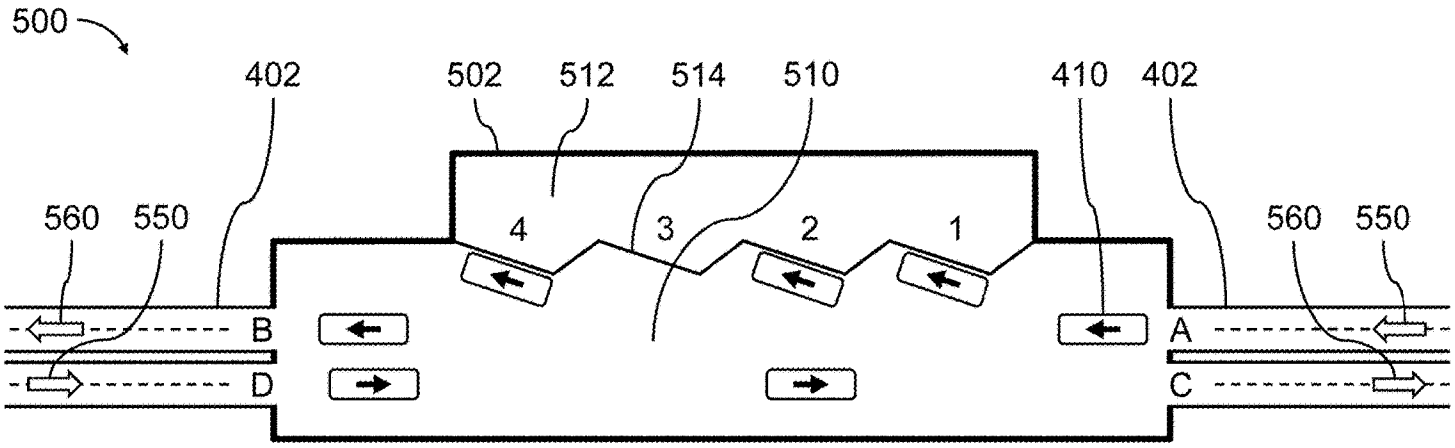
Figure 18:
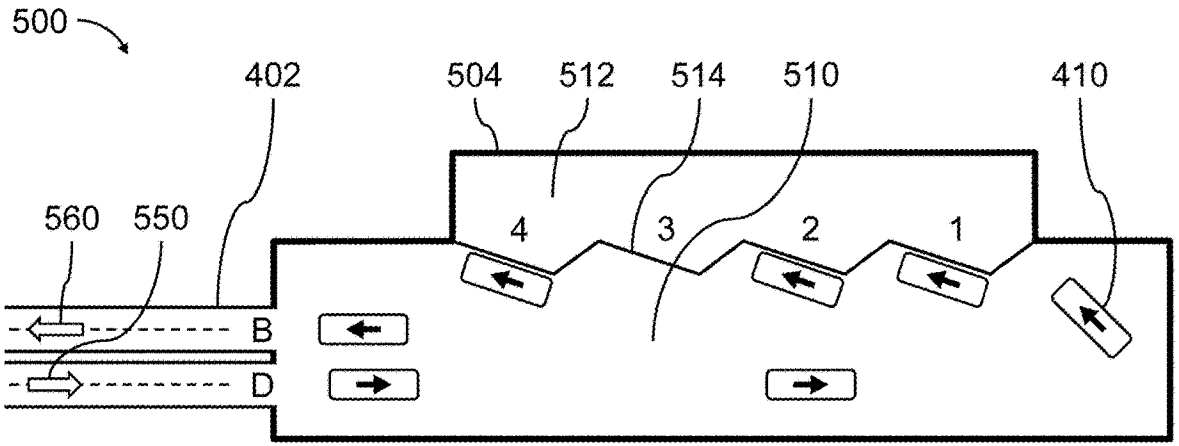
Figure 19:
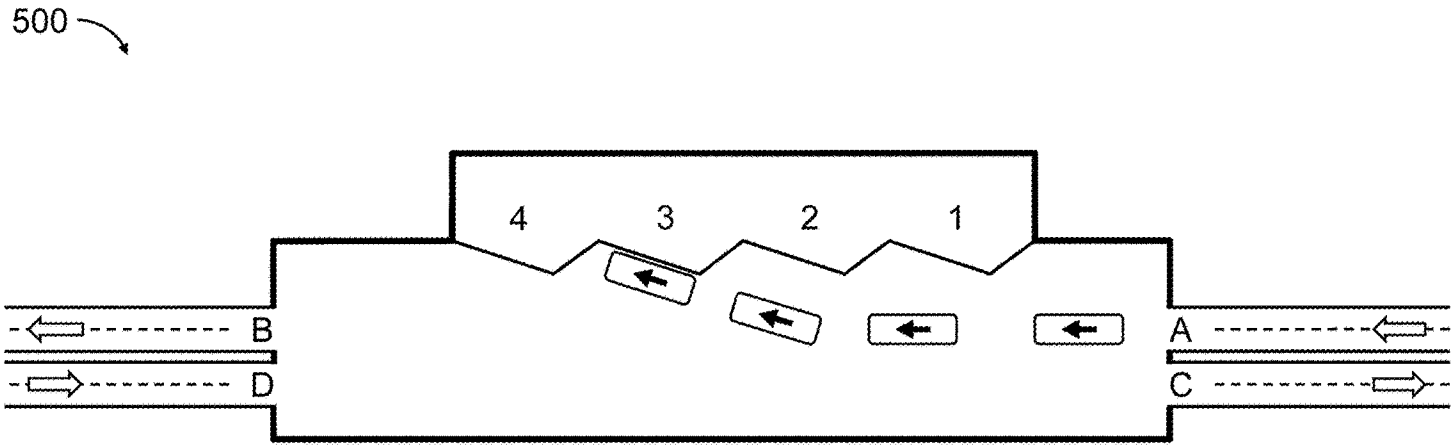
Figure 20:
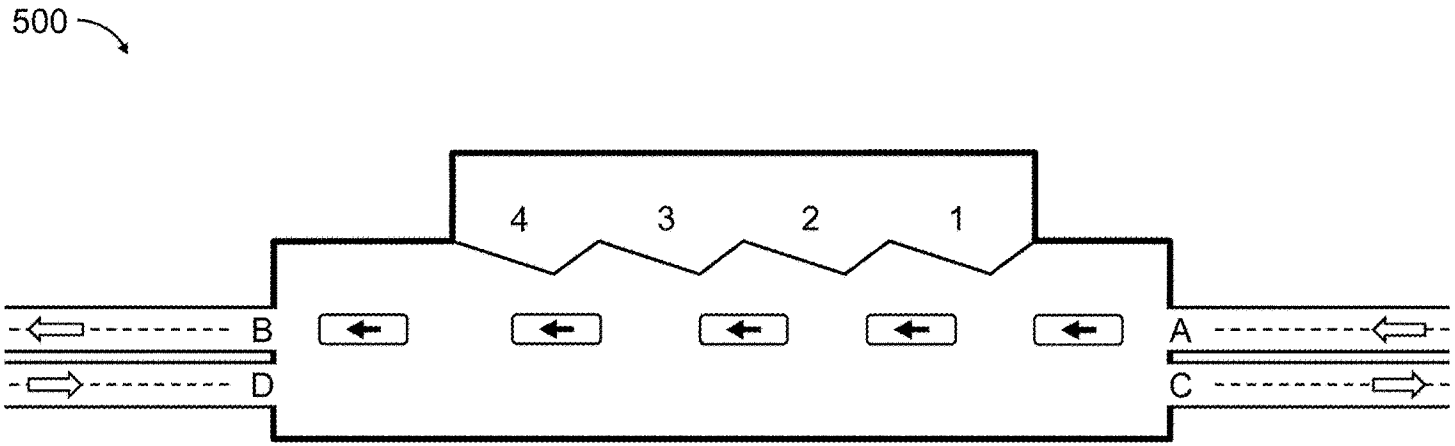
Figure 21:
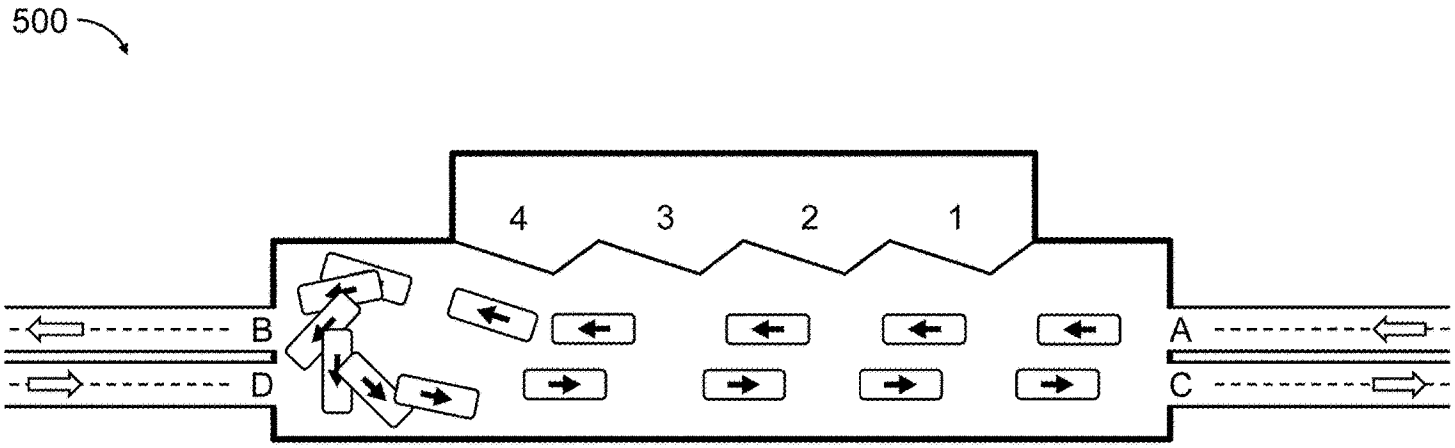
Figure 22:
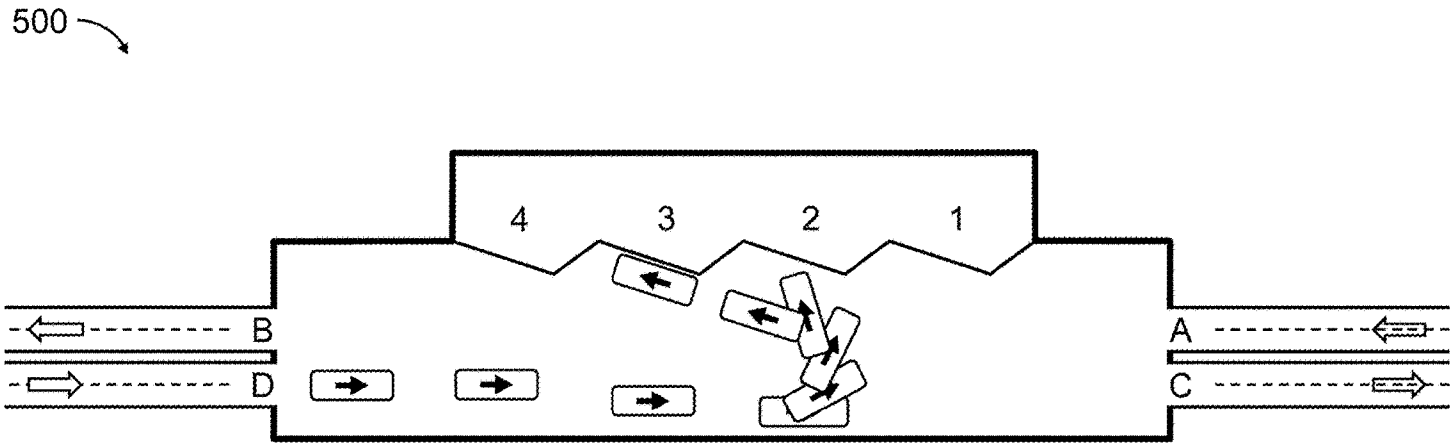
Figure 23:
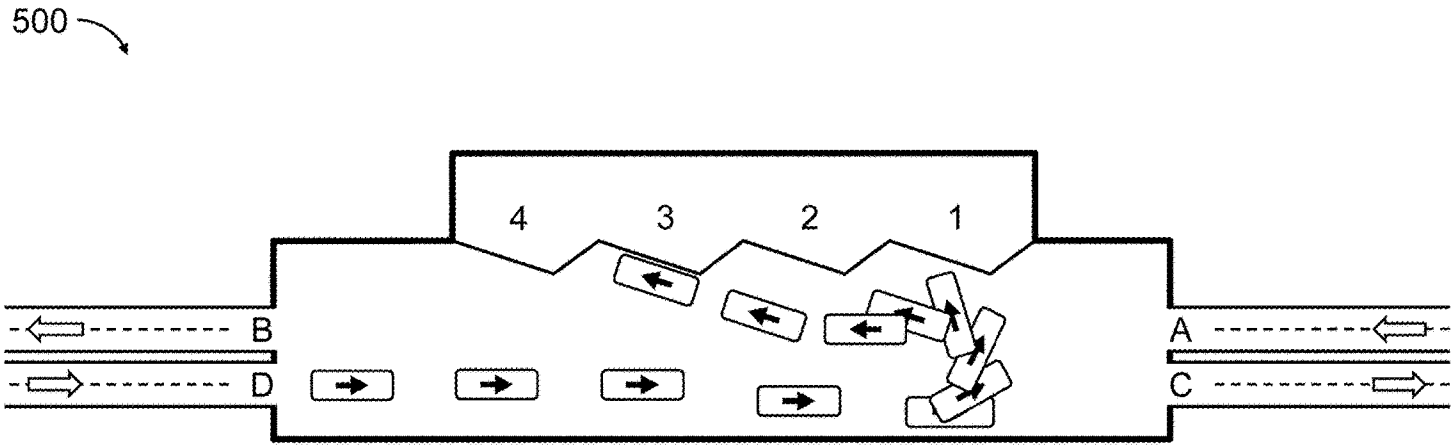
Figure 24:
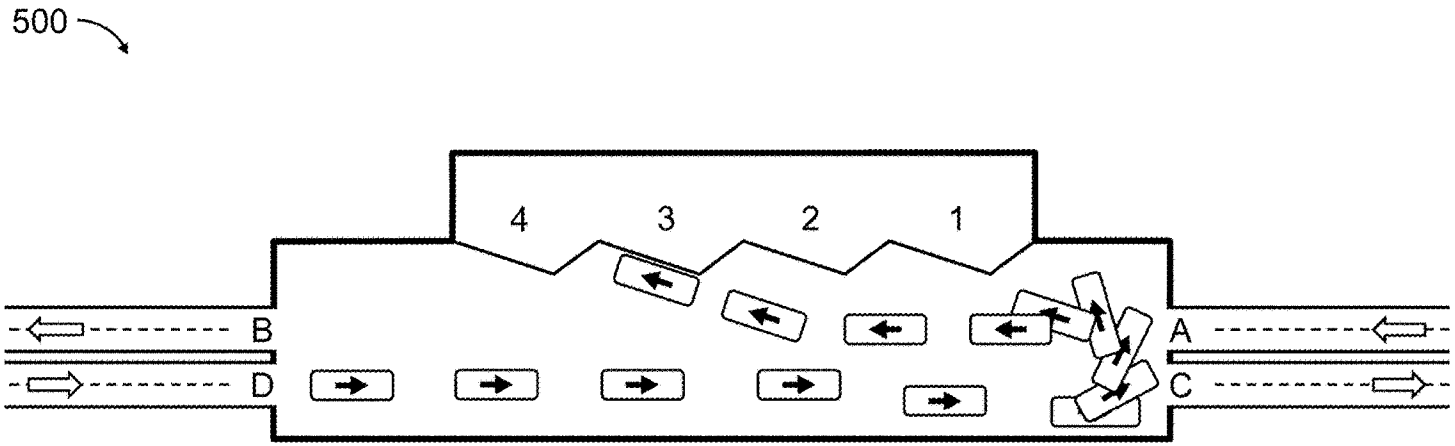
Figure 25:
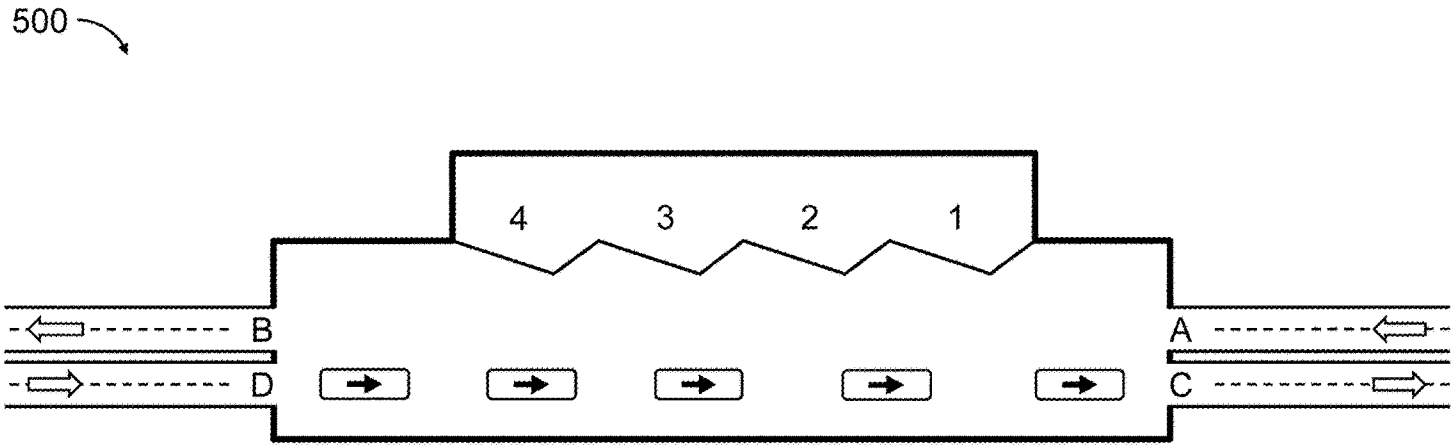
Figure 26:
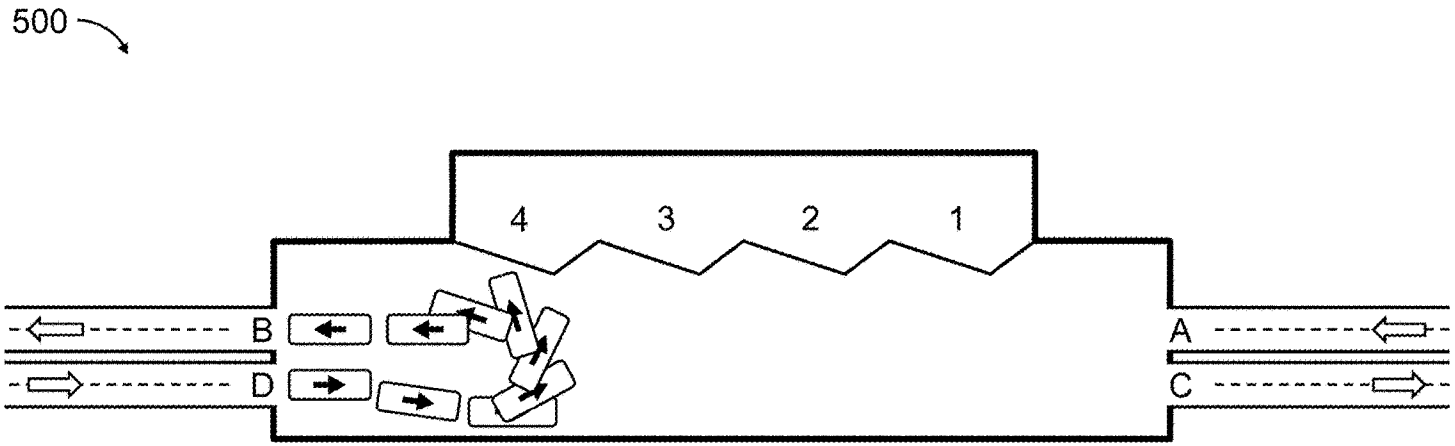
Figure 27:
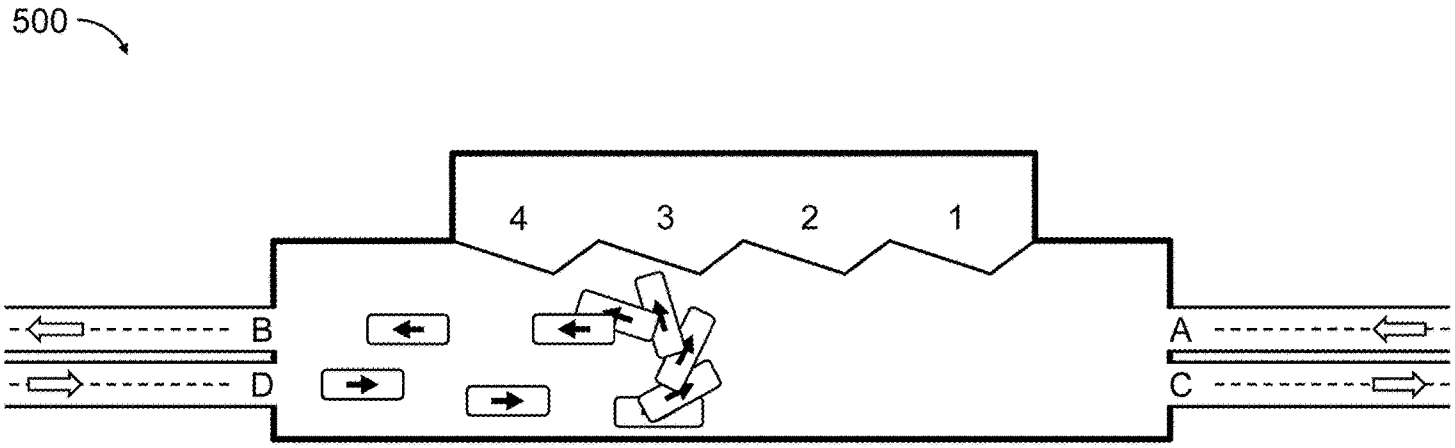
Figure 28:
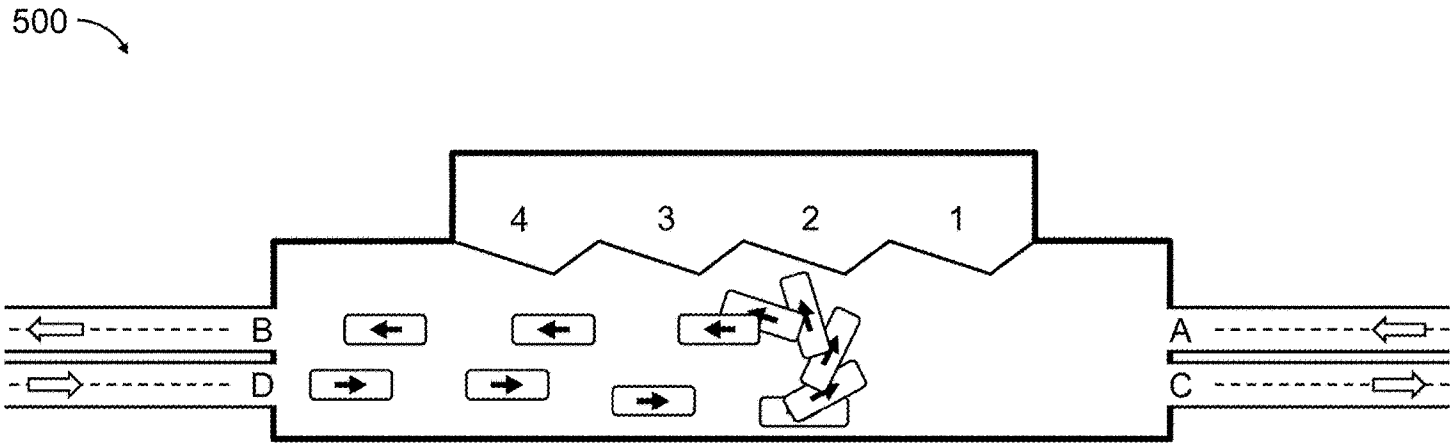
Figure 29:
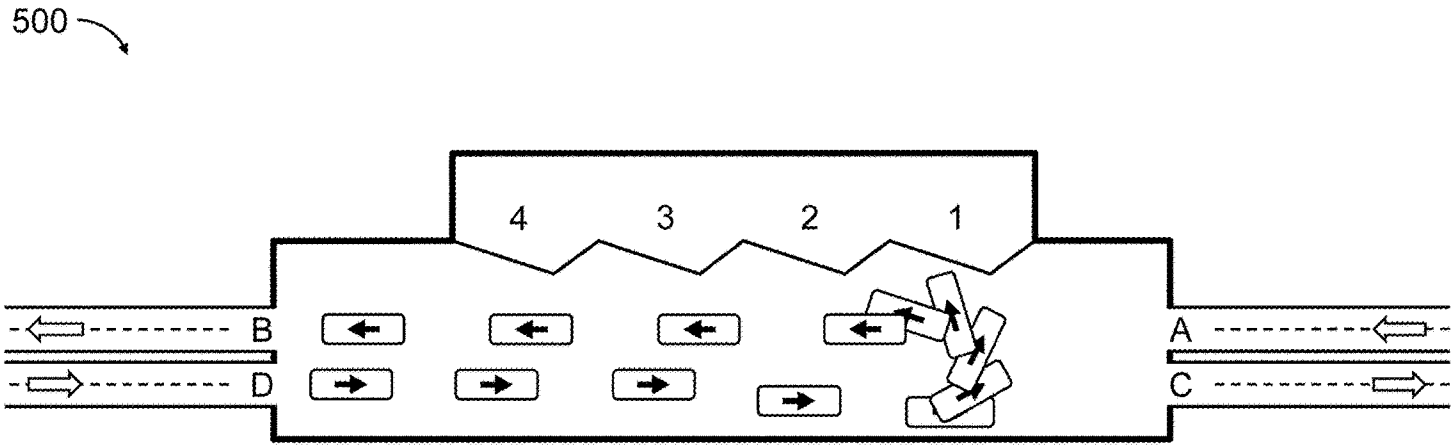
Figure 30:
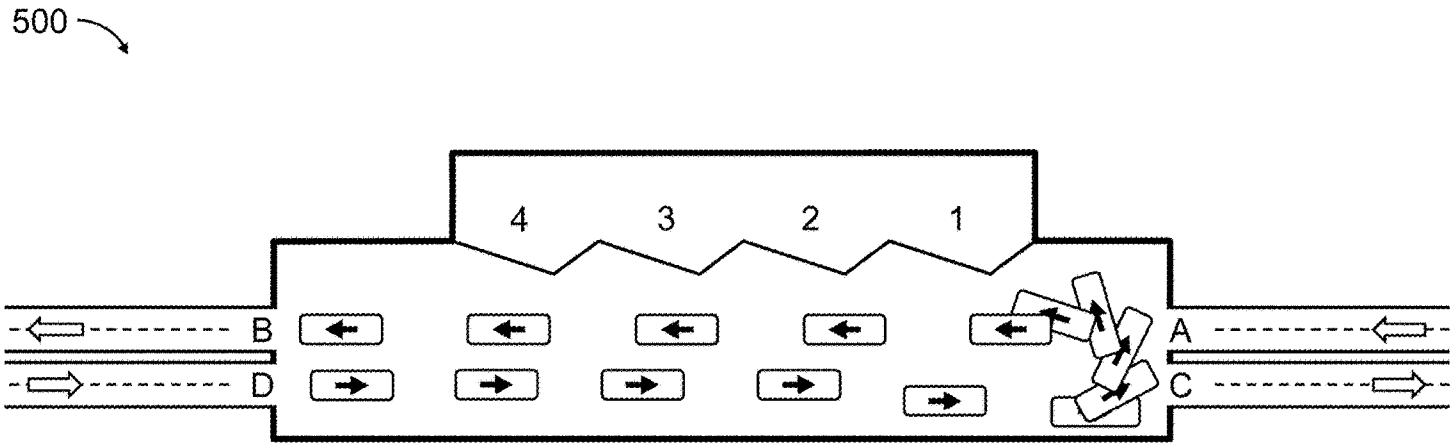
Figure 31:
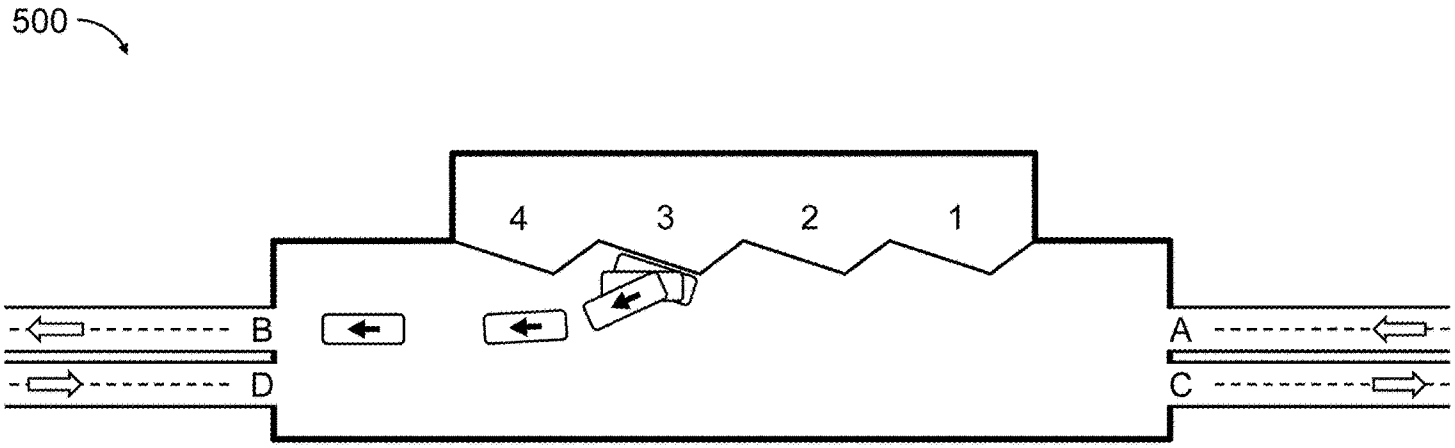
Figure 32:
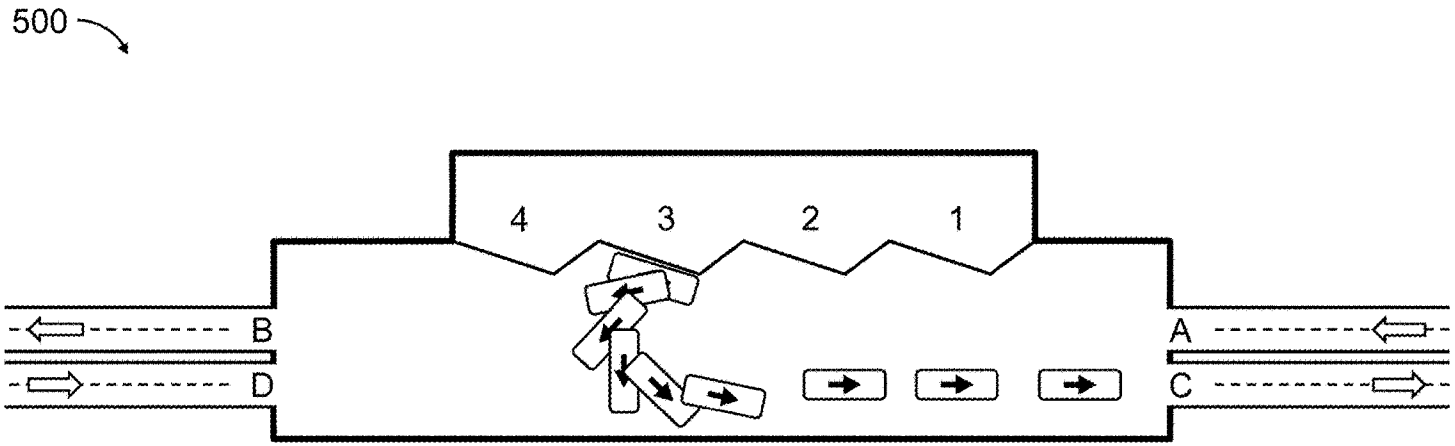
Figure 33:
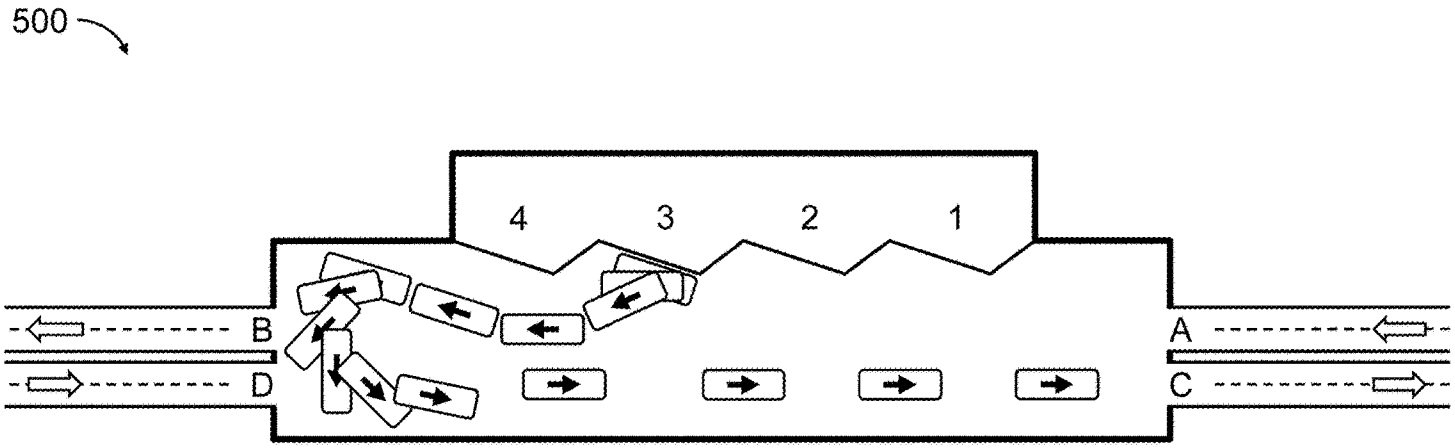
Figure 34:
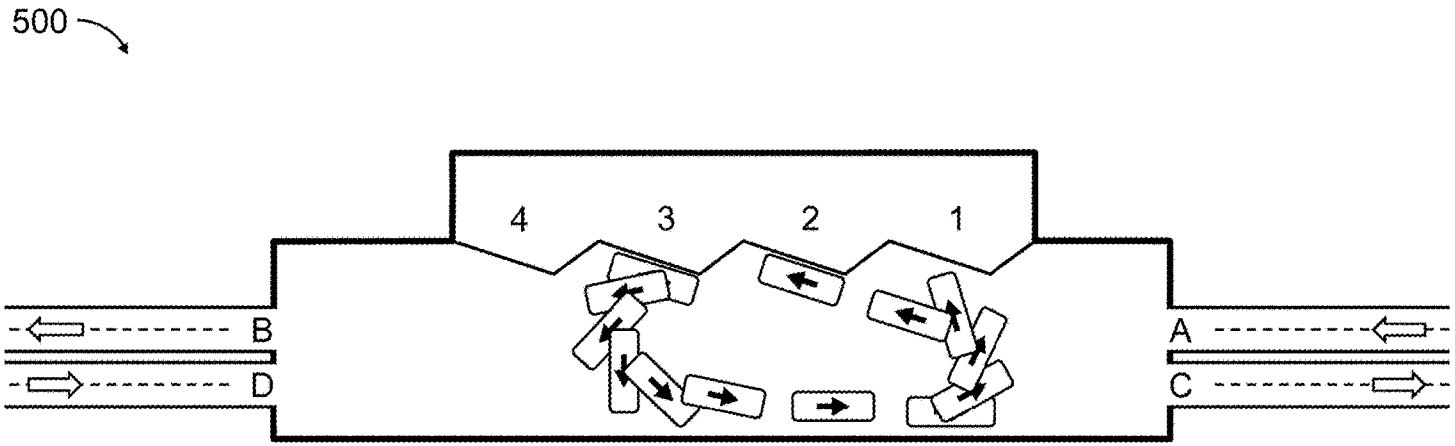
Figure 35:
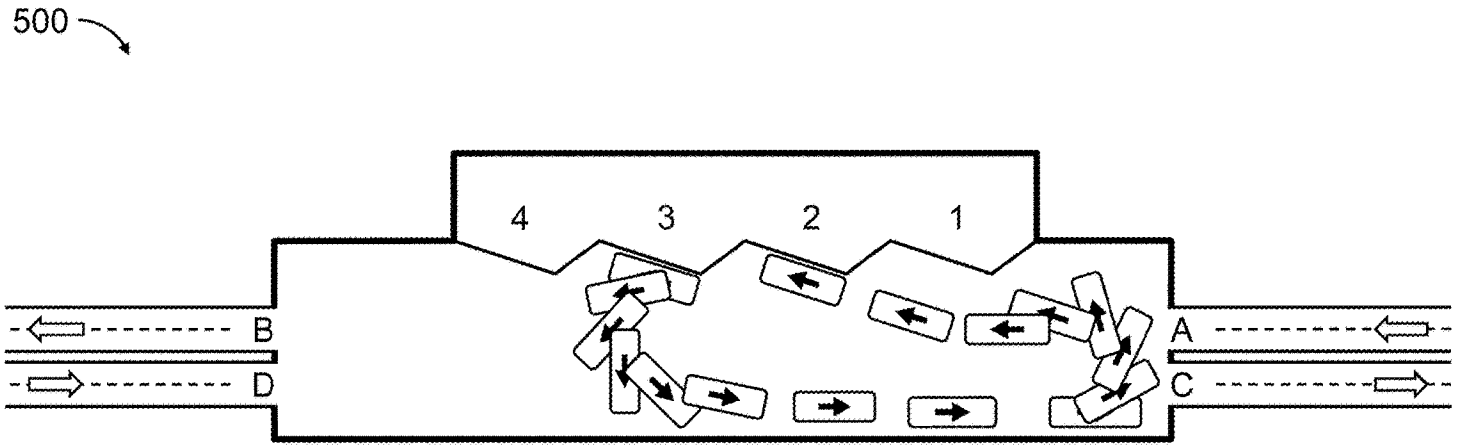
Figure 36:
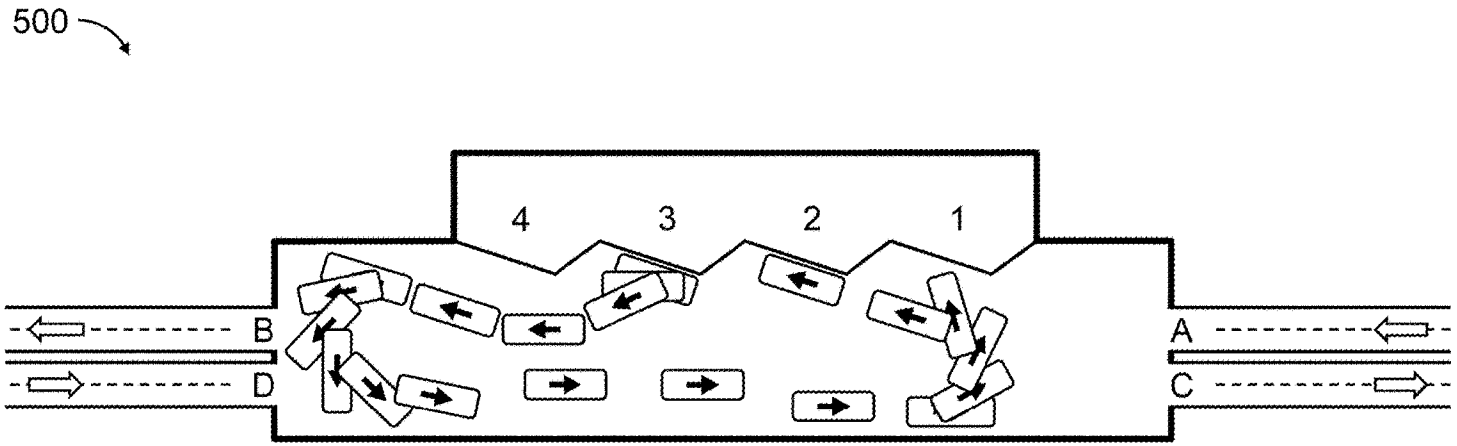
Figure 37:
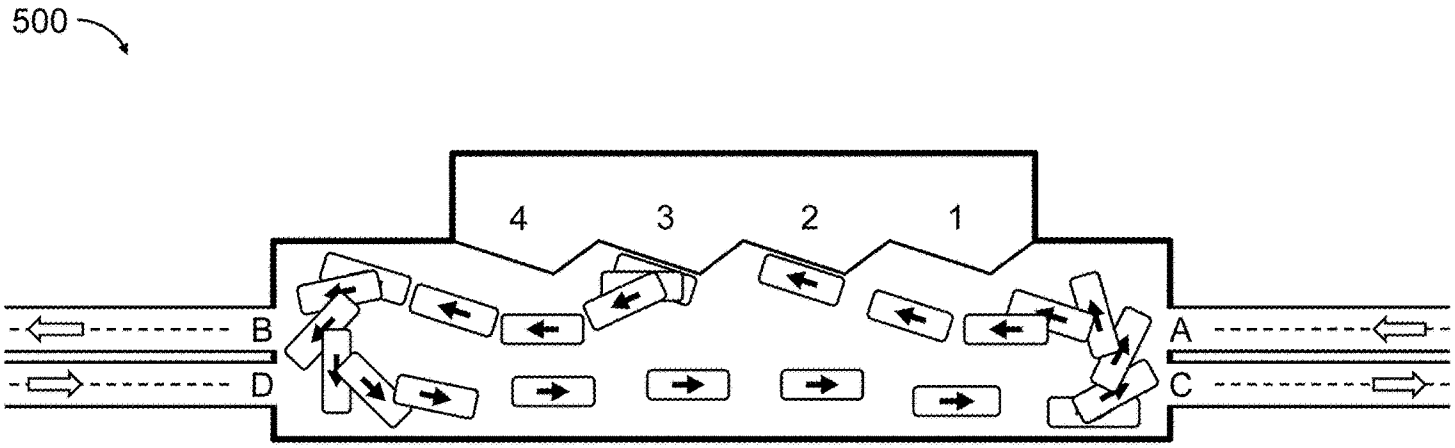
Figure 38:
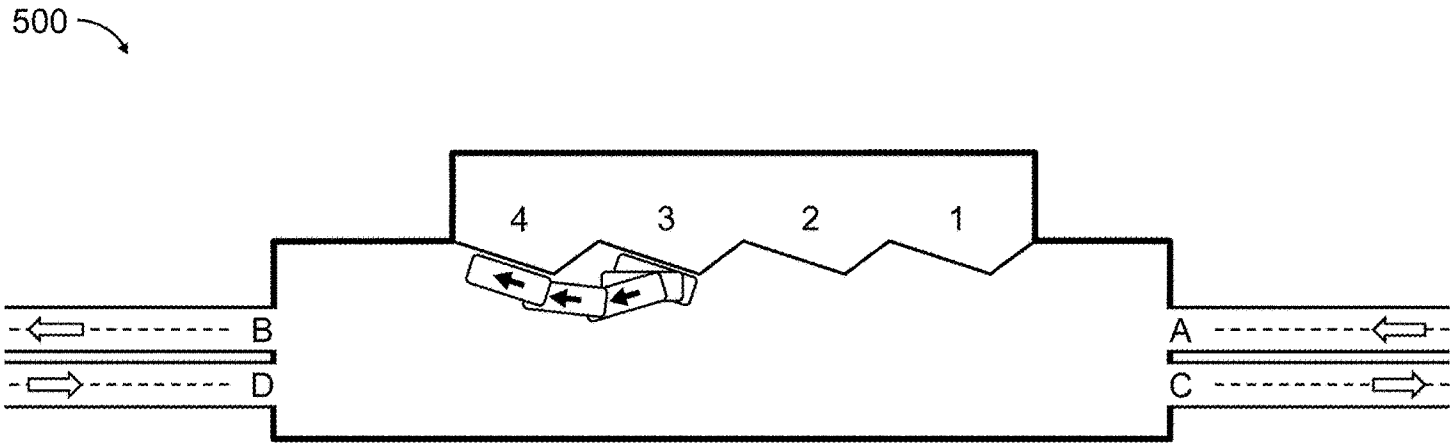
Figure 39:
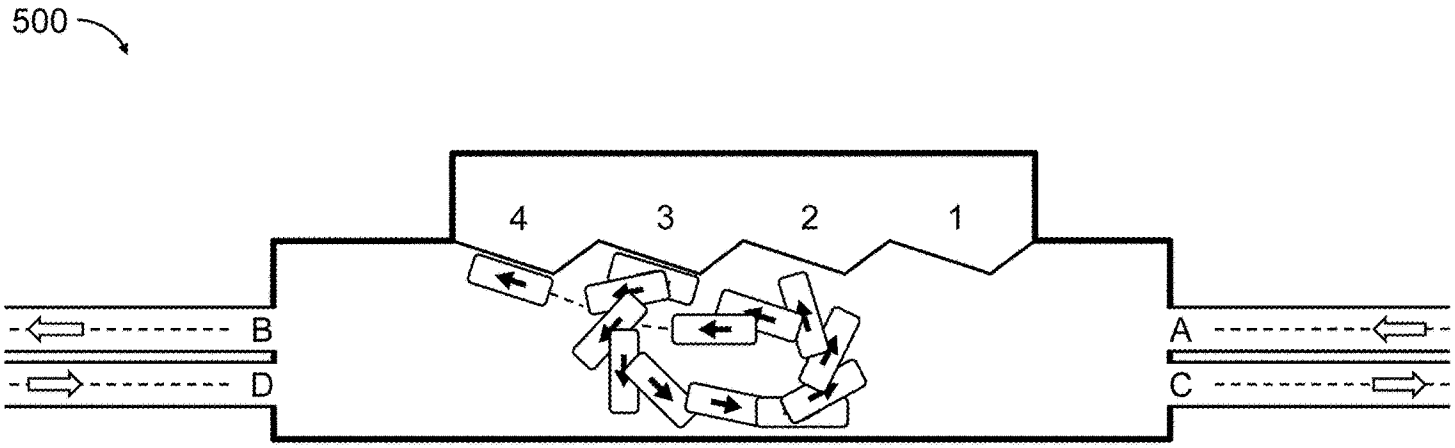
Figure 40:
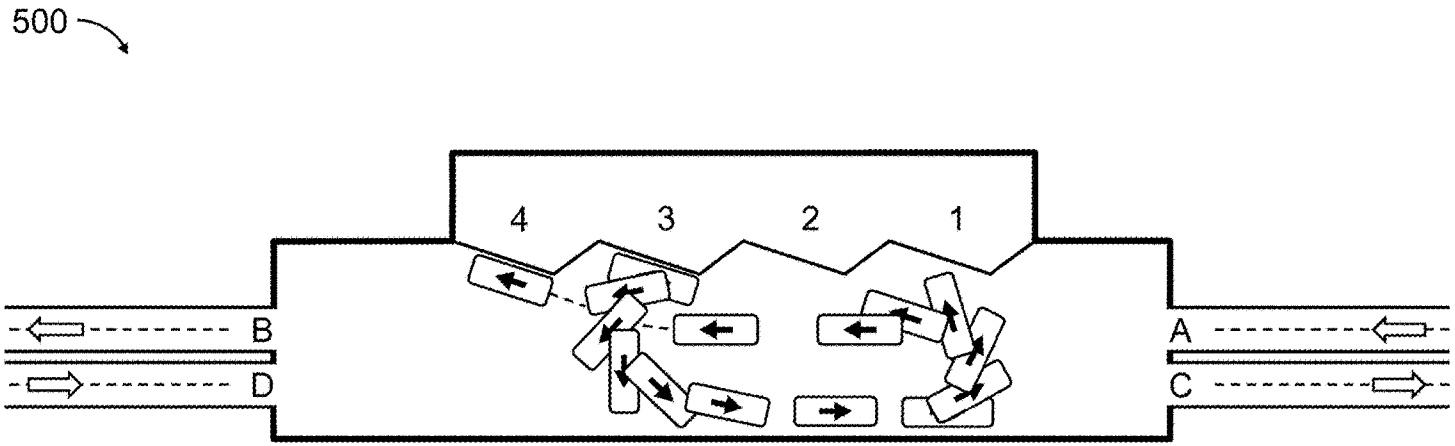
Figure 41:
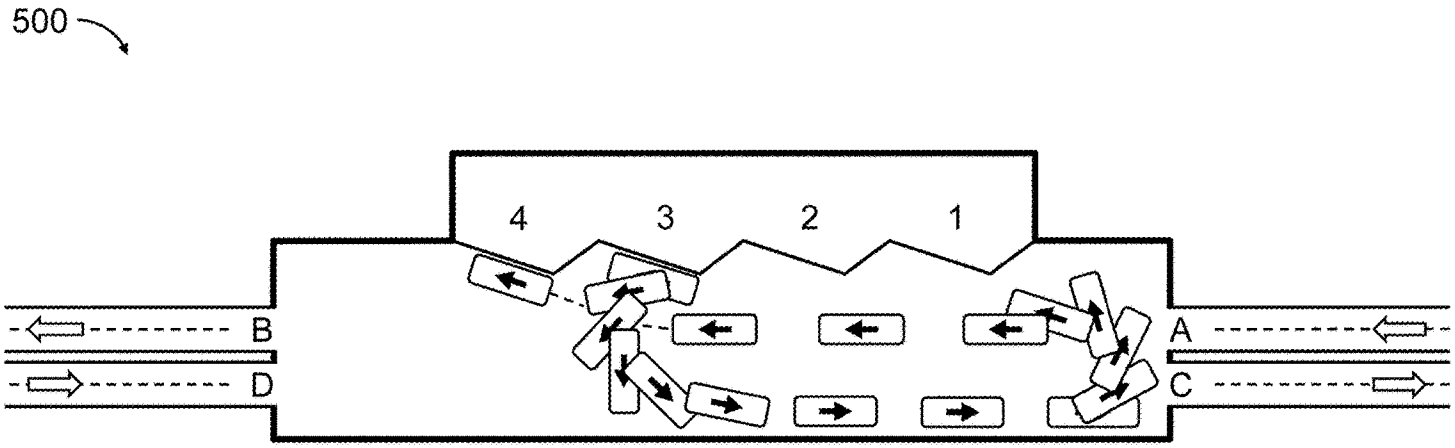
Figure 42:
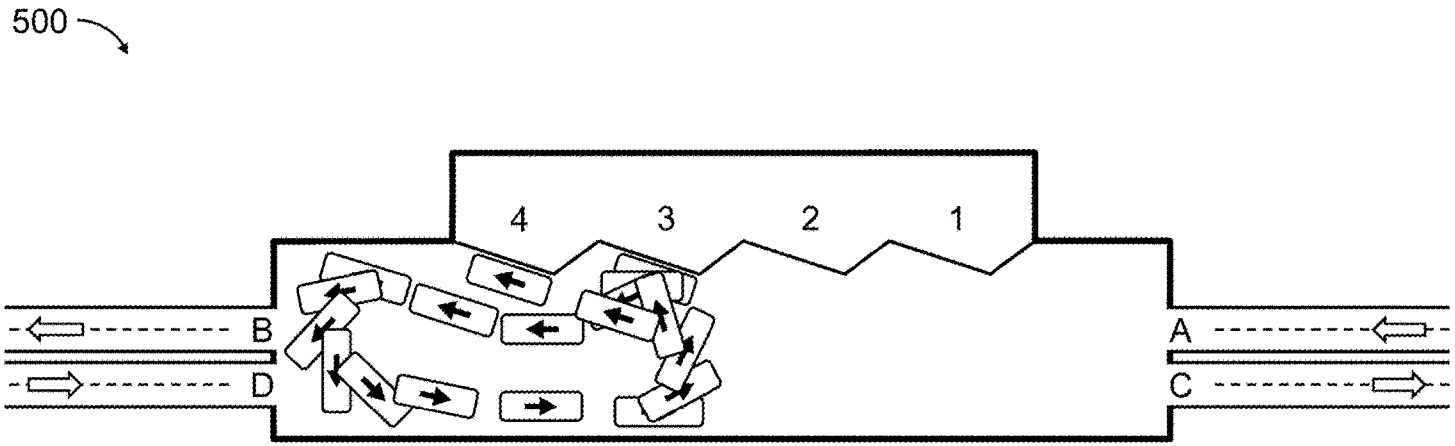
Figure 43:
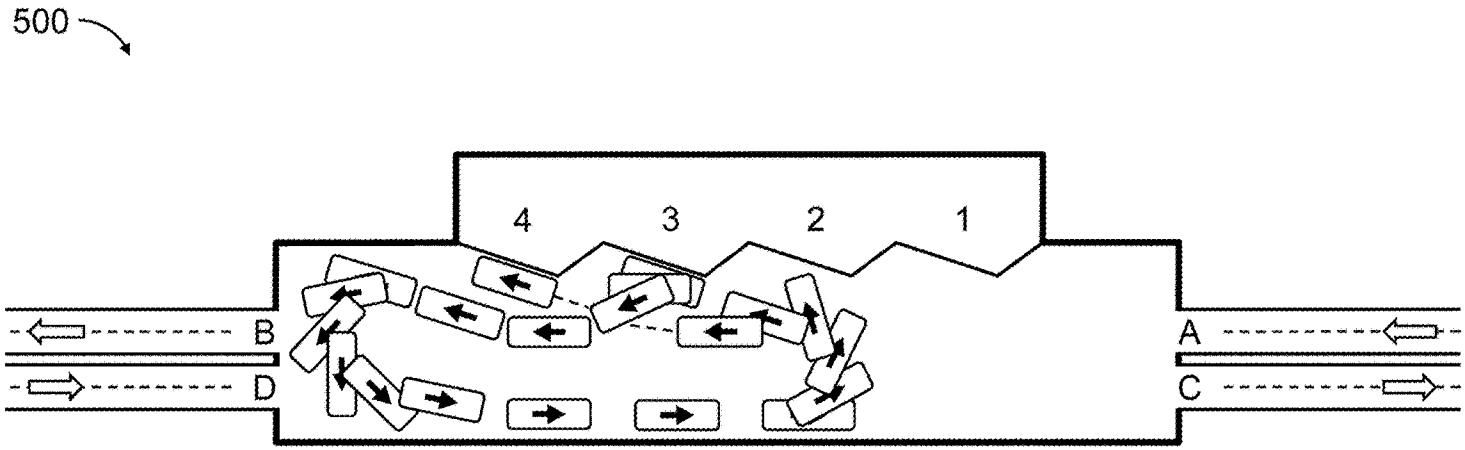
Figure 44:
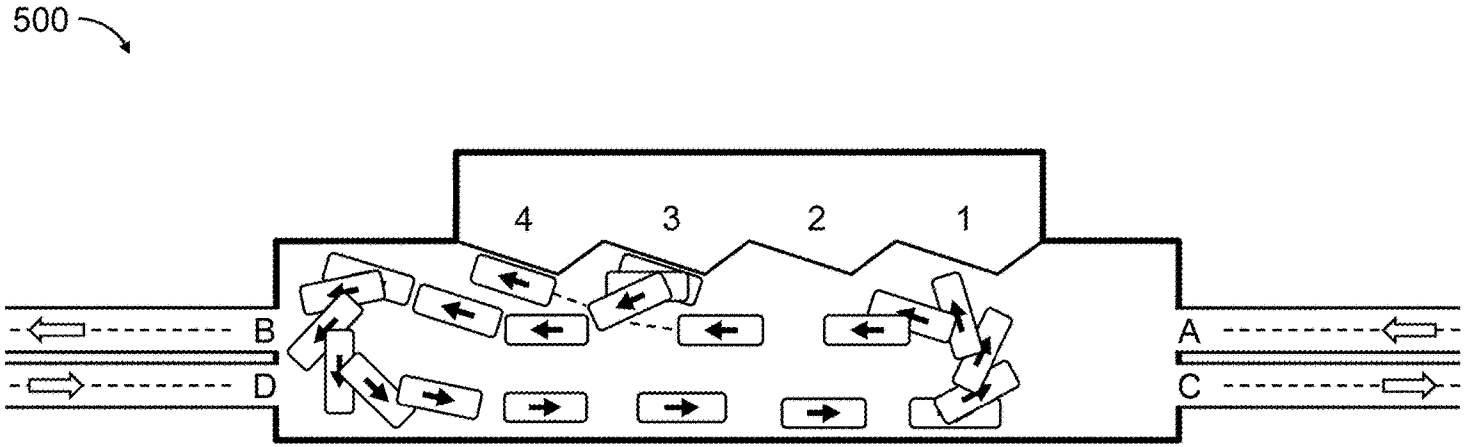
Figure 45:
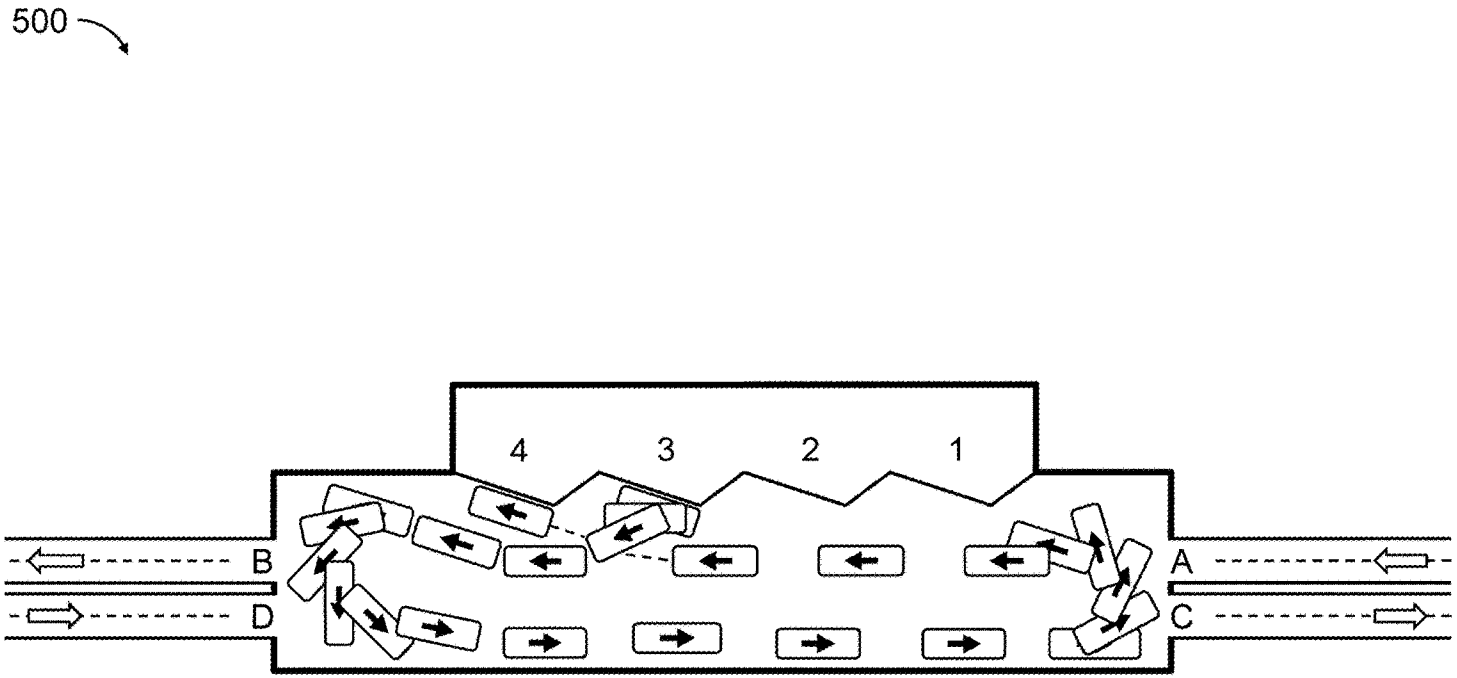

FIG. 17 illustrates the sawtooth junction an embodiment of a sawtooth station system and illustrates a general layout of an station;

FIG. 18 illustrates another embodiment of a sawtooth station system and illustrates a general layout of an end station, which is similar to the sawtooth junction of FIG. 17, but there is no entry D nor exit B;

FIG. 19 illustrates the sawtooth junction system of FIG. 17 and shows an example of an autonomous vehicle entering at entry A and stop at sawtooth berth 3;

FIG. 20 illustrates the sawtooth junction system of FIG. 17 and shows an example of an autonomous vehicle entering at entry A and exiting at exit B;

FIG. 21 illustrates the sawtooth junction system of FIG. 17 and shows an example of an autonomous vehicle entering at entry A, turning around just proximal to exit B, and exiting at exit C;

FIG. 22 illustrates the sawtooth junction system of FIG. 17 and shows an example of an autonomous vehicle entering at entry D, turning around adjacent to sawtooth berth 2 and stop at sawtooth berth 3 (option 1);

FIG. 23 illustrates the sawtooth junction system of FIG. 17 and shows an example of an autonomous vehicle entering at entry D, turning around adjacent to sawtooth berth 1 and stop at sawtooth berth 3 (option 2);

FIG. 24 illustrates the sawtooth junction system of FIG. 17 and shows an example of an autonomous vehicle entering at entry D, turning around just proximal to exit C and stop at sawtooth berth 3 (option 3);

FIG. 25 illustrates the sawtooth junction system of FIG. 17 and shows an example of an autonomous vehicle entering at entry D and exiting at exit C;

FIG. 26 illustrates the sawtooth junction system of FIG. 17 and shows an example of an autonomous vehicle entering at entry D, turning around adjacent to sawtooth berth 4 and exiting at exit B (option 1);

FIG. 27 illustrates the sawtooth junction system of FIG. 17 and shows an example of an autonomous vehicle entering at entry D, turning around adjacent to sawtooth berth 3 and exiting at exit B (option 2);

FIG. 28 illustrates the sawtooth junction system of FIG. 17 and shows an example of an autonomous vehicle entering at entry D, turning around adjacent to sawtooth berth 2 and exiting at exit B (option 3);

FIG. 29 illustrates the sawtooth junction system of FIG. 17 and shows an example of an autonomous vehicle entering at entry D, turning around adjacent to sawtooth berth 1 and exiting at exit B (option 4);

FIG. 30 illustrates the sawtooth junction system of FIG. 17 and shows an example of an autonomous vehicle entering at entry D, turning around adjacent to exit C and exiting at exit B (option 5);

FIG. 31 illustrates the sawtooth junction system of FIG. 17 and shows an example of an autonomous vehicle leaving sawtooth berth 3 and exiting at exit B;

FIG. 32 illustrates the sawtooth junction system of FIG. 17 and shows an example of an autonomous vehicle leaving sawtooth berth 3, immediately turning around, and exiting at exit C (option 1);

FIG. 33 illustrates the sawtooth junction system of FIG. 17 and shows an example of an autonomous vehicle leaving sawtooth berth 3, turning around adjacent to exit B, and exiting at exit C (option 2);

FIG. 34 illustrates the sawtooth junction system of FIG. 17 and shows an example of an autonomous vehicle leaving sawtooth berth 3, immediately turning around, turning around again adjacent to sawtooth berth 1, and stop at sawtooth berth 2 (option 1);

FIG. 35 illustrates the sawtooth junction system of FIG. 17 and shows an example of an autonomous vehicle leaving sawtooth berth 3, immediately turning around, turning around again just proximal to exit C, and stop at sawtooth berth 2 (option 2);

FIG. 36 illustrates the sawtooth junction system of FIG. 17 and shows an example of an autonomous vehicle leaving sawtooth berth 3, immediately turning around, turning around again adjacent to sawtooth berth 1, and stop at sawtooth berth 2 (option 3);

FIG. 37 illustrates the sawtooth junction system of FIG. 17 and shows an example of an autonomous vehicle leaving sawtooth berth 3, turning around, turning around just proximal to exit B, turning around again just proximal to exit C, and stop at sawtooth berth 2 (option 4);

FIG. 38 illustrates the sawtooth junction system of FIG. 17 and shows an example of an autonomous vehicle leaving sawtooth berth 3, and stop at sawtooth berth 4 (option 1);

FIG. 39 illustrates the sawtooth junction system of FIG. 17 and shows an example of an autonomous vehicle leaving sawtooth berth 3, immediately turning around, turning around again adjacent to sawtooth berth 2, and stop at sawtooth berth 4 (option 2);

FIG. 40 illustrates the sawtooth junction system of FIG. 17 and shows an example of an autonomous vehicle leaving sawtooth berth 3, immediately turning around, turning around again adjacent to sawtooth berth 1, and stop at sawtooth berth 4 (option 3);

FIG. 41 illustrates the sawtooth junction system of FIG. 17 and shows an example of an autonomous vehicle leaving sawtooth berth 3, immediately turning around, turning around again just proximal to exit C, and stop at sawtooth berth 4 (option 4);

FIG. 42 illustrates the sawtooth junction system of FIG. 17 and shows an example of an autonomous vehicle leaving sawtooth berth 3, turning around just proximal to exit B, turning around again adjacent to sawtooth berth 3, and stop at sawtooth berth 4 (option 5);

FIG. 43 illustrates the sawtooth junction system of FIG. 17 and shows an example of an autonomous vehicle leaving sawtooth berth 3, turning around just proximal to exit B, turning around again adjacent to sawtooth berth 2, and stop at sawtooth berth 4 (option 6);

FIG. 44 illustrates the sawtooth junction system of FIG. 17 and shows an example of an autonomous vehicle leaving sawtooth berth 3, turning around just proximal to exit B, turning around again adjacent to sawtooth berth 1, and stop at sawtooth berth 4 (option 7);

FIG. 45 illustrates the sawtooth junction system of FIG. 17 and shows an example of an autonomous vehicle leaving sawtooth berth 3, turning around just proximal to exit B, turning around again just proximal to exit C, and stop at sawtooth berth 4 (option 8);

Car Tether

Figure 46:
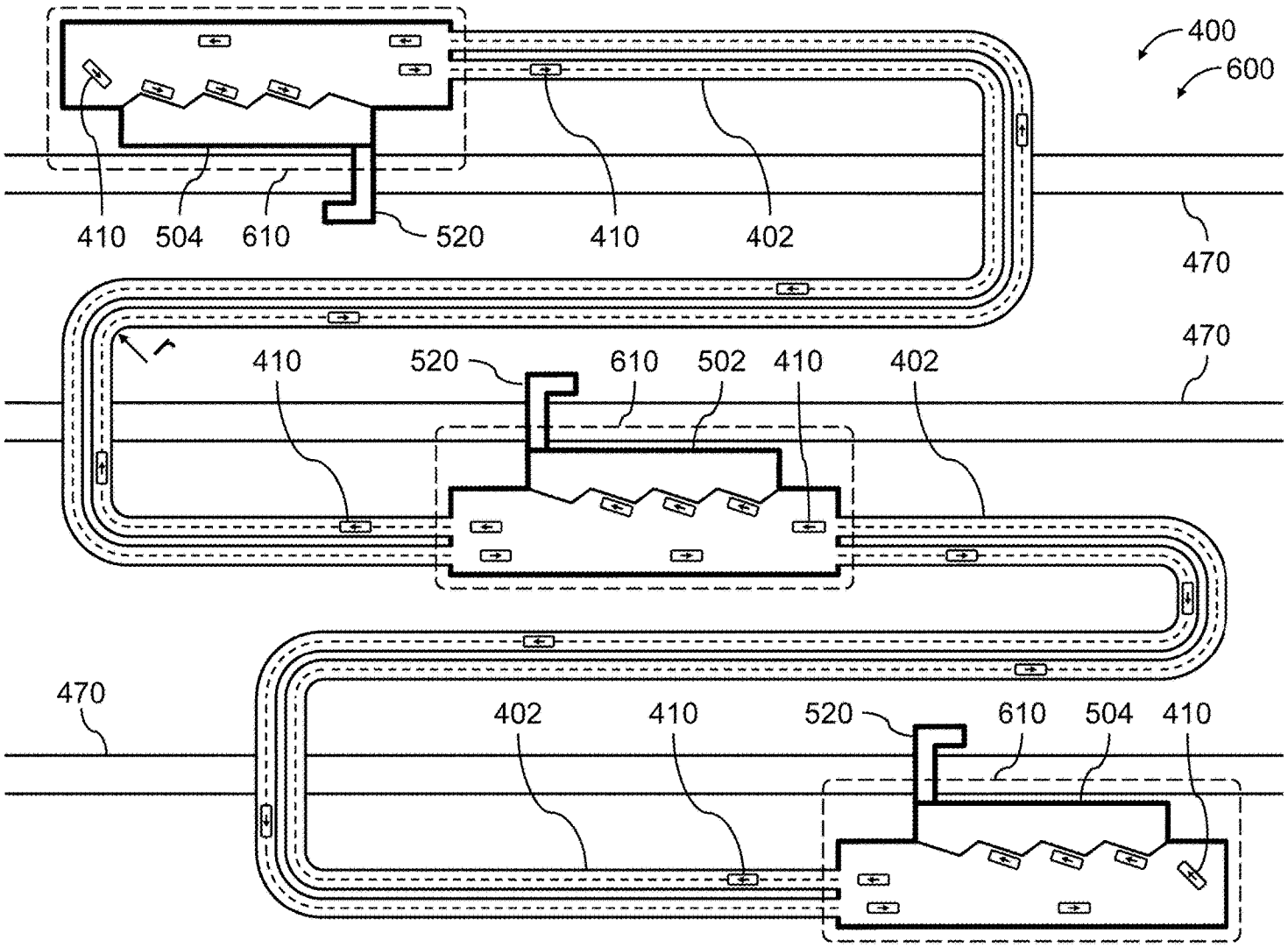
Figure 47:
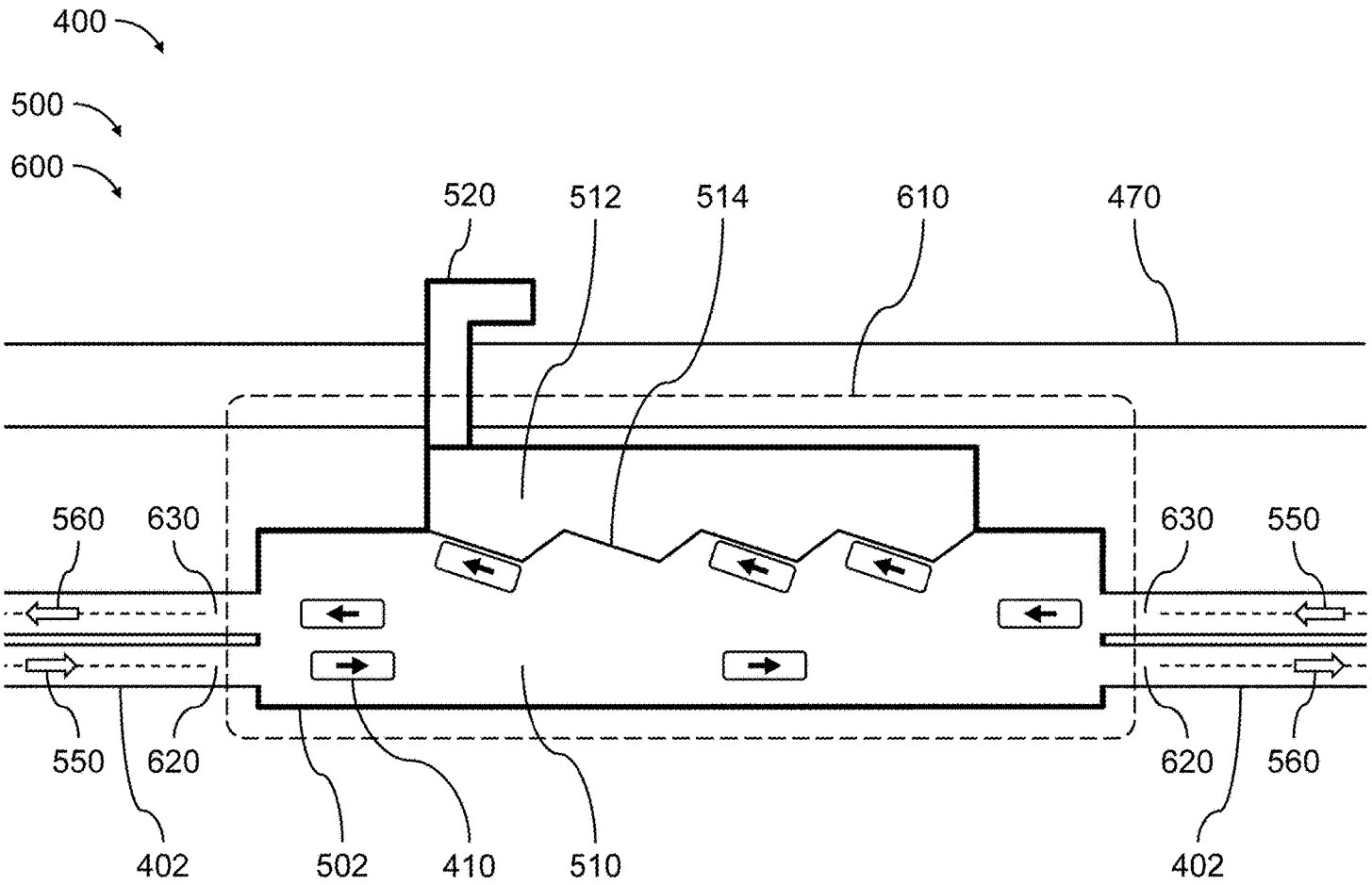
Figure 48:
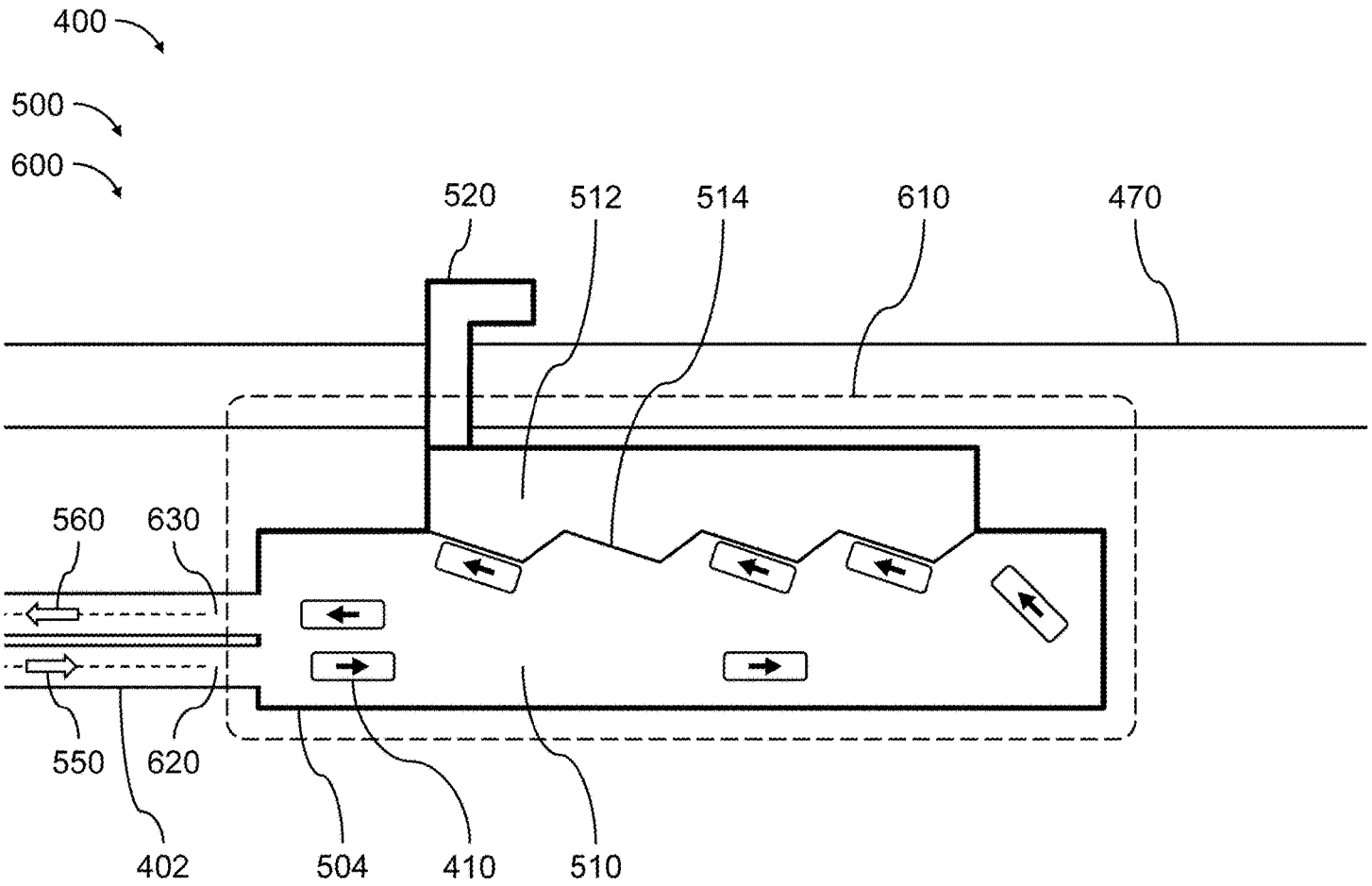
Figure 49:
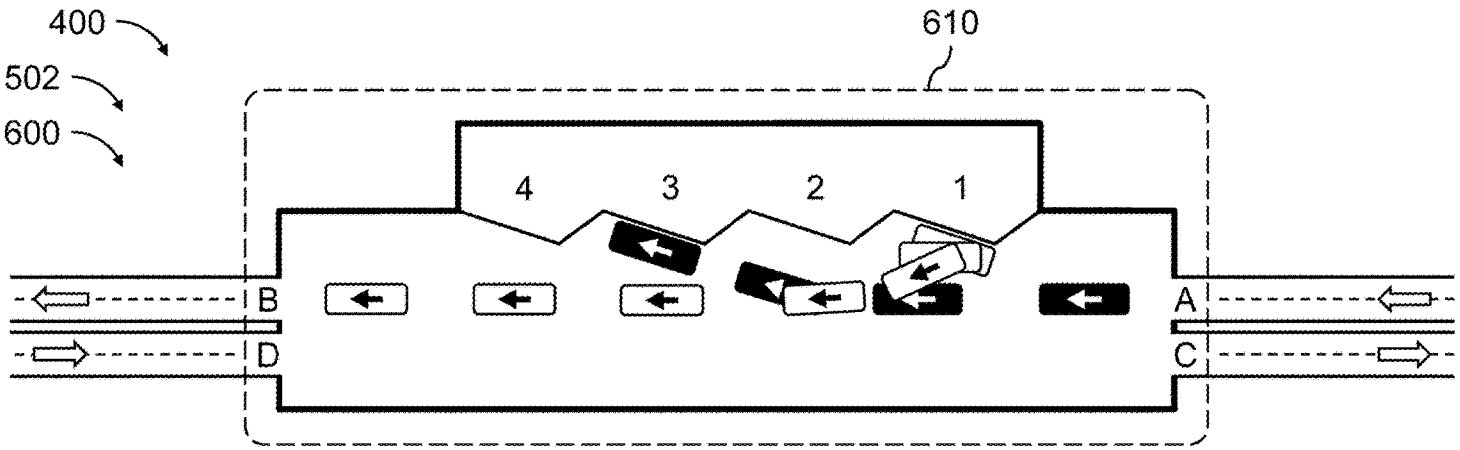
Figure 50:
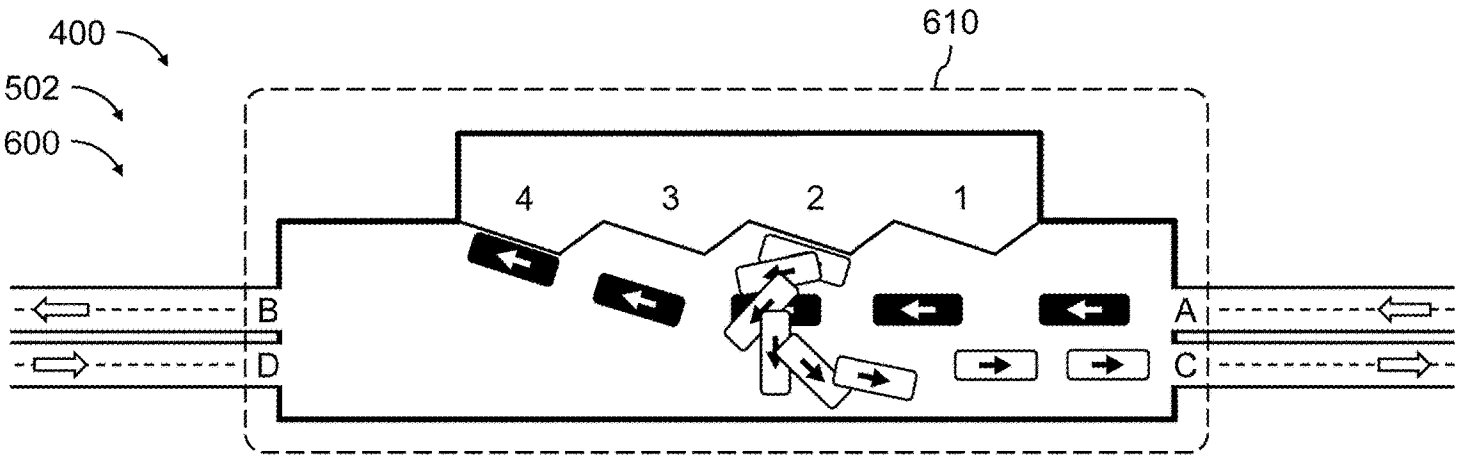
Figure 51:
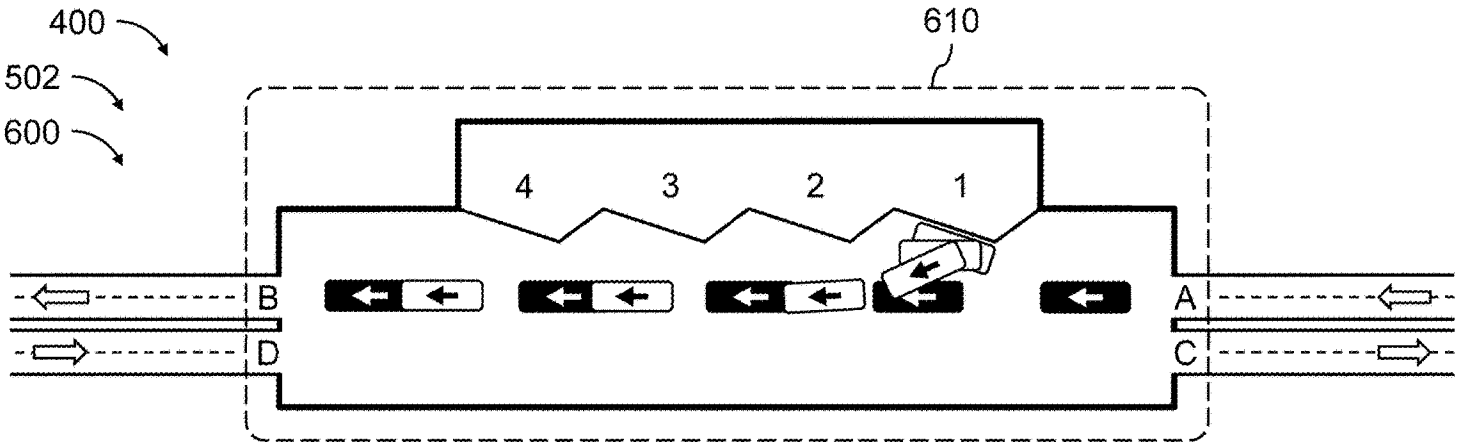
Figure 52:
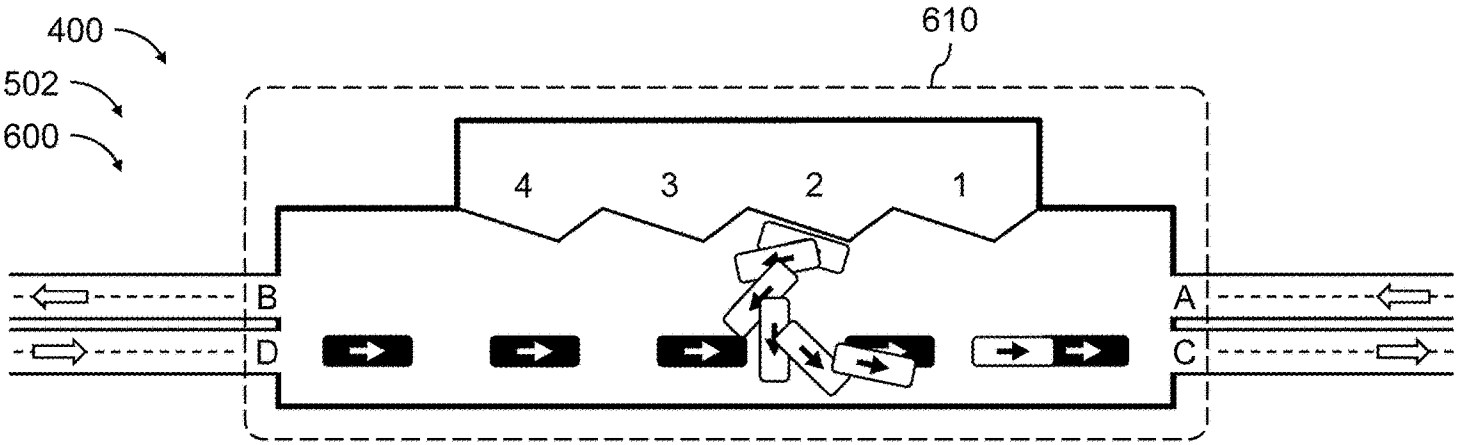

FIG. 46 is an embodiment of a car tether system controlling autonomous vehicles in an elevated autonomously people mover system environment of FIG. 10, where each sawtooth station system is controlled by a car tether system;

FIG. 47 is an embodiment of a car tether system of FIG. 46 controlling autonomous vehicles in a sawtooth junction system of FIG. 17 environment;

FIG. 48 is an embodiment of a car tether system of FIG. 46 controlling autonomous vehicles in a sawtooth terminal system of FIG. 18 environment;

FIG. 49 illustrates the sawtooth junction system of FIG. 47, and shows an example two autonomous vehicles directional flow merge as follows: one autonomous vehicle enters at entry A and stops at sawtooth berth 3, the other autonomous vehicle leaves sawtooth berth 1 and exits at exit B;

FIG. 50 illustrates the sawtooth junction system of FIG. 47, and shows an example two autonomous vehicles 410 directional flow merge as follows: one autonomous vehicle enters at entry A and stops at sawtooth berth 3, the other autonomous vehicle leaves sawtooth berth 2, immediately turns around, and exits at exit C;

FIG. 51 illustrates the sawtooth junction system of FIG. 47, and shows an example two autonomous vehicles directional flow merge as follows: one autonomous vehicle 410 enters at entry A and exits at exit B, the other autonomous vehicle leaves sawtooth berth 1 and exits at exit B;

FIG. 52 illustrates the sawtooth junction system of FIG. 47, and shows an example two autonomous vehicles directional flow merge as follows: one autonomous vehicle enters at entry D and exits at exit C, the other autonomous vehicle leaves sawtooth berth 2, immediately turns around, and exits at exit C;

System

Figure 53:
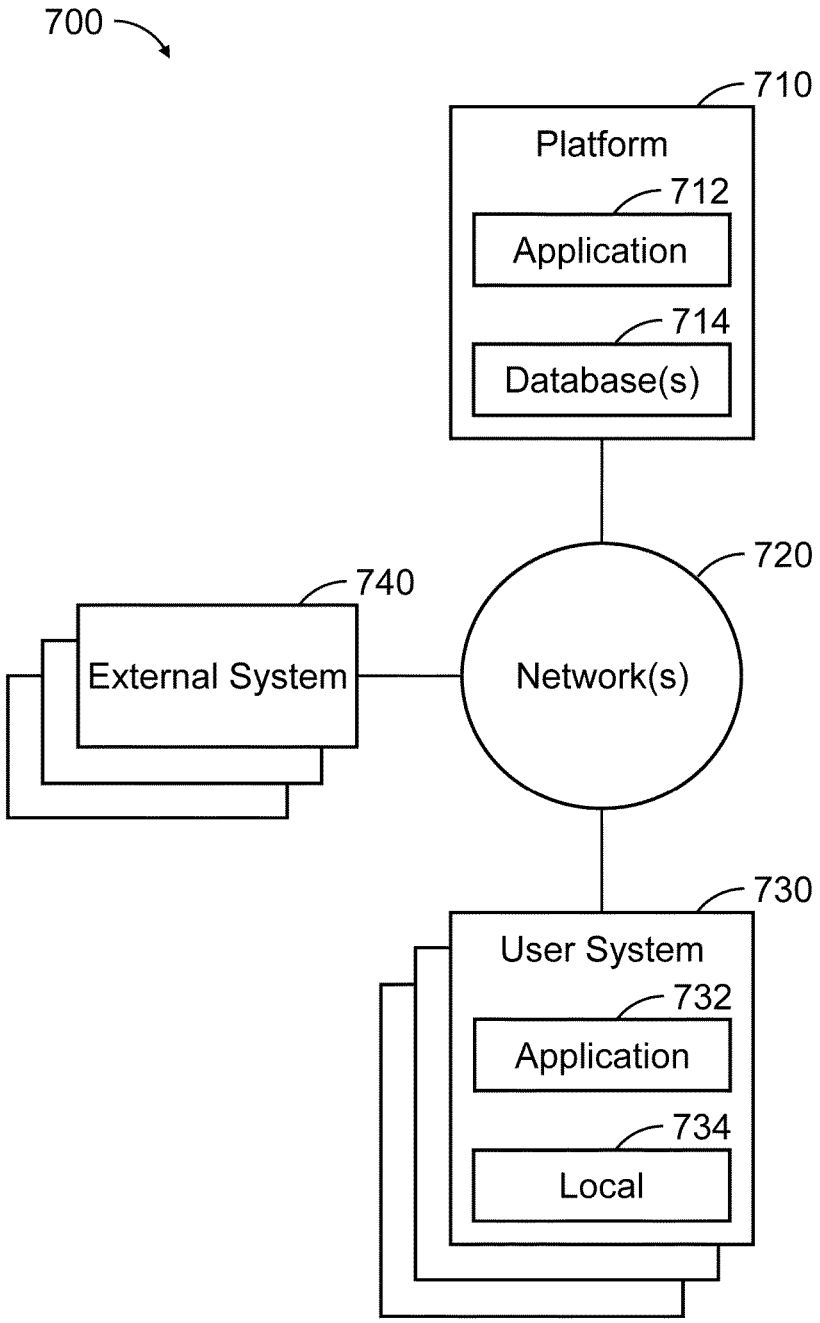
Figure 54:
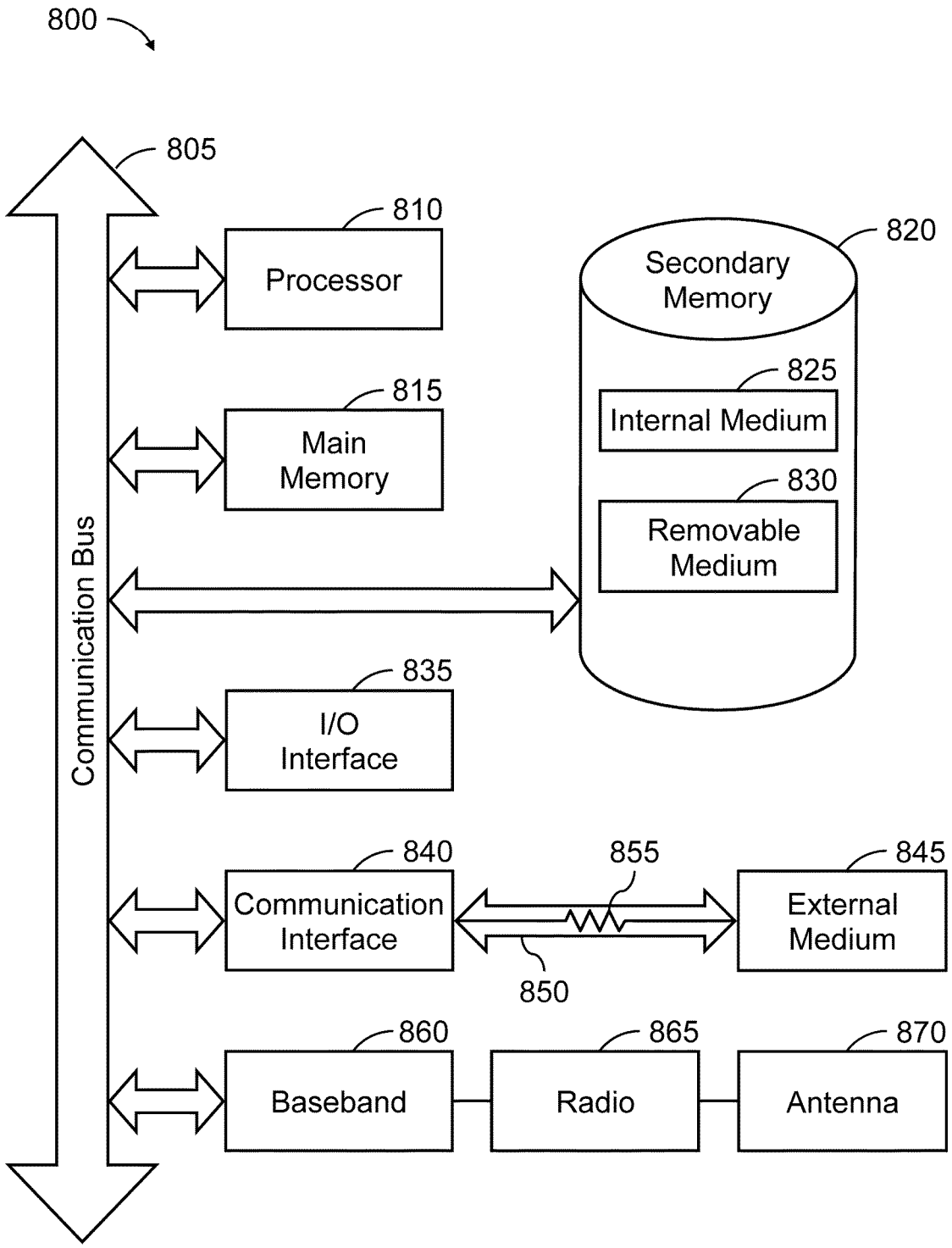
Figure 55:
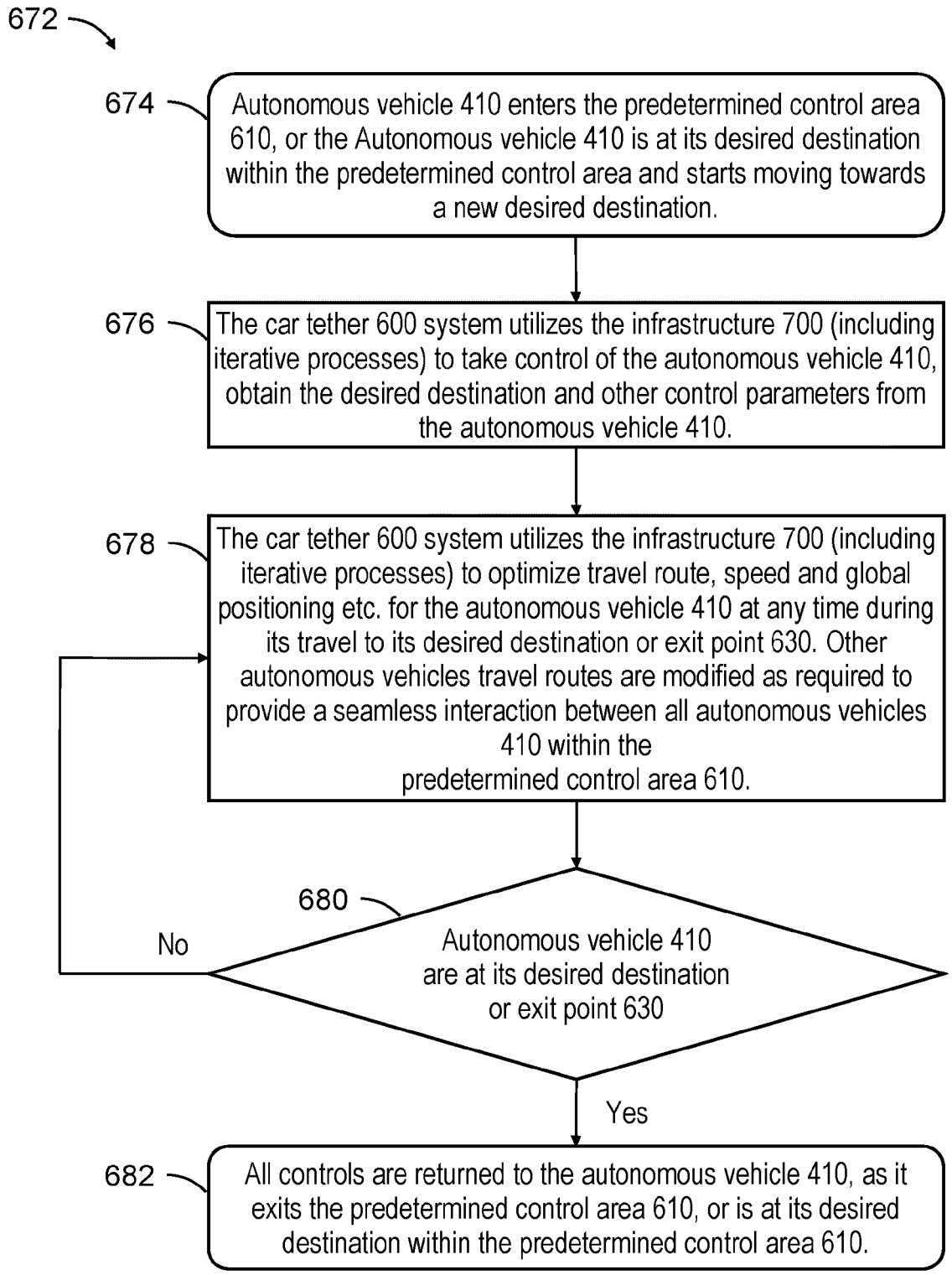

FIG. 53 illustrates an example infrastructure in which one or more of the processes described herein may be implemented according to an embodiment;

FIG. 54 illustrates an example processing system by which one or more of the processes described herein may be executed according to an embodiment;

FIG. 55 illustrates an example flow chart of the processes for the control of the autonomous vehicles by which one or more of the processed described herein may be executed according to an embodiment;

Additional Embodiments: Elevated Autonomous People Mover

Figure 56:
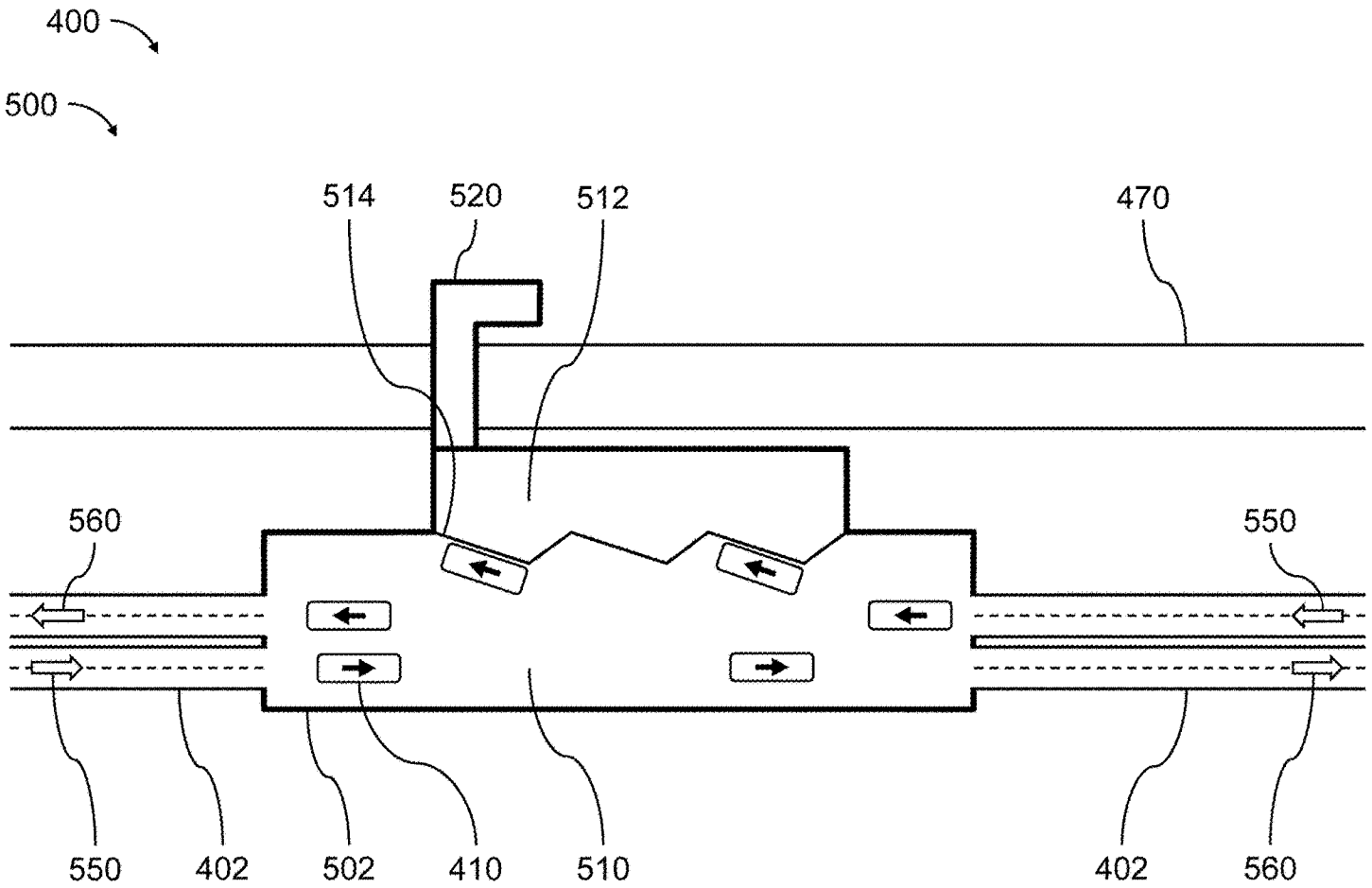
Figure 57:
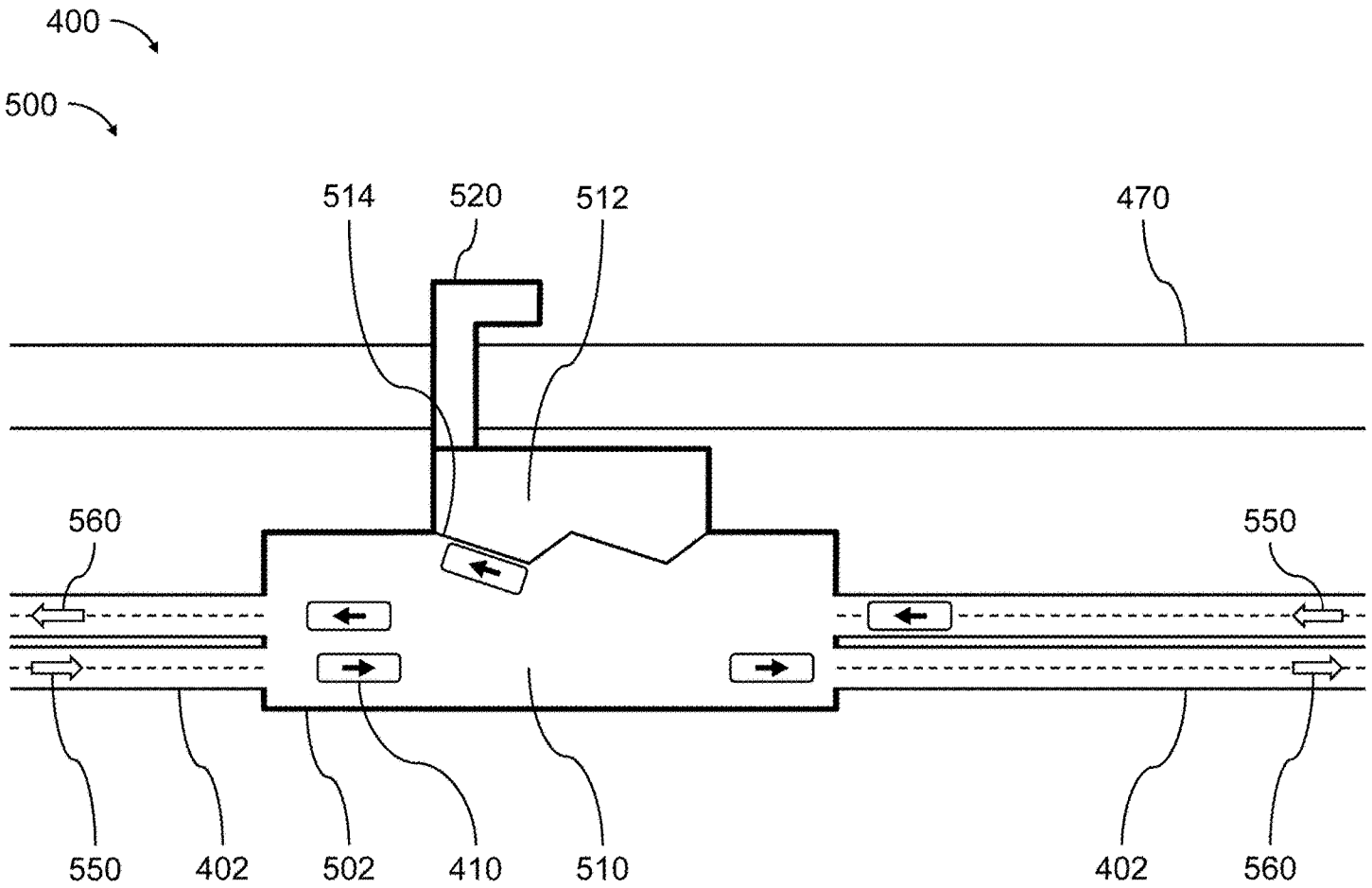
Figure 58:
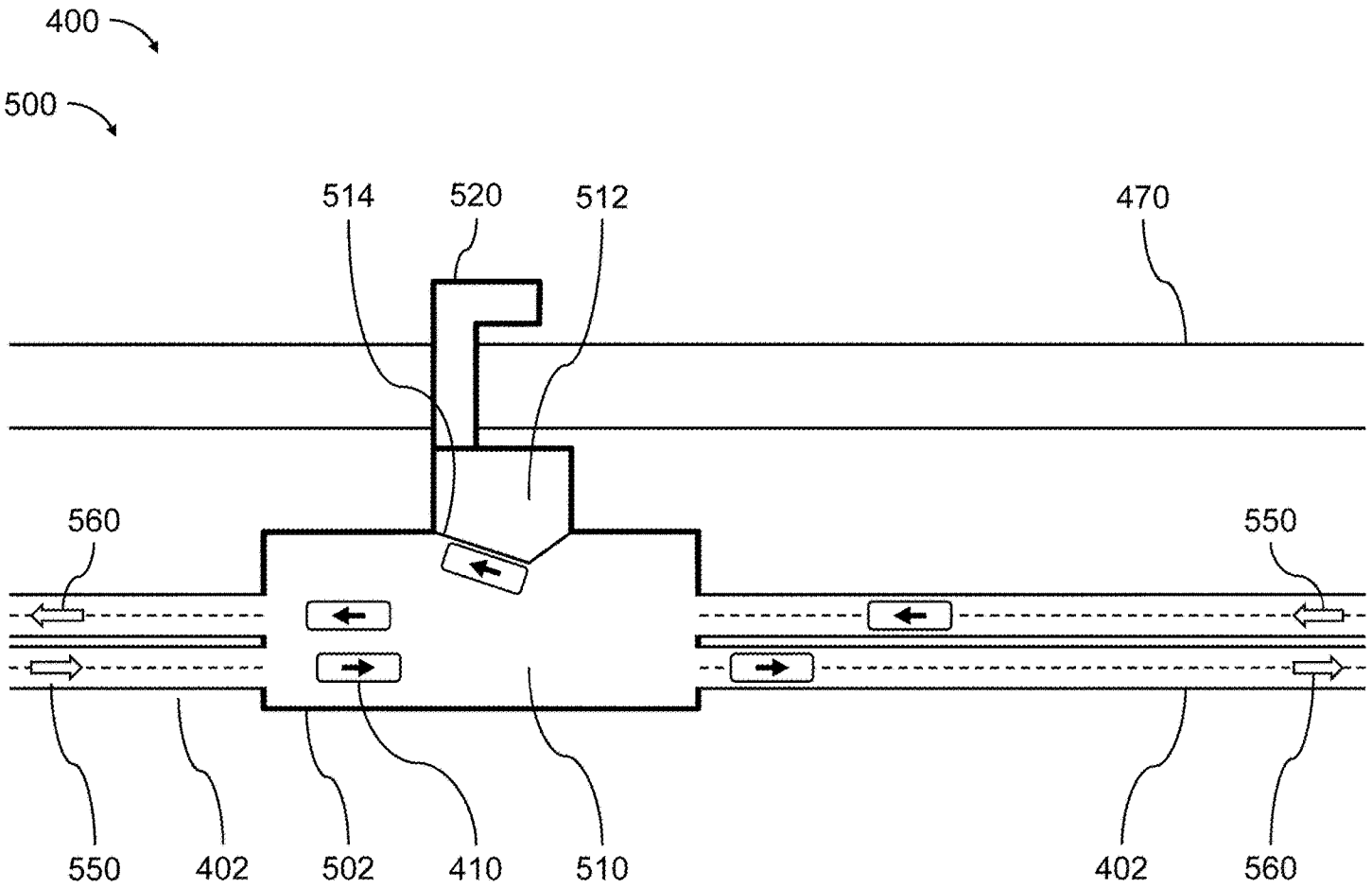

FIG. 56 is a plan view of a sawtooth station with a bidirectional sawtooth platform utilizing three sawtooth berth that alternatively can be used for the elevated autonomous people mover system of FIG. 10;

FIG. 57 is a plan view of a sawtooth station with a bidirectional sawtooth platform utilizing two bidirectional sawtooth berths that alternatively can be used for the elevated autonomous people mover system of FIG. 10;

FIG. 58 is a plan view of a sawtooth station with a bidirectional sawtooth platform utilizing one bidirectional sawtooth berth that alternatively can be used for the elevated autonomous people mover system of FIG. 10;

Additional Embodiments: Sawtooth Station and Bidirectional Sawtooth Platform

Figure 59:
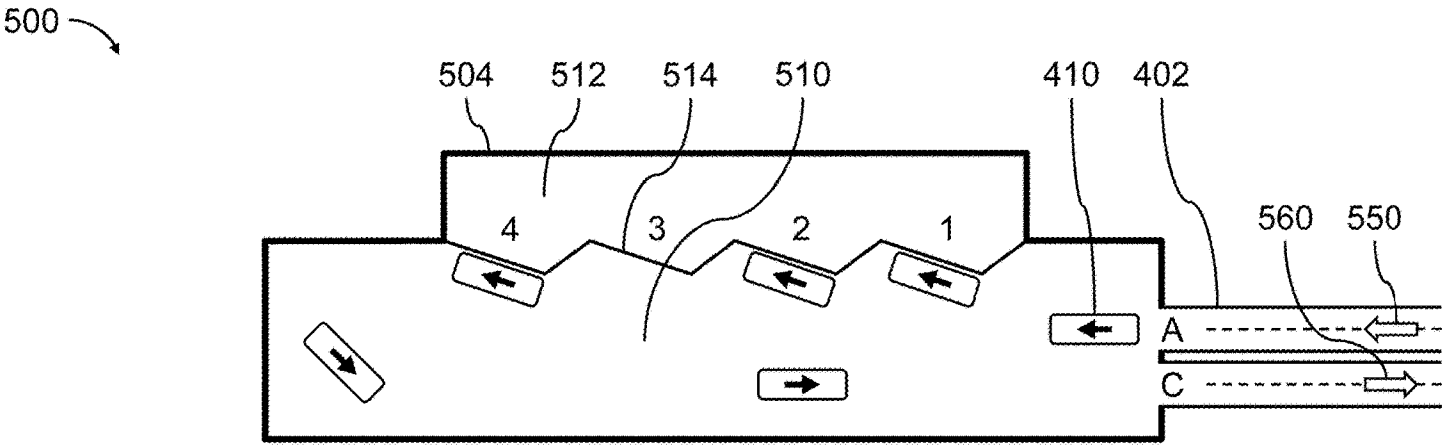
Figure 60:
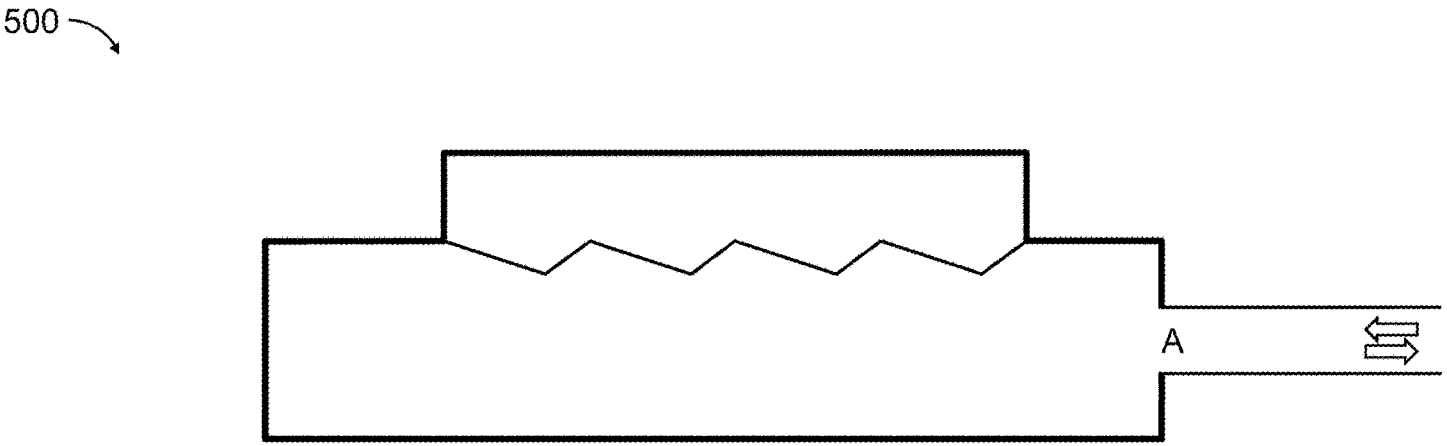
Figure 61:
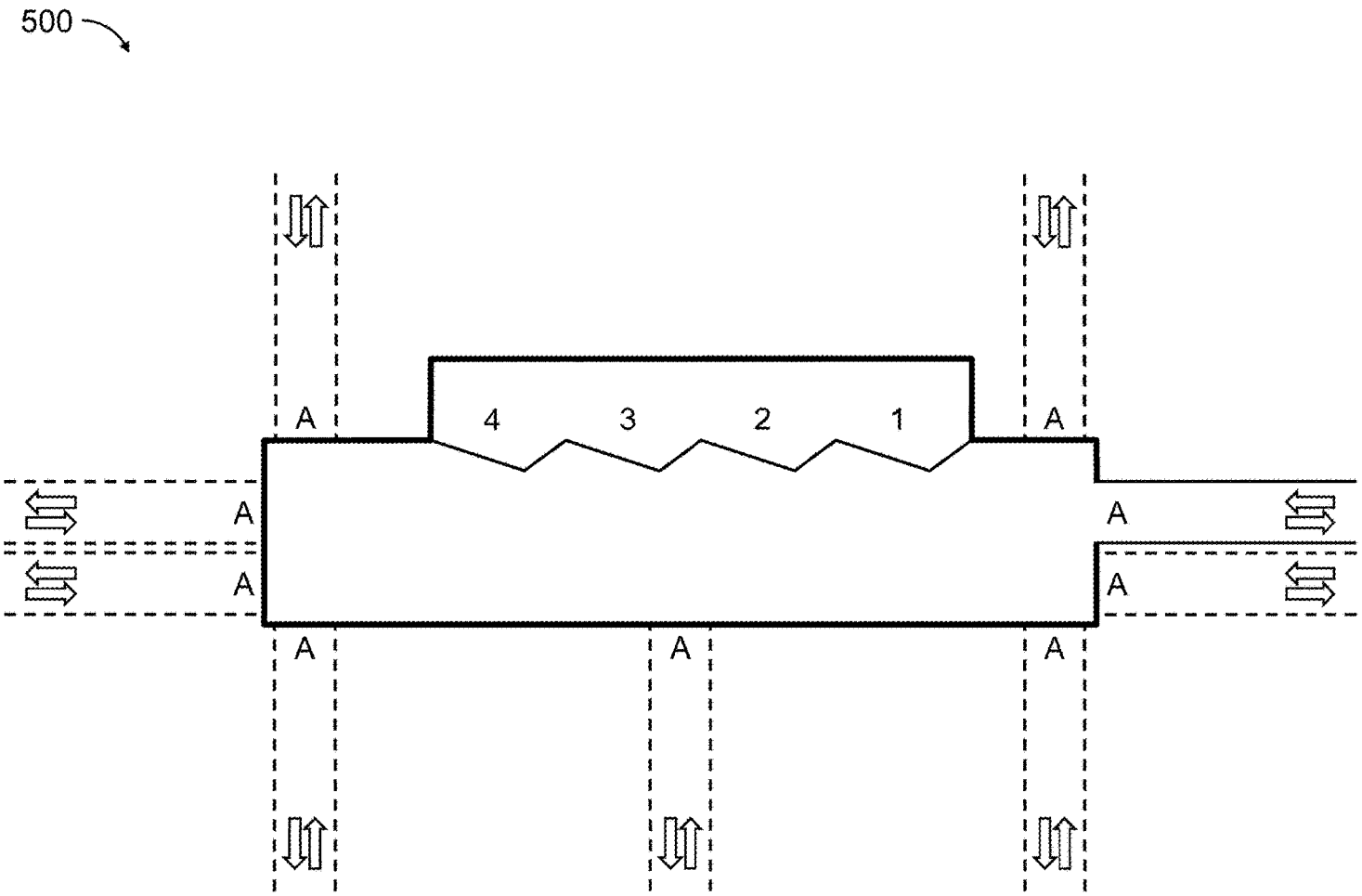
Figure 62:
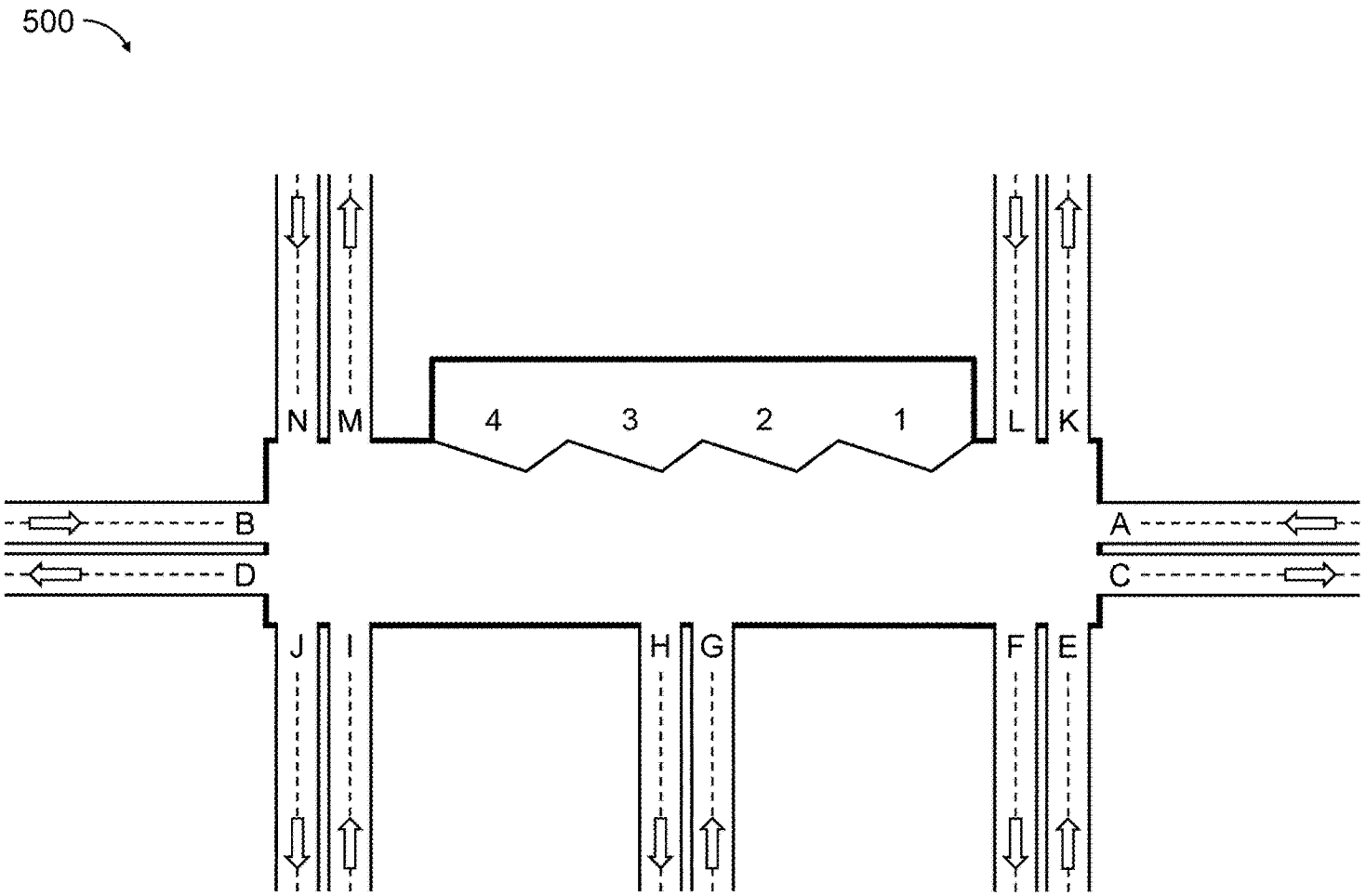
Figure 63:
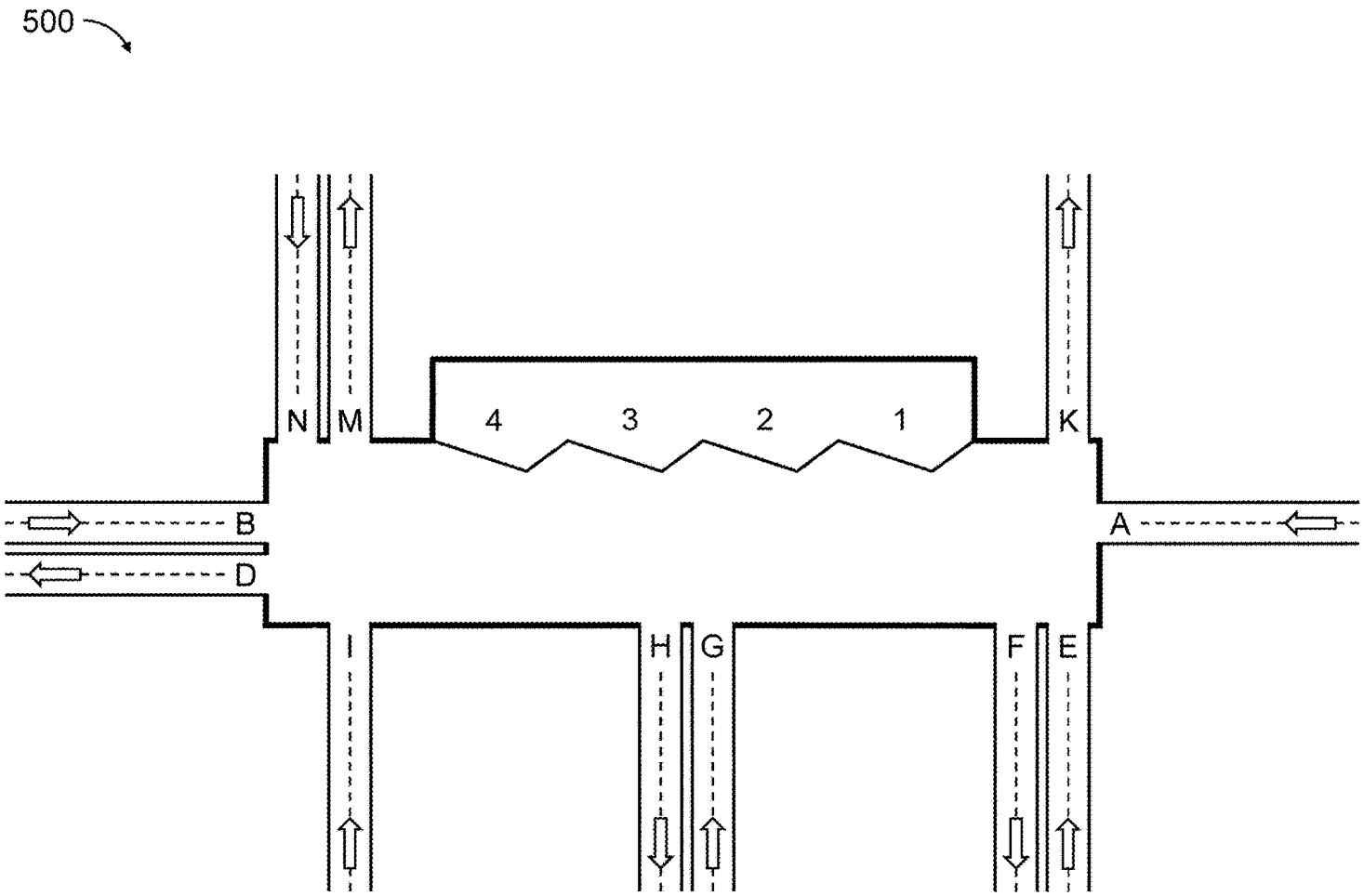
Figure 64:
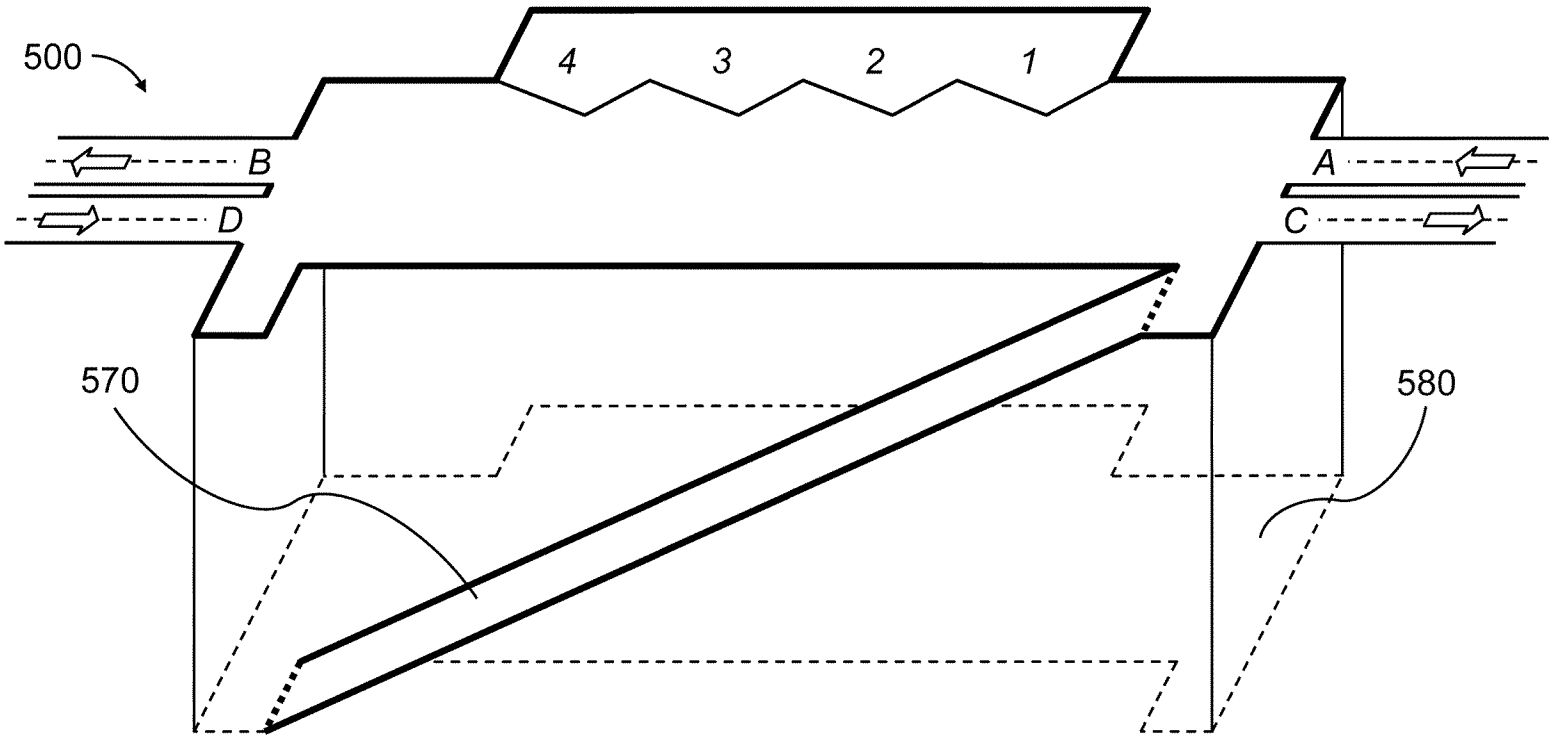

FIG. 59 illustrates an additional embodiment of sawtooth station system and illustrates a general layout of an sawtooth terminal, which is similar to the sawtooth terminal of FIG. 18, except that the entry and exit are at an opposite side;

FIG. 60 illustrates an additional embodiment of a sawtooth station system and illustrates a general layout that is similar to the sawtooth station system of FIG. 59, except there is a single entry/exit A;

FIG. 61 illustrates a further embodiment of a sawtooth station system and illustrates a general layout that is similar to the sawtooth station system of FIG. 60, except that the single entry/exit A can be located in a variety of locations (vehicles entering/exiting can be in any direction);

FIG. 62 illustrates a further embodiment of a sawtooth station system and illustrates a general layout that is similar to the sawtooth station system of FIG. 61, except that instead of a single entry/exit A that can be located in a variety of location (vehicles entering/exiting can be in any direction), there are one or more separate entries/exits that allows vehicles to enter/exit in any direction (option 1);

FIG. 63 illustrates a further embodiment of a sawtooth station system and illustrates a general layout that is similar to the sawtooth station system of FIG. 62, except that there are one or more single entries/exits and one or more separate entries/exits that allows vehicles to enter/exit in any direction (option 2);

FIG. 64 illustrates a further embodiment of a sawtooth station system and illustrates a general layout including a ramp to ground.

Figure 65:
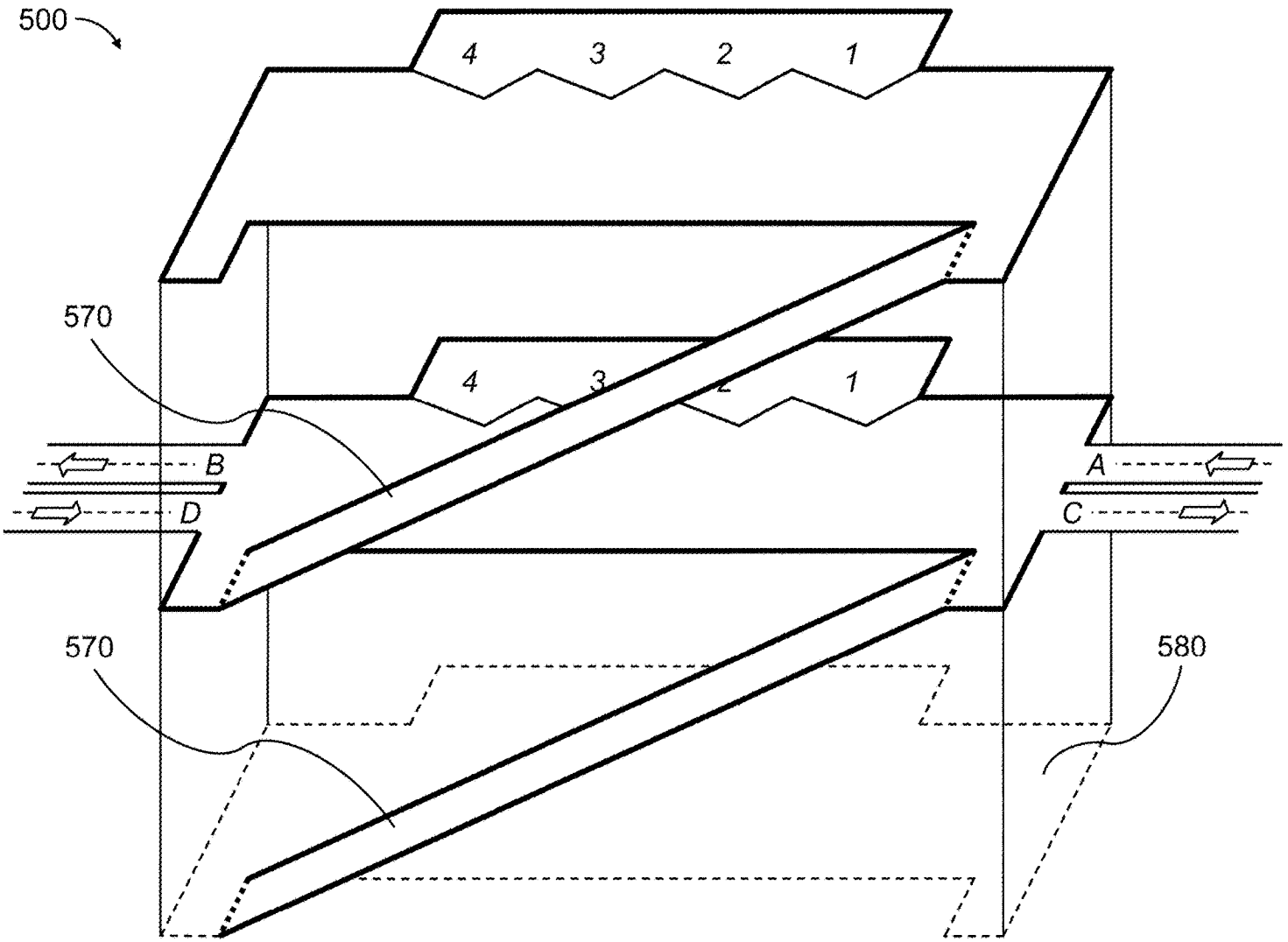

FIG. 65 illustrates a further embodiment of a sawtooth station and illustrates a general layout that is similar to the sawtooth station of FIG. 64, except that there is one additional sawtooth station located above the other sawtooth station.

Figure 66:
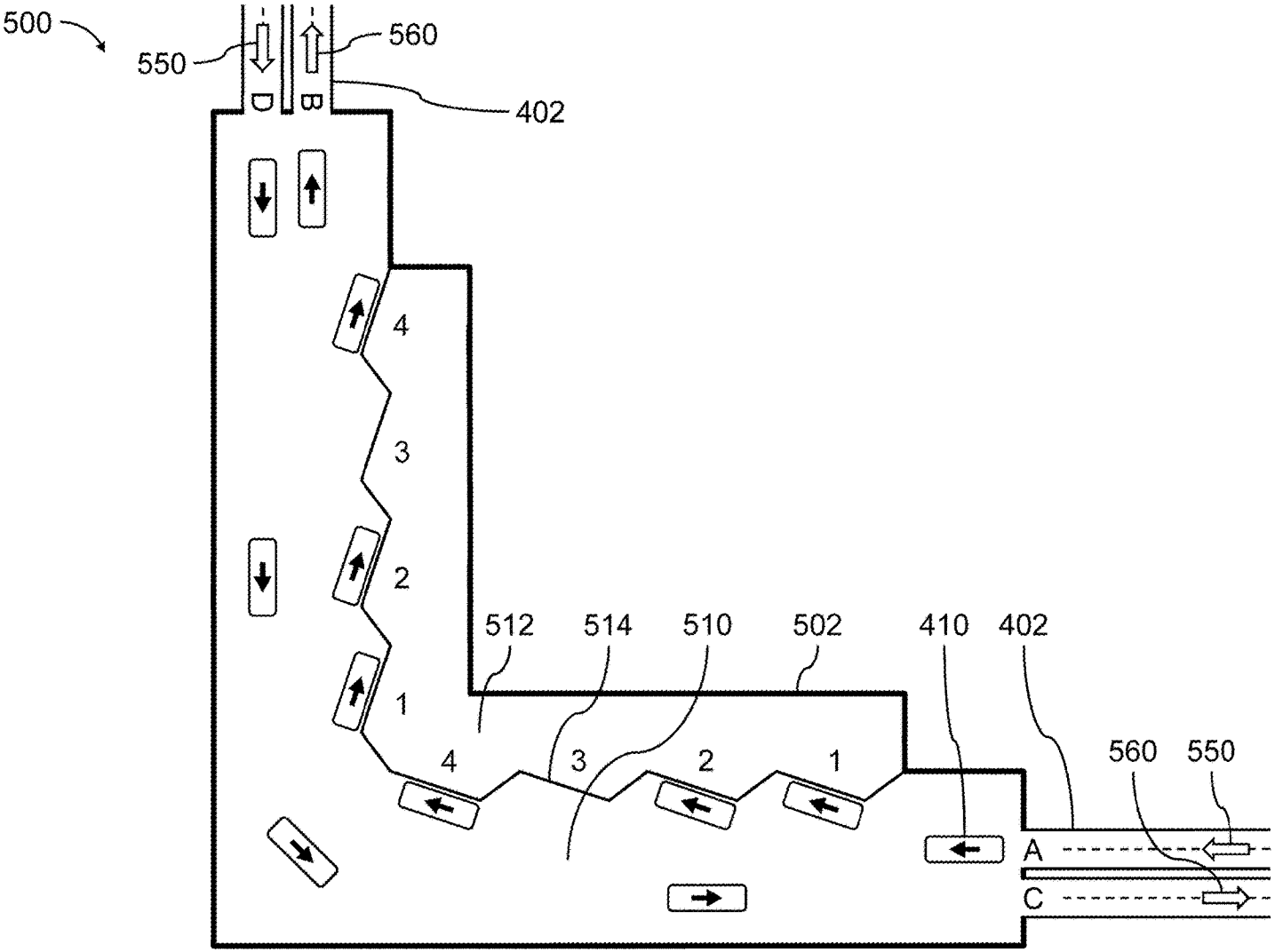
Figure 67:
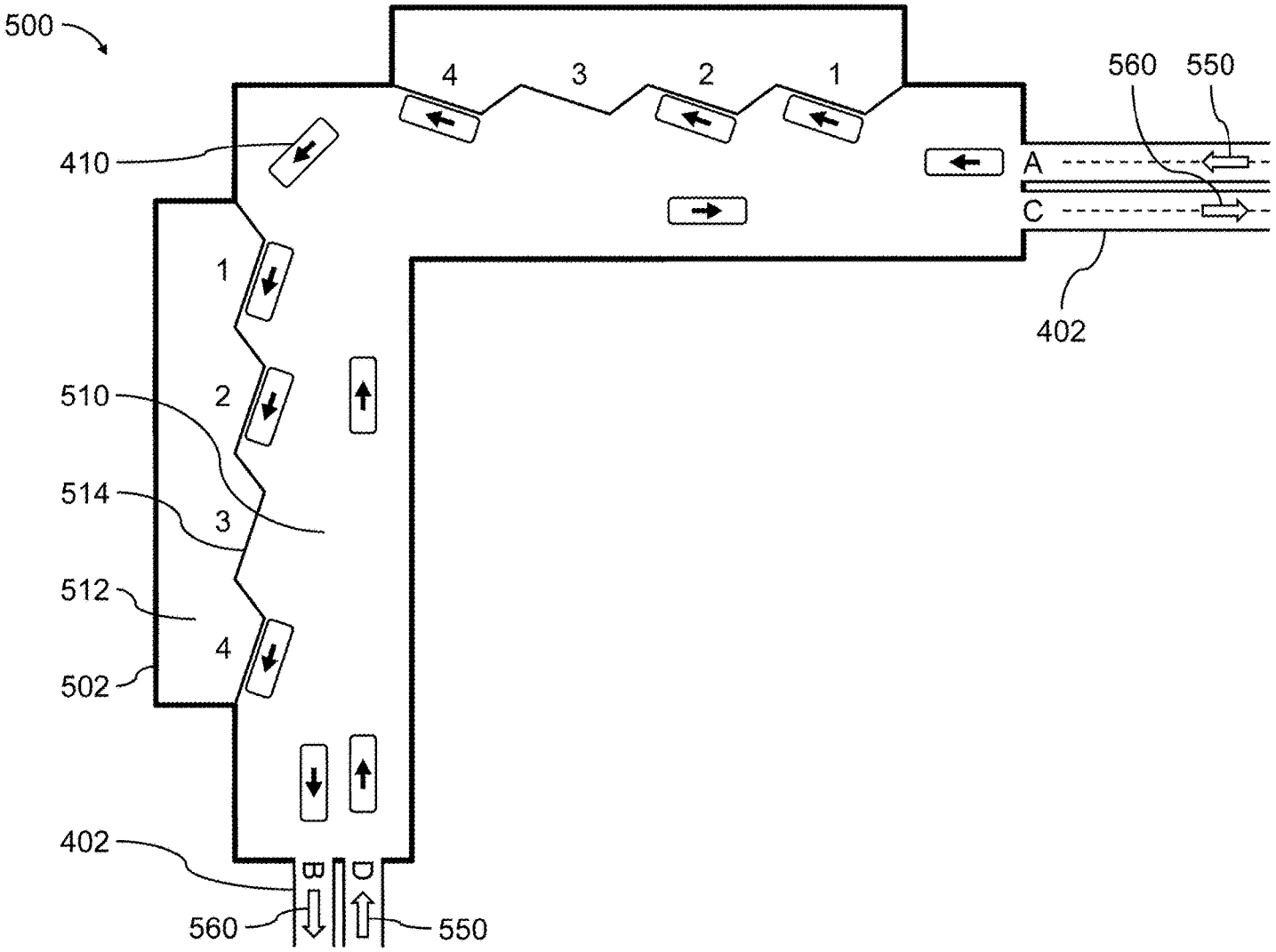
Figure 68:
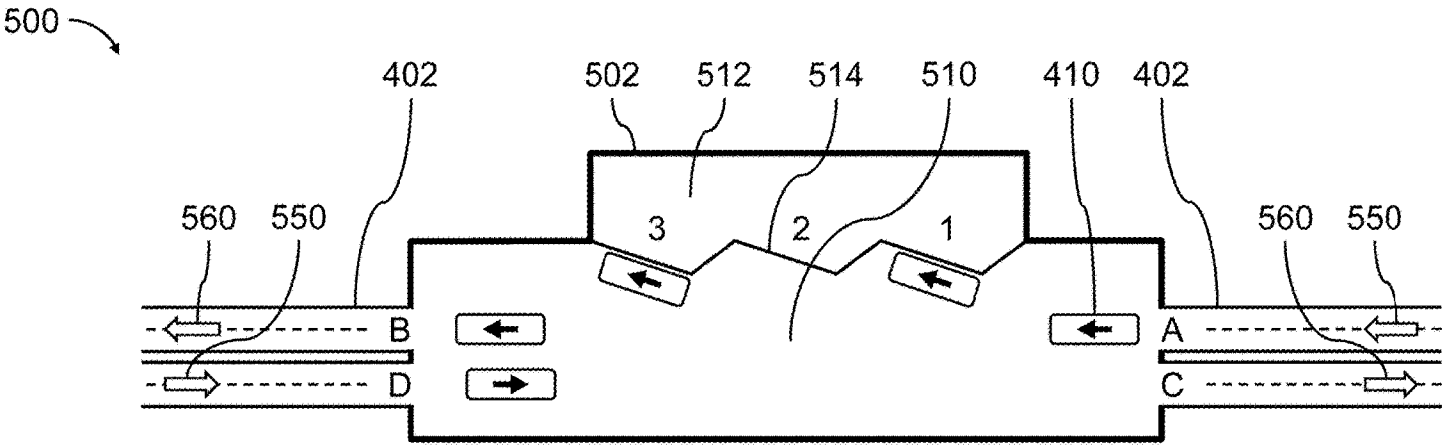
Figure 69:
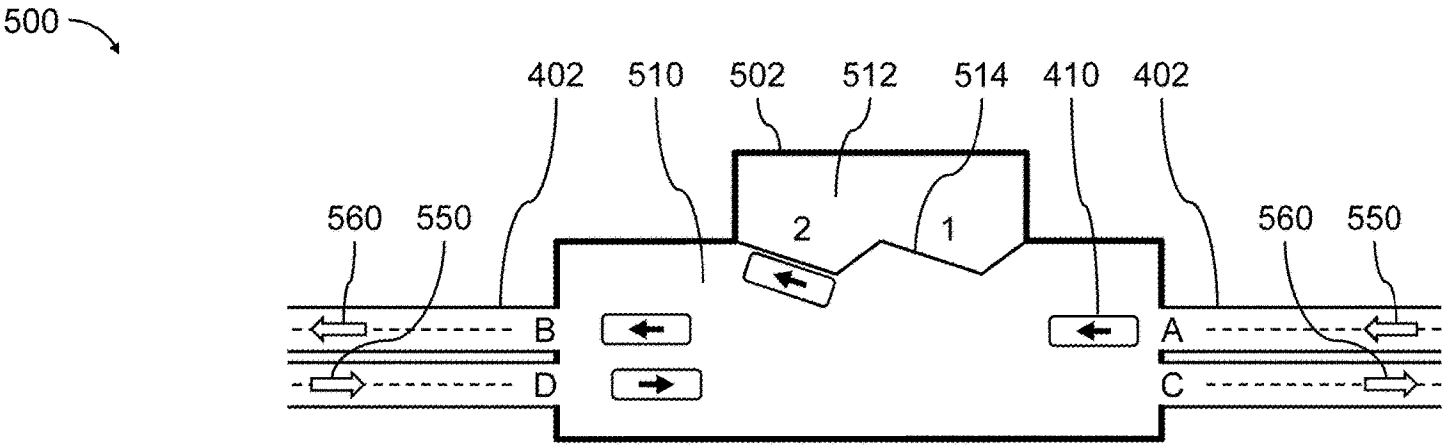
Figure 70:
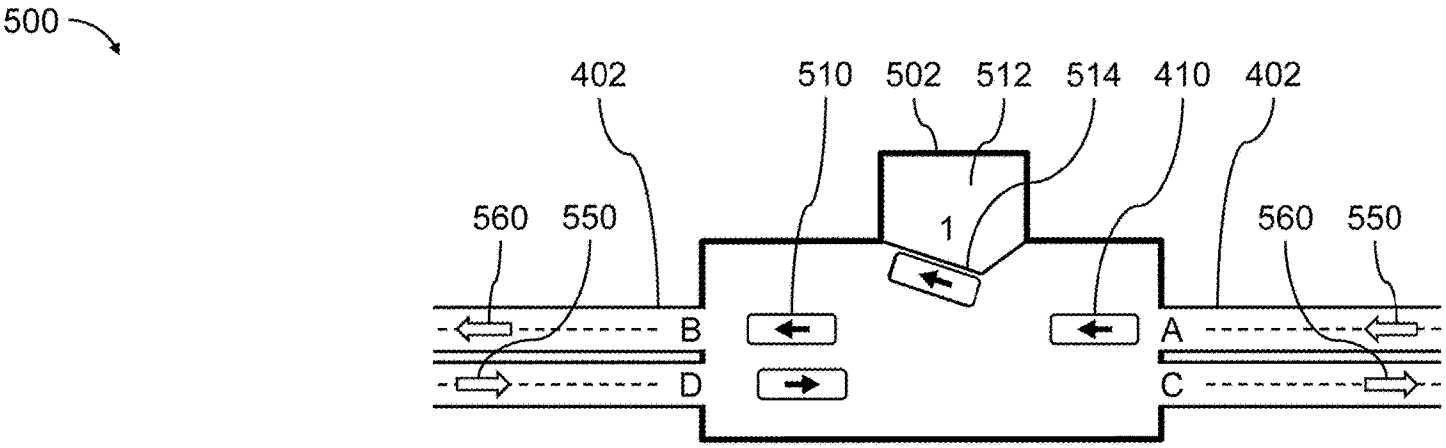
Figure 71:
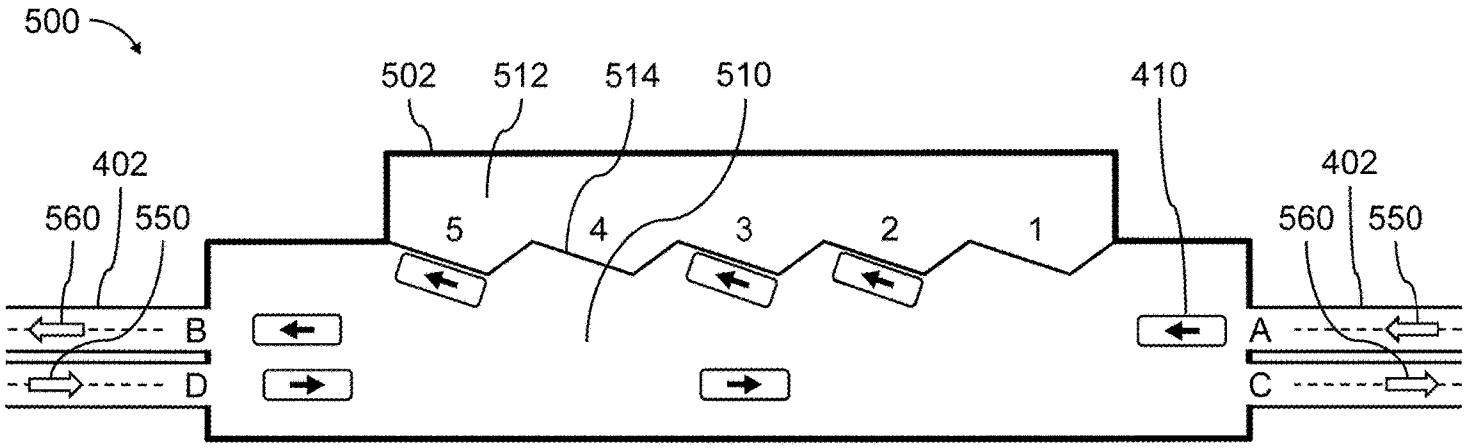
Figure 72:
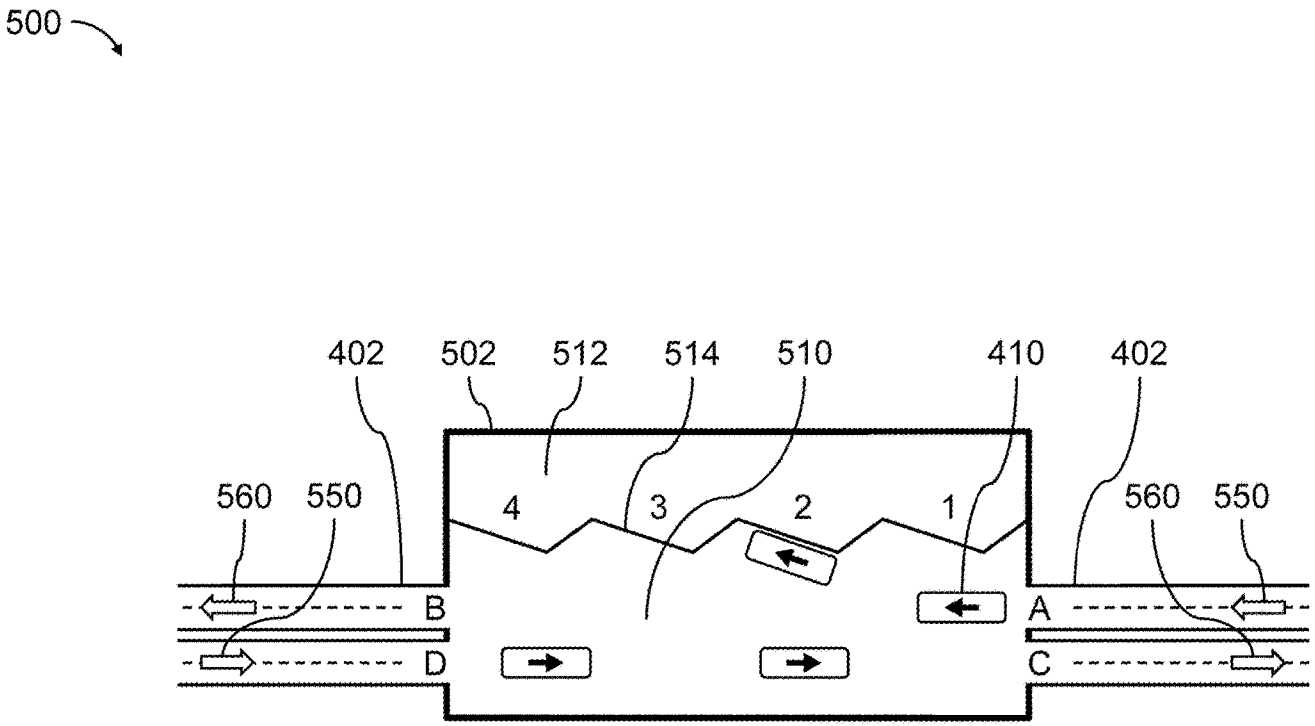

FIG. 66 illustrates a still further embodiment of a sawtooth station system that is a combination of two or more individual sawtooth station systems, with the bidirectional sawtooth platform on the inside (option 1);

FIG. 67 illustrates a further embodiment of a sawtooth station and illustrates a general layout that is similar to the sawtooth station of FIG. 66, except the bidirectional sawtooth platform is on the outside (option 2);

FIG. 68 illustrates a further embodiment of a sawtooth station and illustrates a general layout that is similar to the sawtooth station of FIG. 17, except that there are three bidirectional sawtooth platforms;

FIG. 69 illustrates a further embodiment of a sawtooth station and illustrates a general layout that is similar to the sawtooth station of FIG. 68, except that there are two bidirectional sawtooth platforms;

FIG. 70 illustrates a further embodiment of a sawtooth station and illustrates a general layout that is similar to the sawtooth station of FIG. 69, except there is one bidirectional sawtooth platform;

FIG. 71 illustrates a further embodiment of a sawtooth station and illustrates a general layout that is similar to the sawtooth station of FIG. 70, except there are five bidirectional sawtooth platforms;

FIG. 72 illustrates a further embodiment of a sawtooth station and illustrates a general layout that is similar to the sawtooth station of FIG. 17, except the bidirectional sawtooth platform is no longer than the sawtooth berths;

Additional Embodiments: Car Tether

Figure 73:
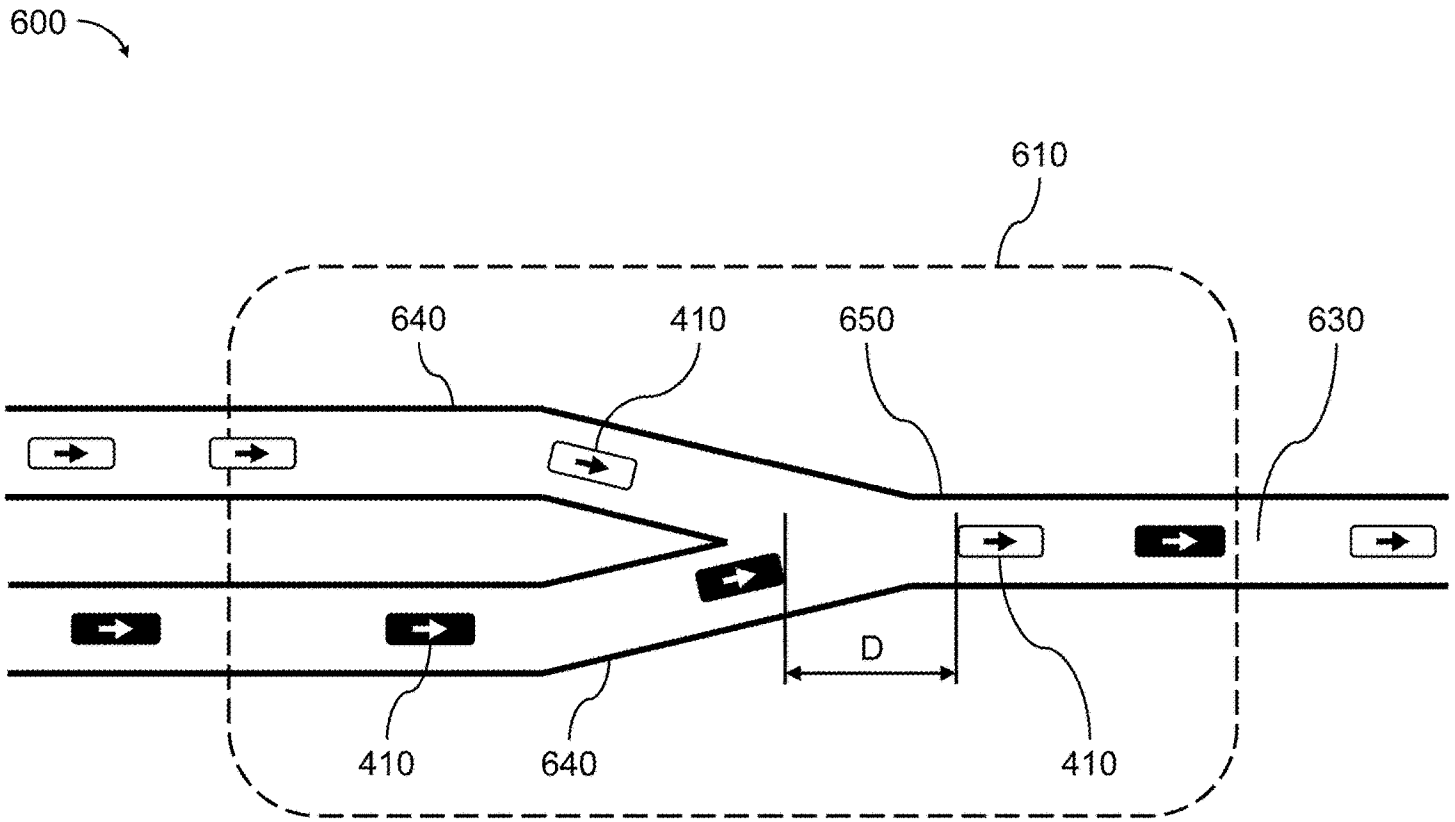
Figure 74:
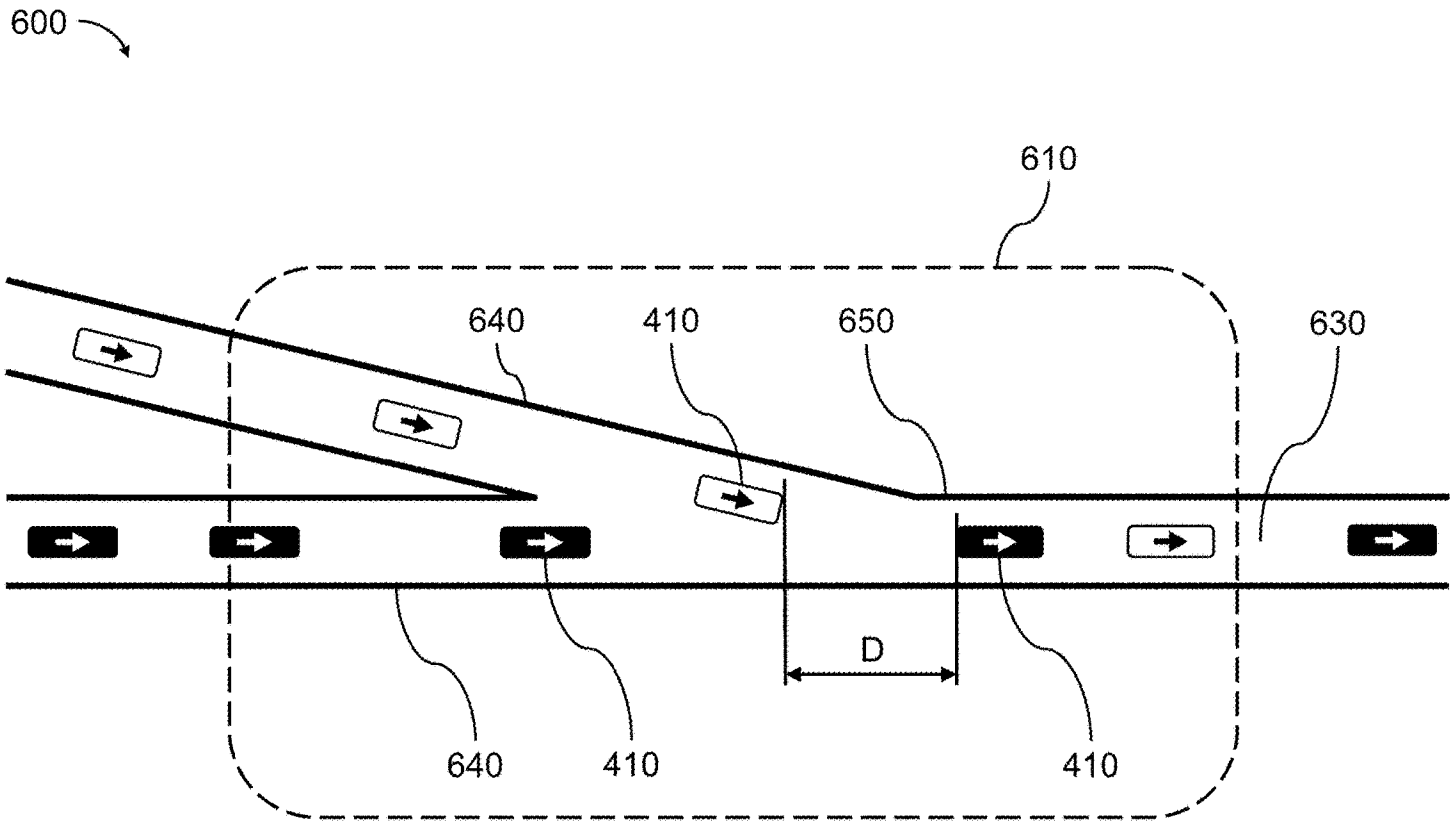
Figure 75:
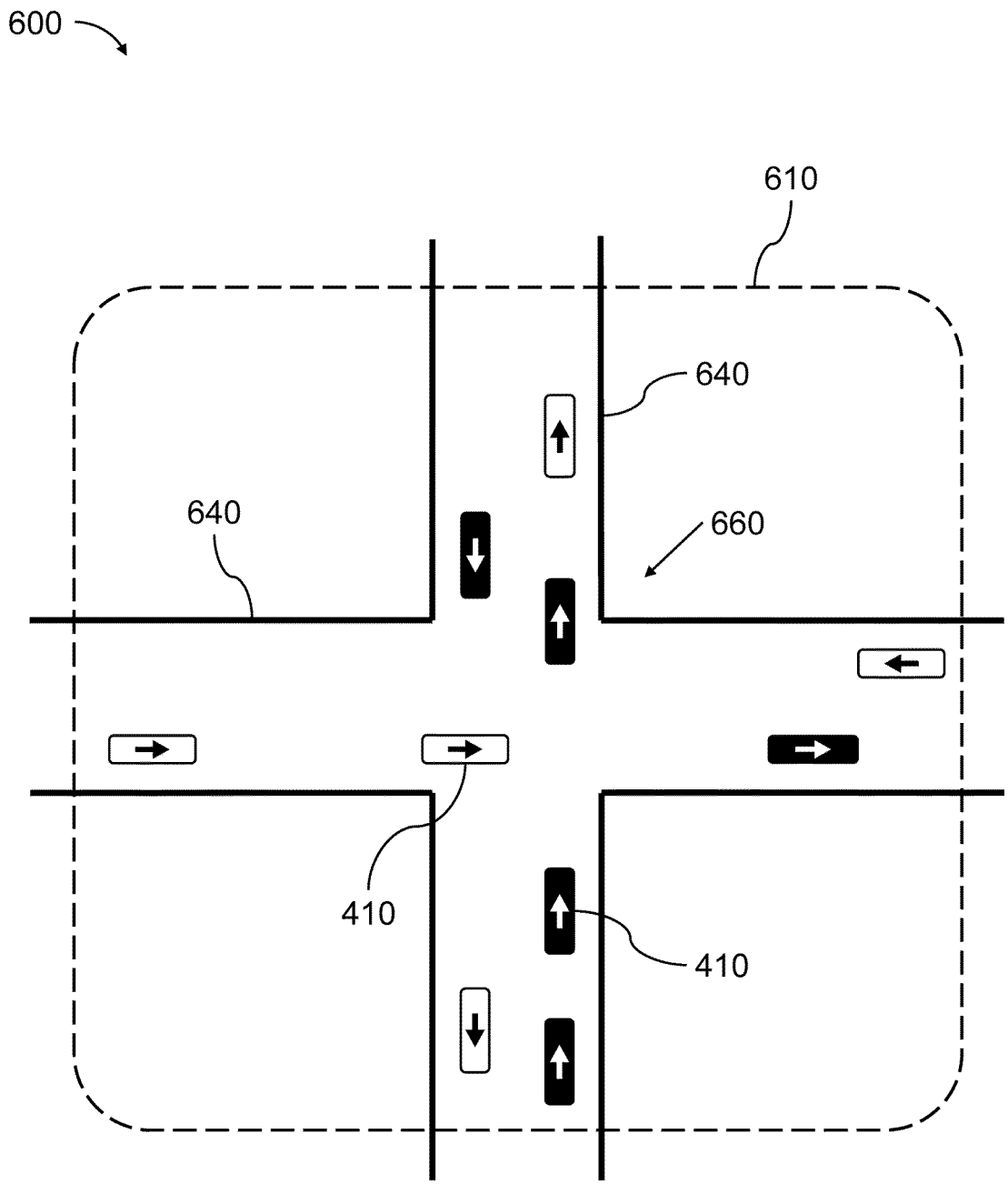
Figure 76:
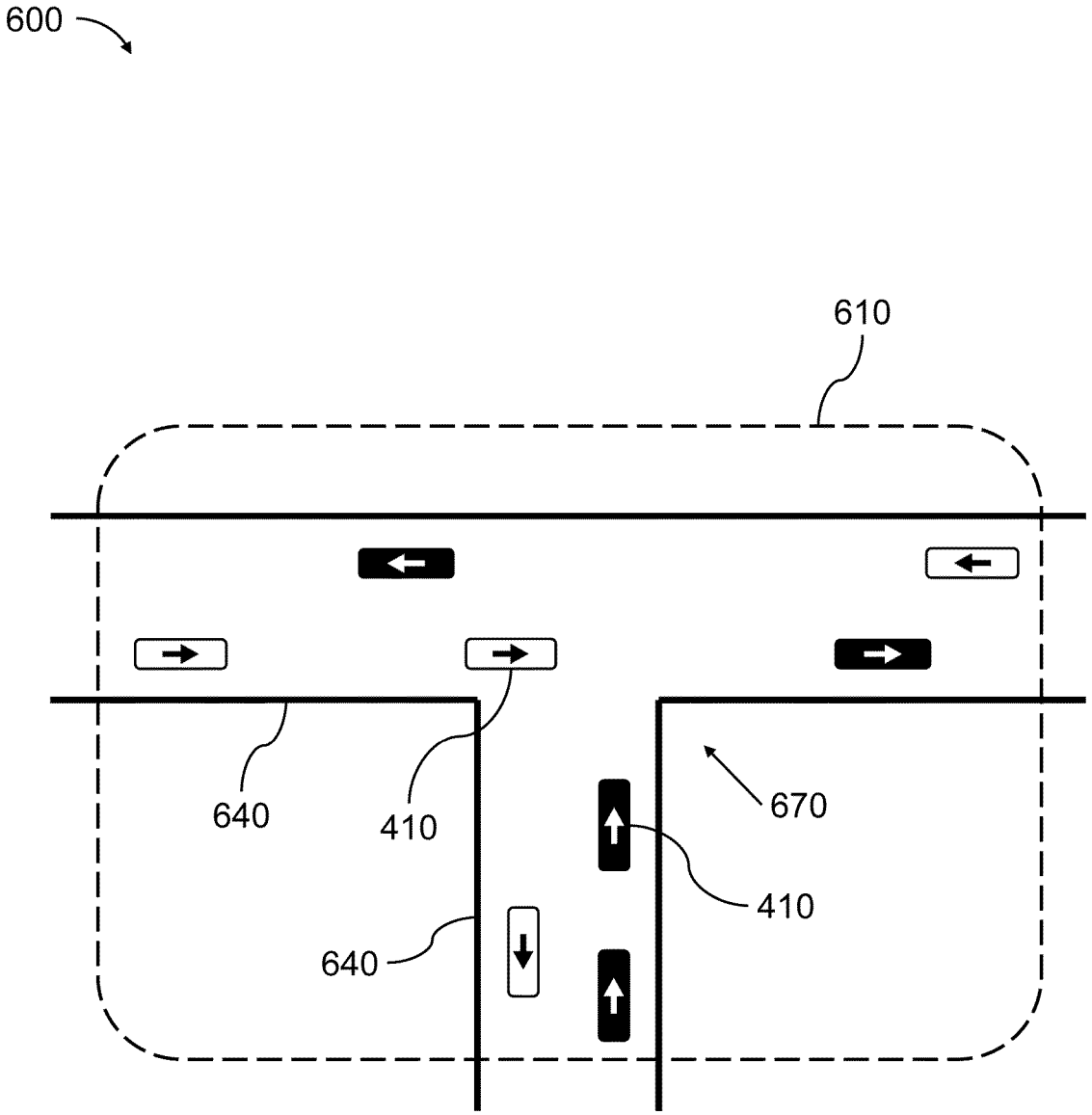

FIG. 73 is an embodiment of a car tether system controlling autonomous vehicles in an environment where two traffic lanes merge to one lane;

FIG. 74 is an additional example of an embodiment of a car tether system controlling autonomous vehicles in an environment where two traffic lanes merge to one lane;

FIG. 75 is an embodiment of a car tether system controlling autonomous vehicles in a four-way intersection environment;

FIG. 76 is an embodiment of a car tether system controlling autonomous vehicles in a three-way intersection environment;

Additional Embodiments: Sawtooth Station and Bidirectional Sawtooth Platform

Figure 77:
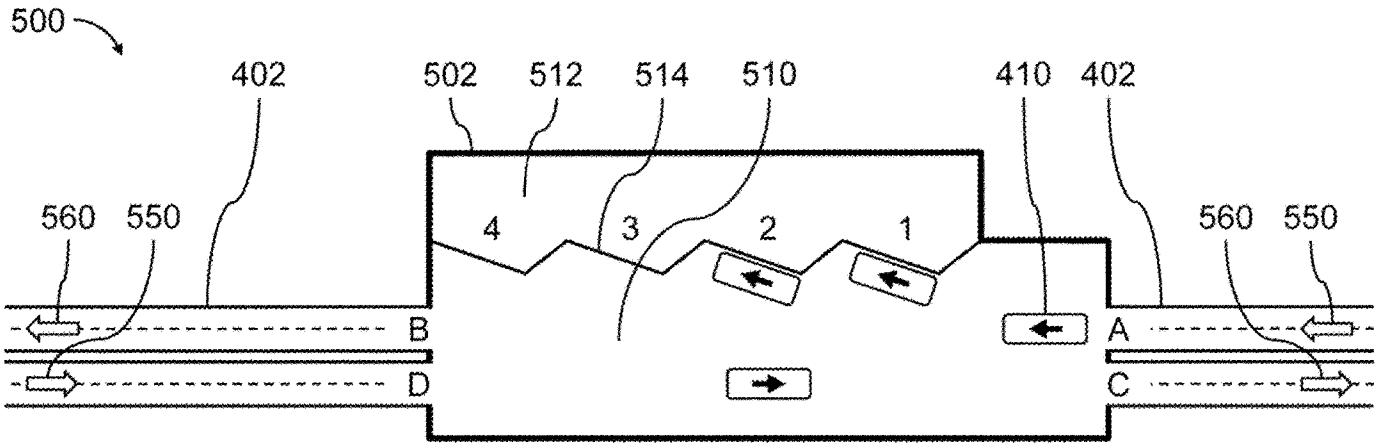
Figure 78:
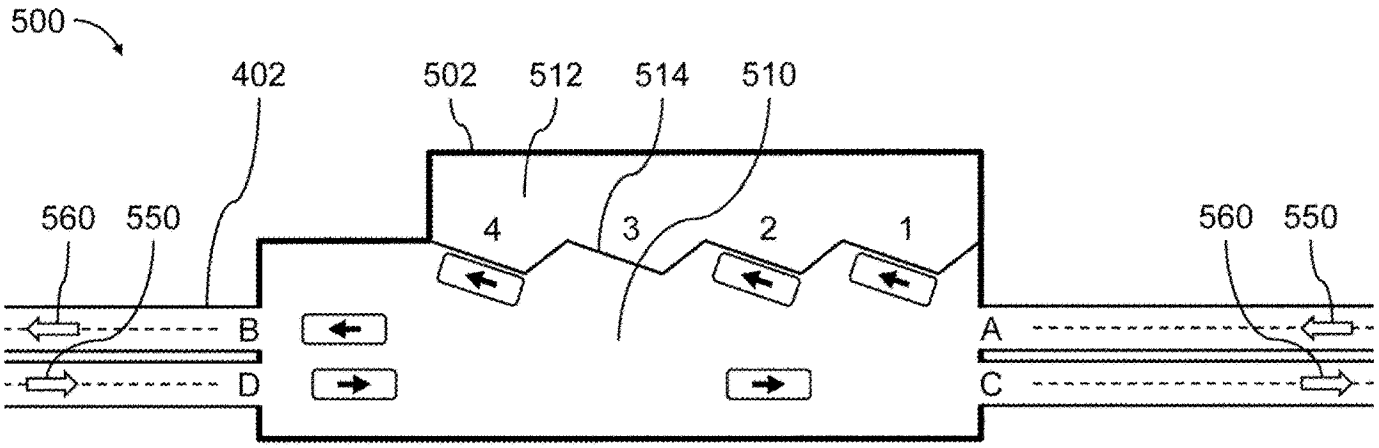
Figure 79:
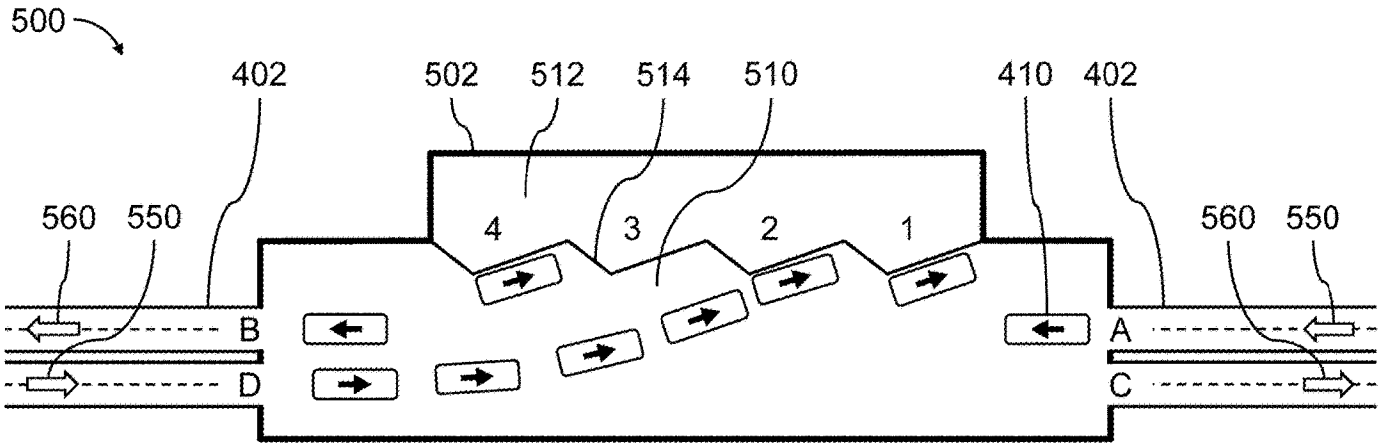
Figure 80:
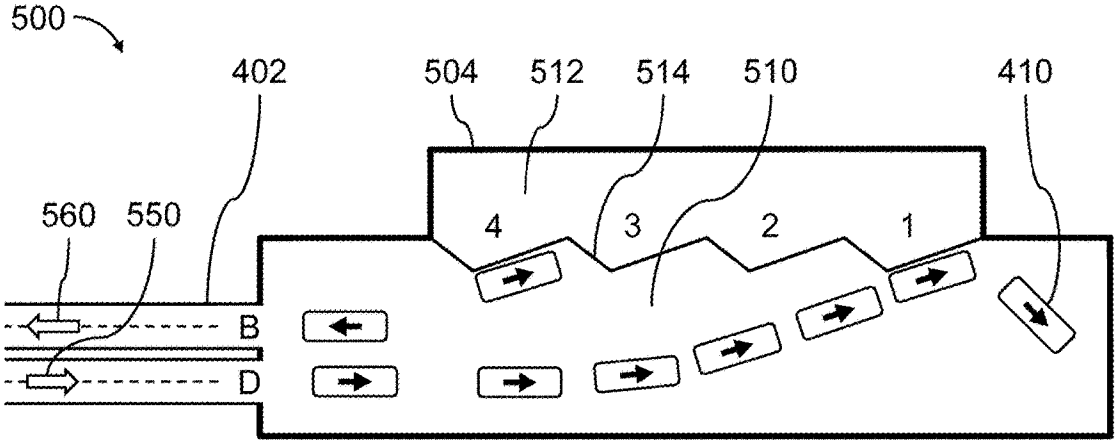
Figure 81:
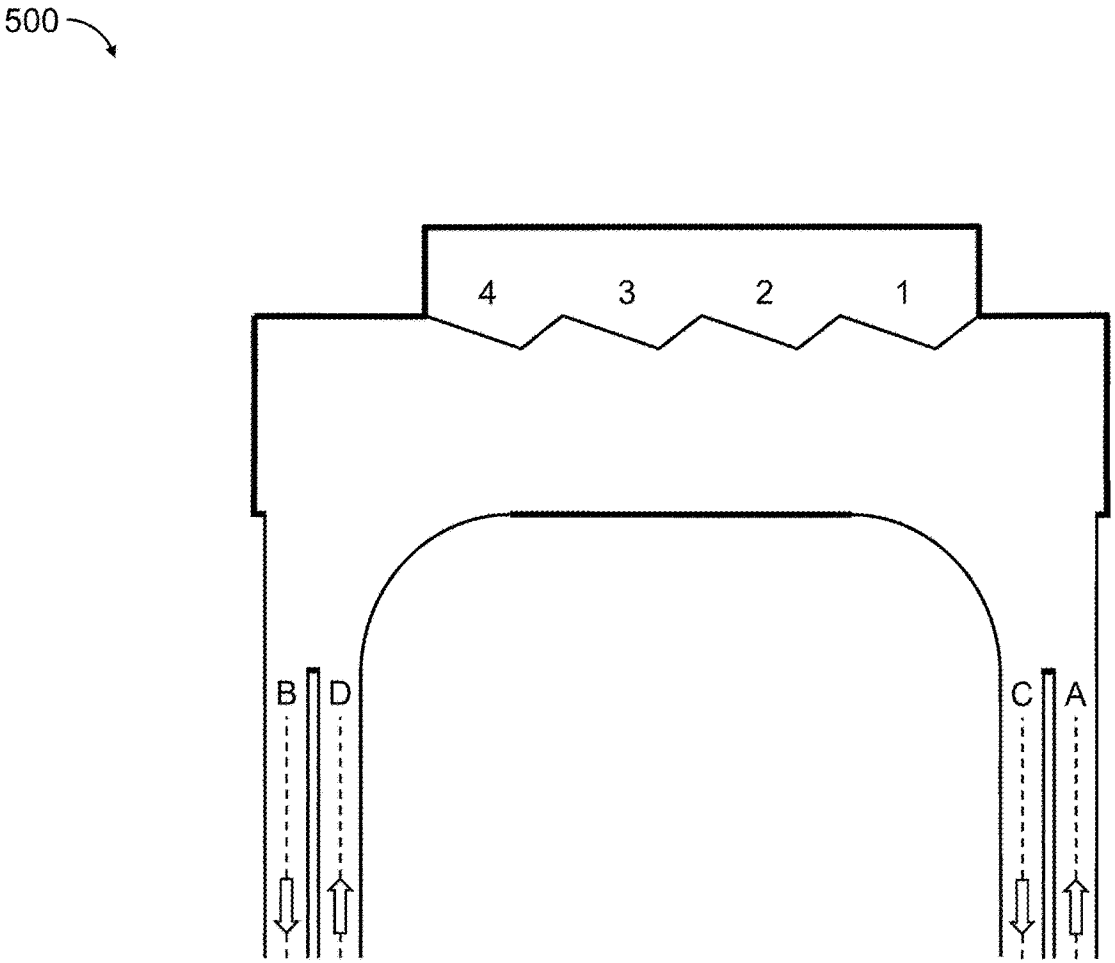
Figure 82:
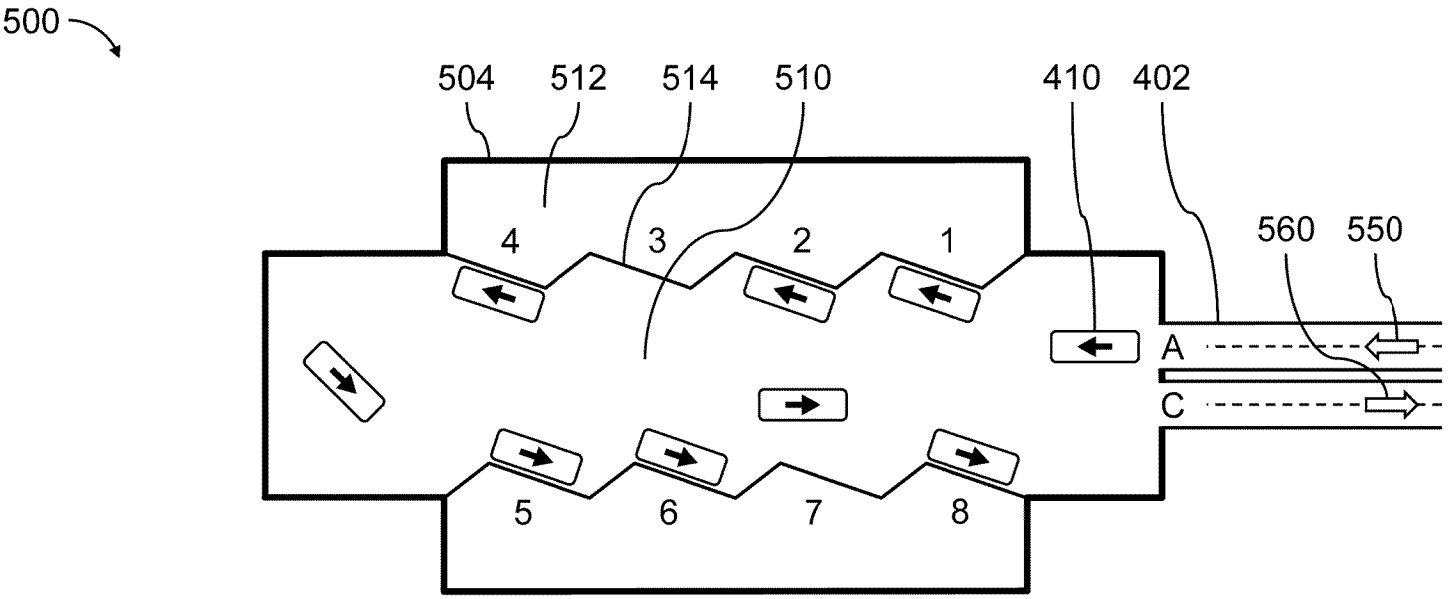

FIG. 77 illustrates a further embodiment of a sawtooth station and illustrates a general layout that is similar to the sawtooth station of FIG. 17, except the bidirectional sawtooth platform is no longer than the sawtooth berths on the left side;

FIG. 78 illustrates a further embodiment of a sawtooth station and illustrates a general layout that is similar to the sawtooth station of FIG. 17, except the bidirectional sawtooth platform is no longer than the sawtooth berths on the right side;

FIG. 79 illustrates a further embodiment of a sawtooth station and illustrates a general layout that is similar to the sawtooth station of FIG. 17, except the autonomous vehicles enter the sawtooth berth in the opposite direction;

FIG. 80 illustrates a further embodiment of a sawtooth station and illustrates a general layout that is similar to the sawtooth station of FIG. 18, except the autonomous vehicles enter the sawtooth berth in the opposite direction;

FIG. 81 illustrates a further embodiment of a sawtooth station system and illustrates a general layout that is similar to the sawtooth station system of FIG. 63, except that the enter/exit are curved;

FIG. 82 illustrates a further embodiment of a sawtooth station and illustrates a general layout that is similar to the sawtooth station of FIG. 17, except that there are two sawtooth berths located on opposite sides of the bidirectional sawtooth platform.

DETAILED DESCRIPTION

Elevated Autonomous People Mover

With reference to FIGS. 10 through 16, an embodiment of an elevated autonomous people mover system 400 and method will be described.

FIG. 10 shows an alignment including an elevated sawtooth station 500 system with two different sawtooth station 500 types, a sawtooth junction 502 and a sawtooth terminal 504. The sawtooth stations 500 are connected by an elevated guideway structure 402 to accommodate the autonomous vehicles 410 movement between sawtooth stations 500, thereby allow for passenger transportation between sawtooth stations 500. The direction of travel of the autonomous vehicle 410 is indicated by the arrow.

The elevated autonomous people mover system 400 includes one or more autonomous vehicles 410, which can have any passenger occupancy, with any number of doors and windows.

When the autonomous vehicle 410 is at the end of the alignment and starts the return trip, the autonomous vehicle 410 needs to move to the opposite side to avoid any autonomous vehicles 410 coming to the sawtooth terminal 504. To move to the opposite side, the autonomous vehicle 410 performs a U-turn within the sawtooth terminal 504. Therefore, the elevated autonomous people mover system 400 does not require the guideway switch 102 of the prior art automated people mover system(s) 100. The autonomous vehicle can also perform a U-turn within the sawtooth junction 502.

In urban areas, the sawtooth stations system 500 is placed adjacent to a street 470 to facilitate easy transfer between different transportation methods. At this location, an elevated passenger walkway 520 is provided over the adjacent street 470 to provide unobstructed connectivity to the other side of the adjacent street 470.

The minimum alignment radius r for the operation of the elevated autonomous people mover system 400 is around 20 feet. This means that in an urban area the elevated autonomous people mover system 400 requires less property acquisition compared to prior art automated people mover system (s) 100.

FIGS. 11 through 13 shows the elevated guideway structure 402 and 404 for the elevated autonomous people mover system 400. FIG. 11 shows the elevation view, FIG. 12 shows cross sections for a two autonomous vehicle elevated guideway structure 402, and FIG. 13 shows cross sections for an single autonomous vehicle elevated guideway structure 404, as described below.

The elevated autonomous people mover system 400 includes one or more autonomous vehicles 410. Tires 412 of the autonomous vehicles 410 can be pneumatic or non-pneumatic. The autonomous vehicle 410 can have any number of wheels. A running surface 422, which is a surface on top of the deck 420, can be made of concrete, steel, or other material used for vehicular driving surfaces. An optional center barrier/railing 426 and side barrier/railing 424 are provided for containment during accidental incident. The deck 420 spans about 100 feet between columns 440 and can be made from steel, concrete, or other material. The deck 420 can be simply supported on the columns 440 or be continuous over the columns 440. If required, a cap beam (spreader beam) 430 can be disposed on top of the column 440 to support the deck 420. The deck 420 and column 440 can be connected to make an integral structure. Foundation 450 supports the column(s) 440, and can be spread footing, piles, etc. and surface of the ground 460.

The autonomous vehicle(s) 410 operate on the running surface 422. The autonomous vehicle(s) 410 do not require the guide structure 120 (e.g., guidance rail or other similar guidance systems). Therefore, the elevated autonomous people mover system 400 does not require the guide structure 120 of the prior art automated people mover system(s) 100.

The autonomous vehicle(s) 410 are self-powered (e.g., via electric, hybrid, etc.) and self-guided (e.g., via GPS, autopilot, etc.). Thus, the autonomous vehicle(s) 410 used for the elevated autonomous people mover system 400 are completely autonomous and self-powered. Therefore, the elevated autonomous people mover system 400 does not require the "third rail" 130 of the prior art automated people mover system(s) 100.

The height h is the distance from the ground 460 to the running surface 422. The minimum required height h is around 20 feet. This is achieved because the elevated passenger walkway 520 is connecting directly to the passenger waiting area 512, as shown on FIG. 18. Therefore, the elevated autonomous people mover system 400 height requirements are reduced by half compared to the prior art automated people mover system(s) 100.

The sawtooth station 500 consists of two station types, the sawtooth junction 502 and the sawtooth terminal 504. The sawtooth junction 502 connects to the elevated guideway structure 402 at both ends, whereas the sawtooth terminal 504 connects to the elevated guideway structure 402 at one end only.

FIG. 14 shows a plan view of a sawtooth junction 502 with four bidirectional sawtooth berths 514. FIG. 15 shows a plan view of a sawtooth terminal 504 with four bidirectional sawtooth berths 514. FIG. 16 shows a cross-sectional view of the sawtooth junction 502 and the sawtooth terminal 504 with four bidirectional sawtooth berths 514.

The autonomous vehicles 410 enter the sawtooth station 500 at entry 550, move onto the sawtooth bay 514, where the autonomous vehicles 410 stops to embark and disembark passengers, can turn around inside the sawtooth junction 502 and the sawtooth terminal 504 as needed to stop at the sawtooth bay 514. Following embarking and disembarking of passengers, the autonomous vehicles 410 continue to the exit 560.

The sawtooth station 500 includes of two floors, a roof 540, escalators 530, stairways, and elevator between all floors, a 1st floor located on ground 460, where passengers take escalators to the 2nd floor which may be an elevated passenger walkway 520, bidirectional sawtooth platform 510, and passenger waiting area 512.

An optional partition is placed along the sawtooth bay 514, with automatic doors that open when the vehicle is at the sawtooth bay 514. The partition is normally transparent for the passengers to be able to see the vehicle as it arrives.

The passengers are embarking and disembarking the autonomous vehicles 410 at the sawtooth berth 514 at the 2nd floor, from there, passengers go down escalators 530 to the 1st floor located on the ground 460, or go along the elevated passenger walkway 520 to go over the adjacent street 470 and continue down escalators 530 to the 1st floor located on the ground 460 on the other side of the adjacent street 470.

The elevated passenger walkway 520, which is located on the 2nd floor, goes over the adjacent street 470, connecting directly to the passenger waiting area 512 This allows passengers to go from elevated passenger walkway 520 directly on to the autonomous vehicle 410. Therefore, the minimum required height h is around 20 feet.

When the autonomous vehicle 410 passes over the deck 420, the deflection the elevated autonomous people mover system 400 can accommodate is larger than that of the prior art automated people mover system 100. Therefore, in addition to box or truss structure, the deck 420 can be made of less stiff structures such as beams (e.g., array of several beams).

The size of the autonomous vehicle 410 can be reduced compared to the prior art vehicle 110 because the guide structure 120 is eliminated in the elevated autonomous people mover system 400.

Sawtooth Station and Bidirectional Sawtooth Platform

With reference to FIGS. 17 through 45, embodiments of sawtooth stations 500 of a sawtooth station system and methods will be described. The sawtooth stations 500 utilize a bidirectional sawtooth platform 510 to accommodate vehicles form opposite directions.

The bidirectional sawtooth platform 510 can accept autonomous vehicles 410 from any direction. Therefore, only one bidirectional sawtooth platform 510 is required to accommodate traffic in two directions, compared to prior art sawtooth platform 320 where two sawtooth platform 320 are required to accommodate traffic in two directions.

Because the bidirectional sawtooth platform 510 can accommodate traffic from two directions, the sawtooth station 500, in an urban setting, is only two stories high, compared to the prior art sawtooth platform 320 that were three stories high, similar to the prior art automated people mover system 100.

The sawtooth station 500 includes two station types, a sawtooth junction 502 and a sawtooth terminal 504. The sawtooth junction 502 connects to the elevated guideway structure 402 at both ends, whereas the sawtooth terminal 504 connects to the elevated guideway structure 402 at one end only. FIG. 18 shows the sawtooth terminal 504 connecting to the elevated guideway structure 403 at one end but, in an alternative embodiment the sawtooth terminal 504 could also connect to the elevated guideway structure 403 at the opposite end.

Figure 1:
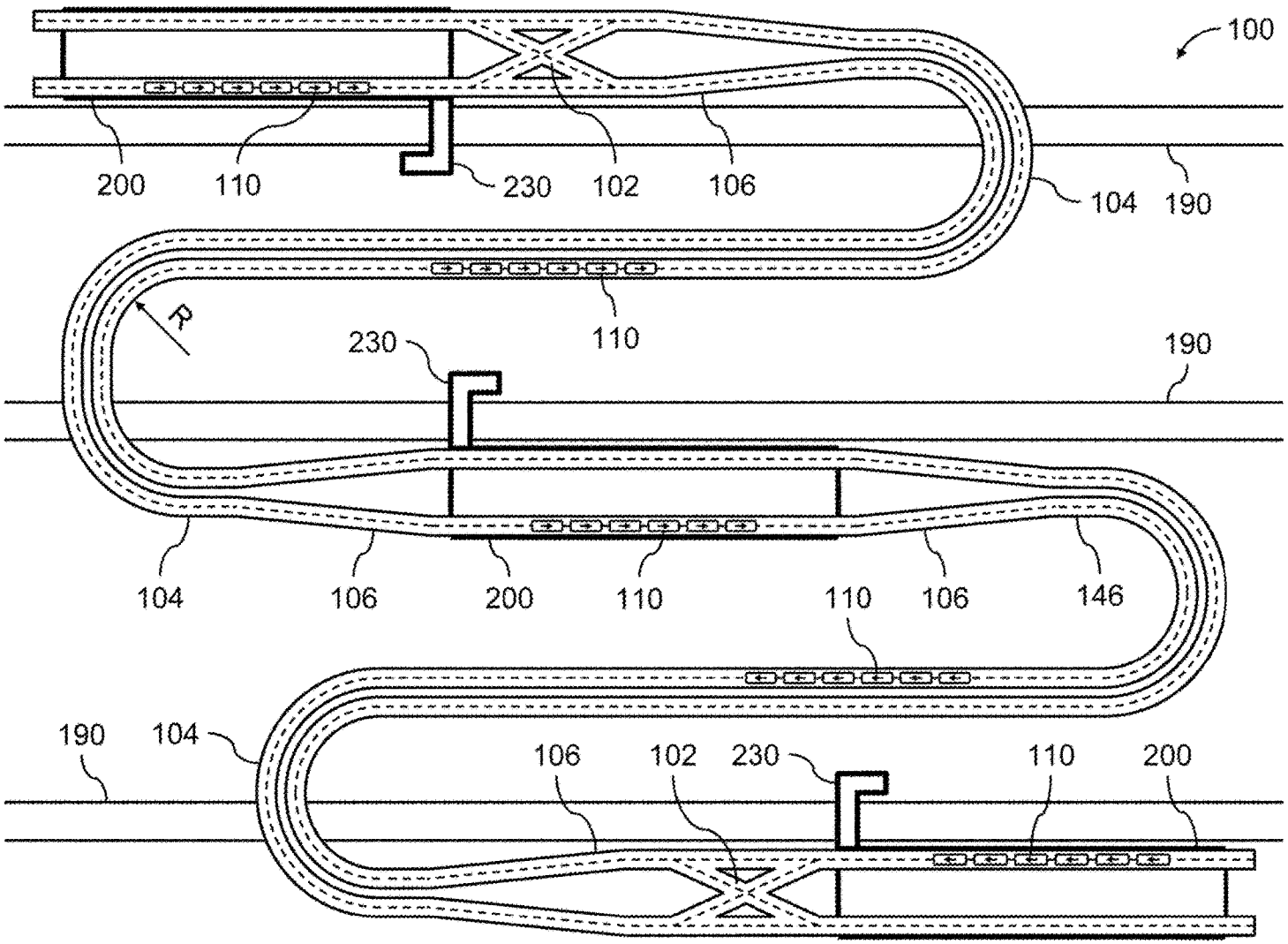
FIG. 1 (PRIOR ART)
FIG. 1 is a schematic alignment of an prior art automated people mover system.
Figure 2:
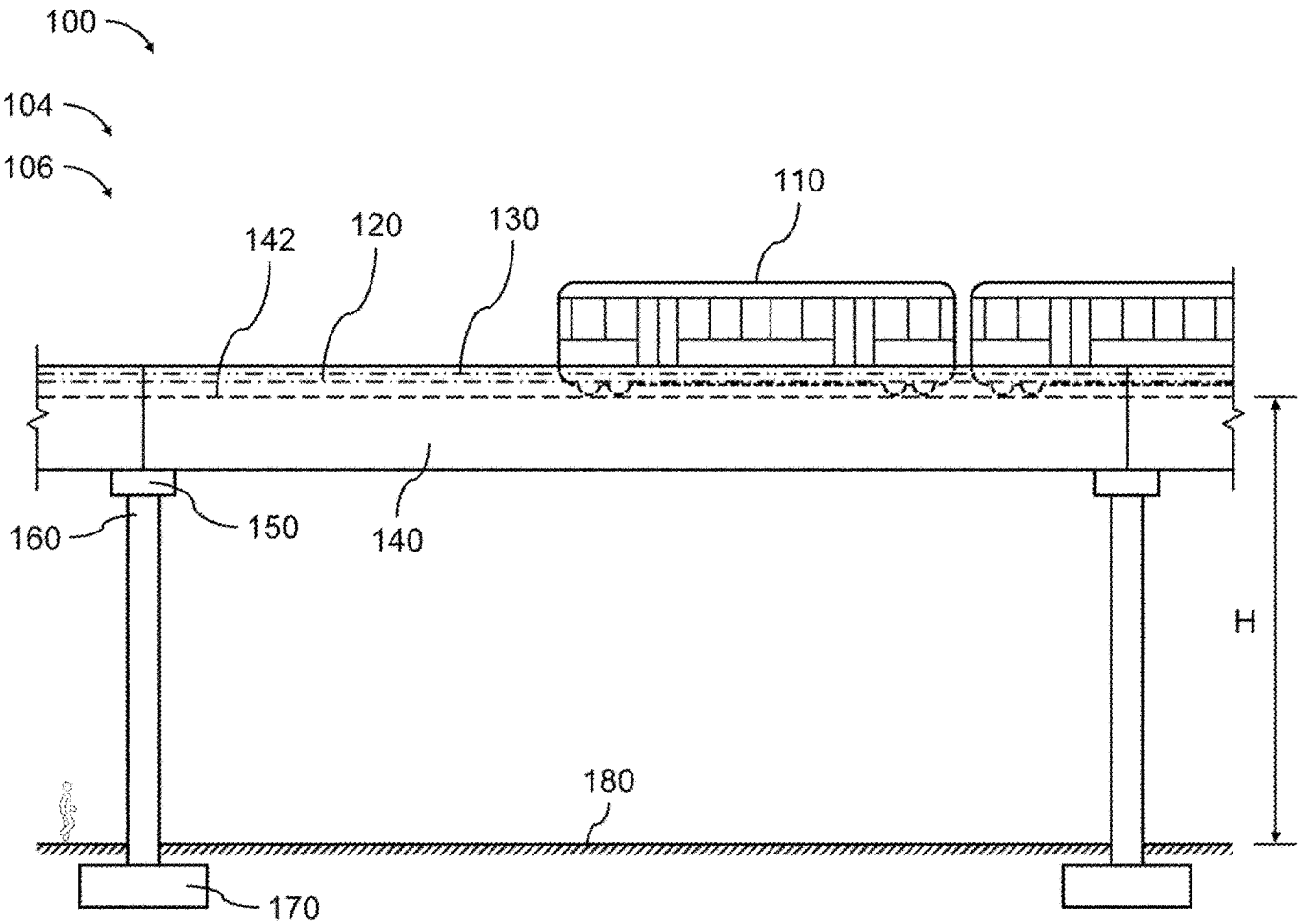
FIG. 2 (PRIOR ART)
FIG. 2 is a elevational view of the elevated guideway structure used for the prior art automated people mover system of FIG. 1.
Figure 3:
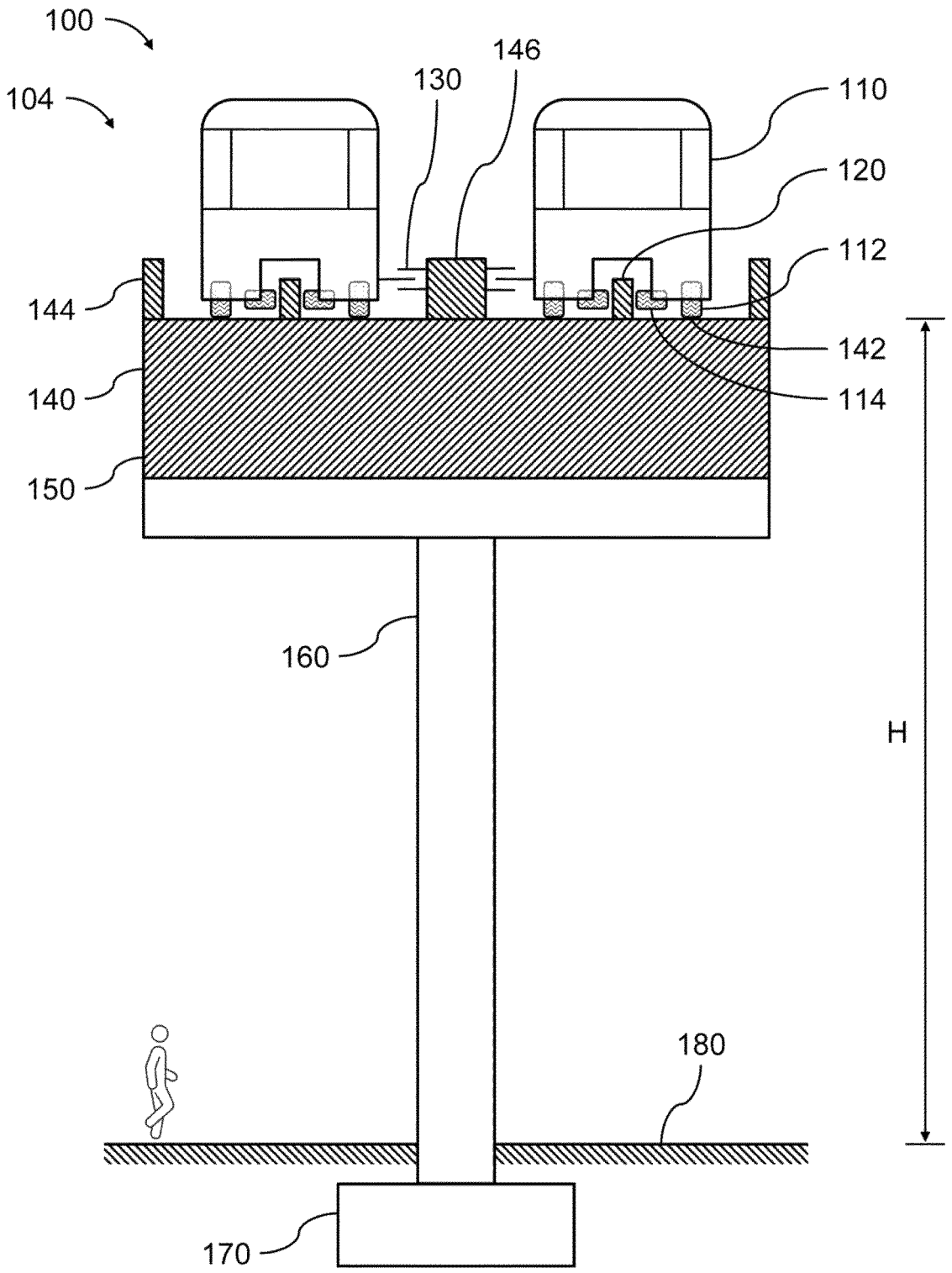
FIG. 3 (PRIOR ART)
FIG. 3 is a cross-sectional view of the two vehicle elevated guideway structure used for the prior art automated people mover system of FIG. 1.
Figure 4:
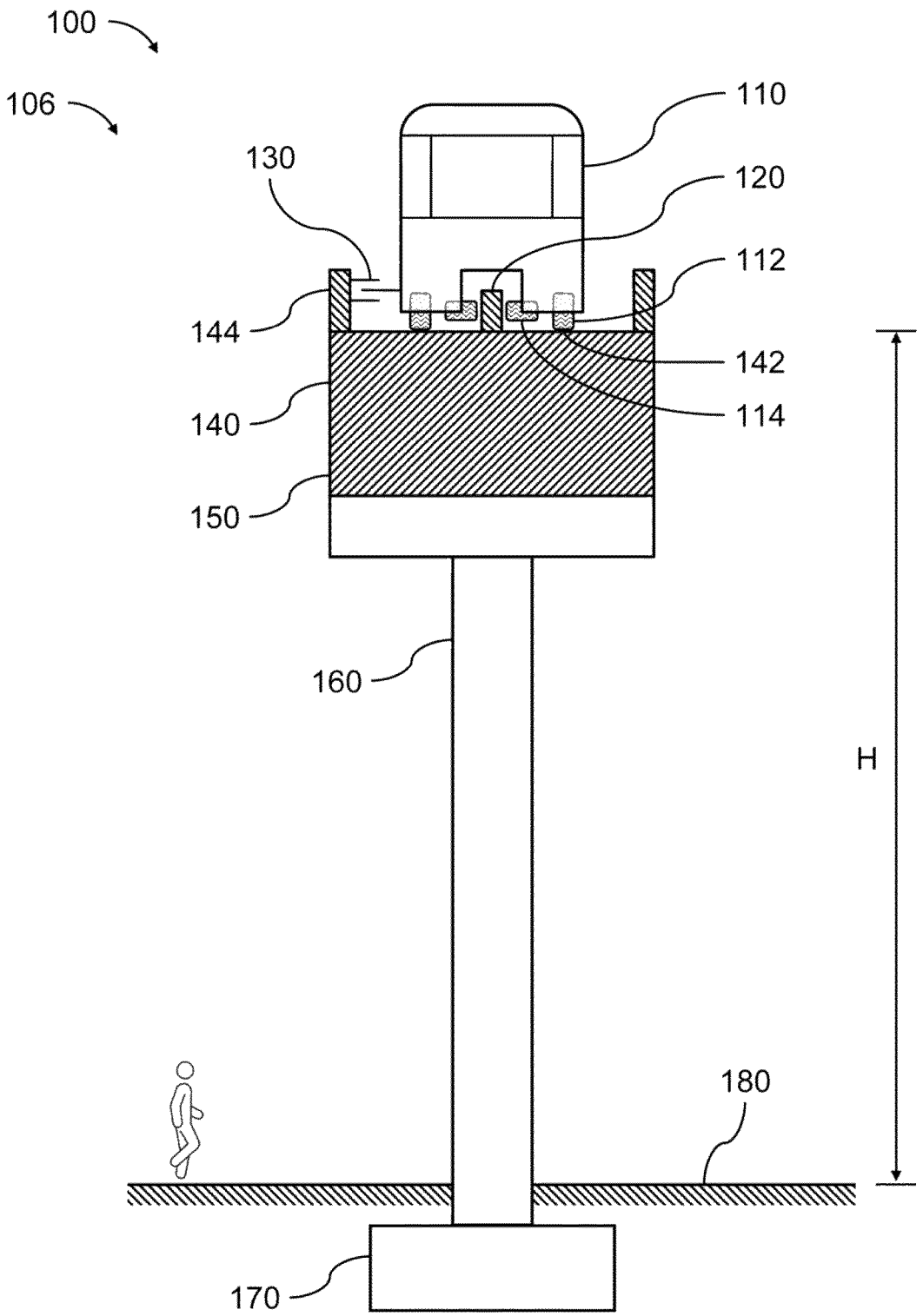
FIG. 4 (PRIOR ART)
FIG. 4 is a cross-sectional view of the one vehicle elevated guideway structure used for the prior art automated people mover system of FIG. 1.
Figure 5:
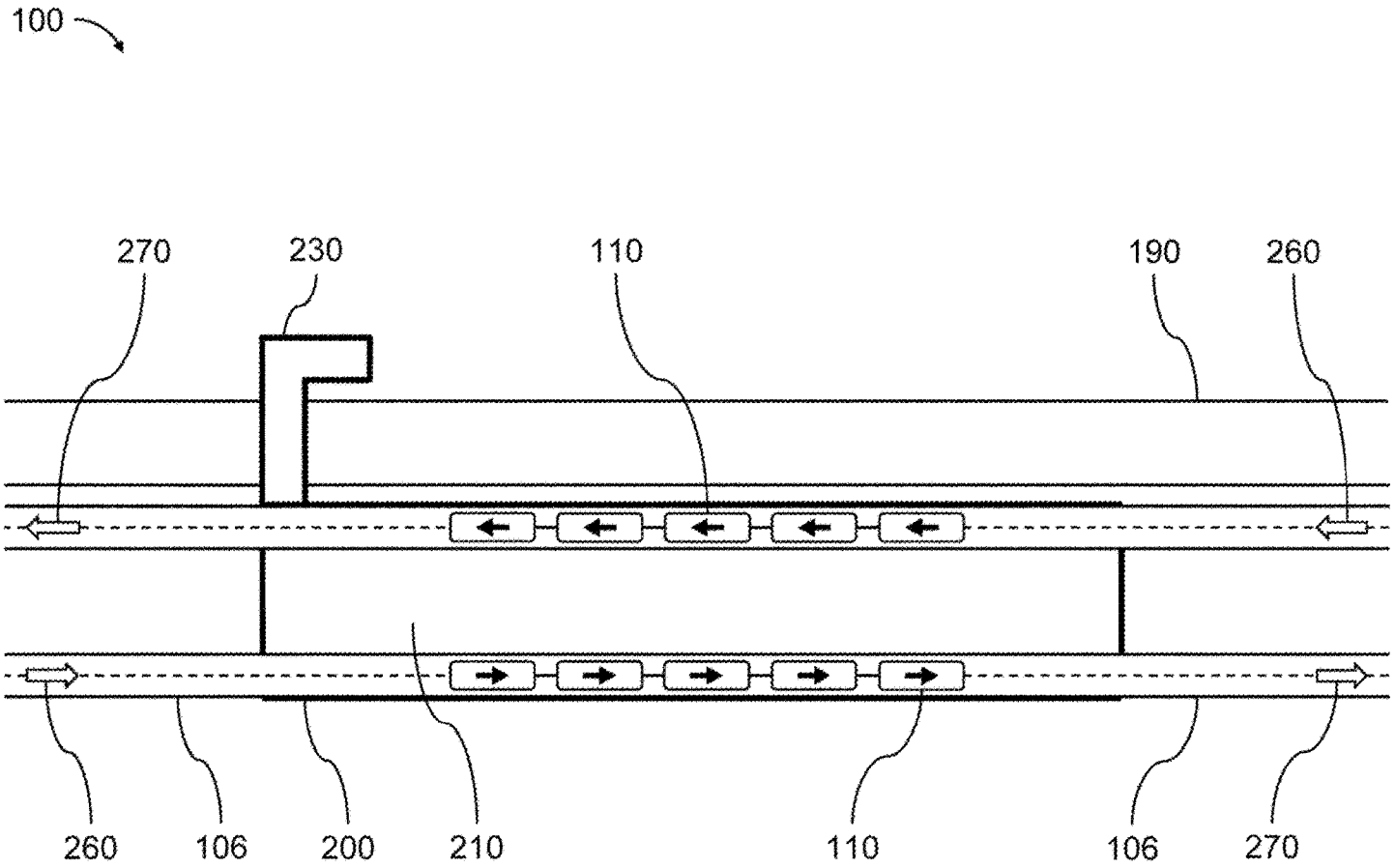
FIG. 5 (PRIOR ART)
FIG. 5 is a plan view of a station with center passenger platform used for the prior art automated people mover system of FIG. 1.
Figure 6:
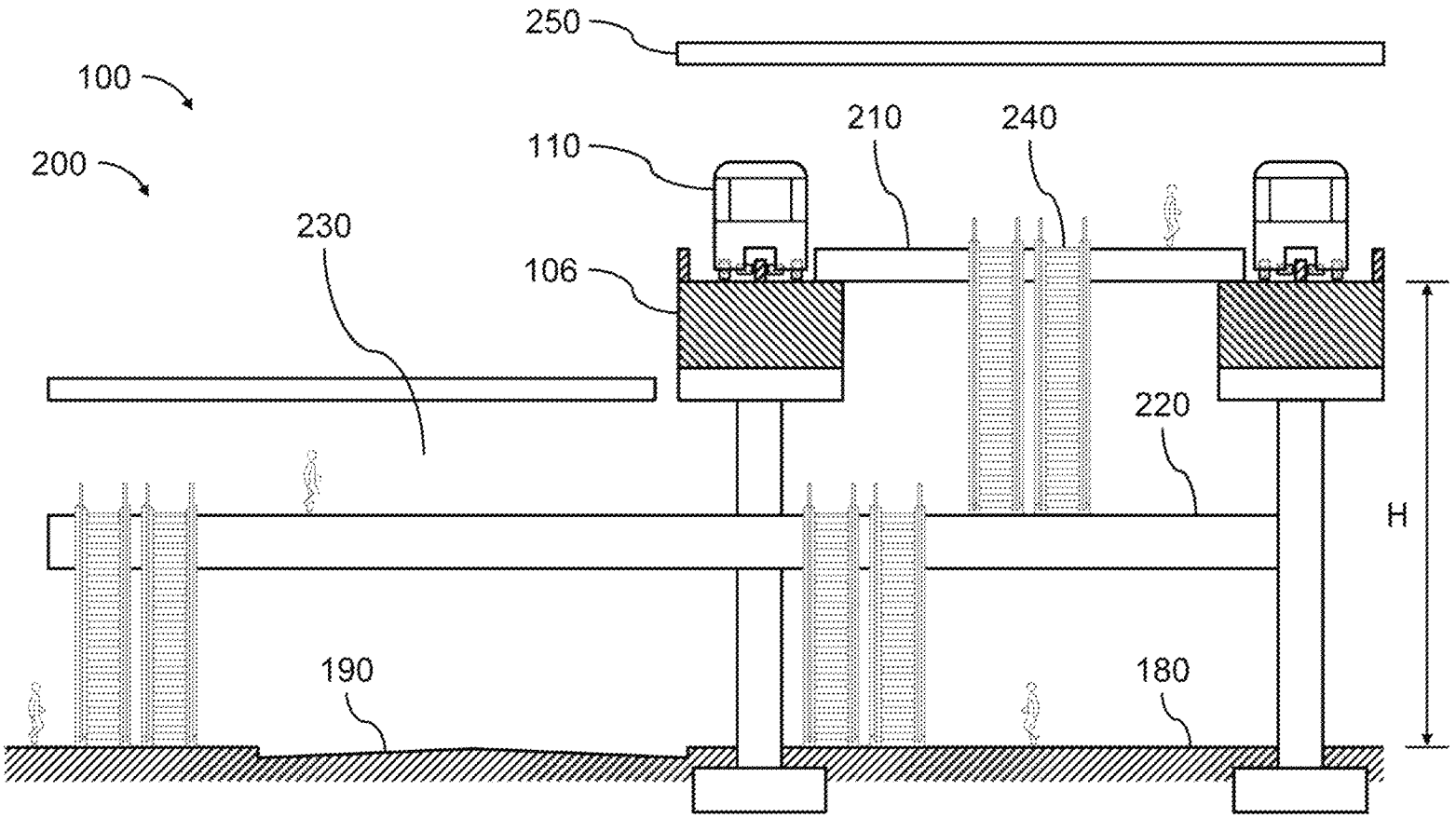
FIG. 6 (PRIOR ART)
FIG. 6 is a cross-sectional view of a station with center passenger platform used for the prior art automated people mover system of FIG. 1.
Figure 7:
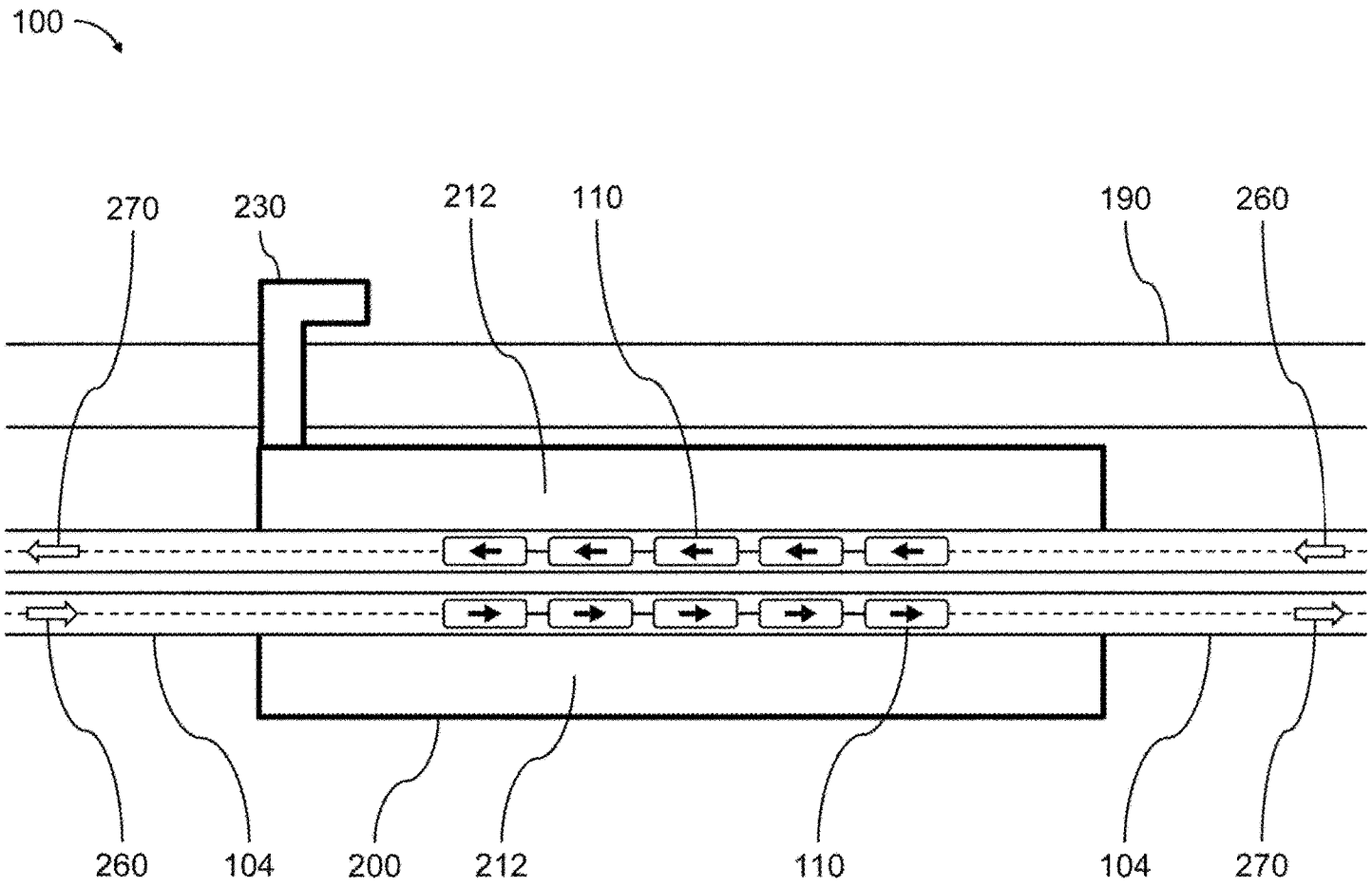
FIG. 7 (PRIOR ART)
FIG. 7 is a plan view of a station with side passenger platform that alternatively can be used for the prior art automated people mover system of FIG. 1.
Figure 8:
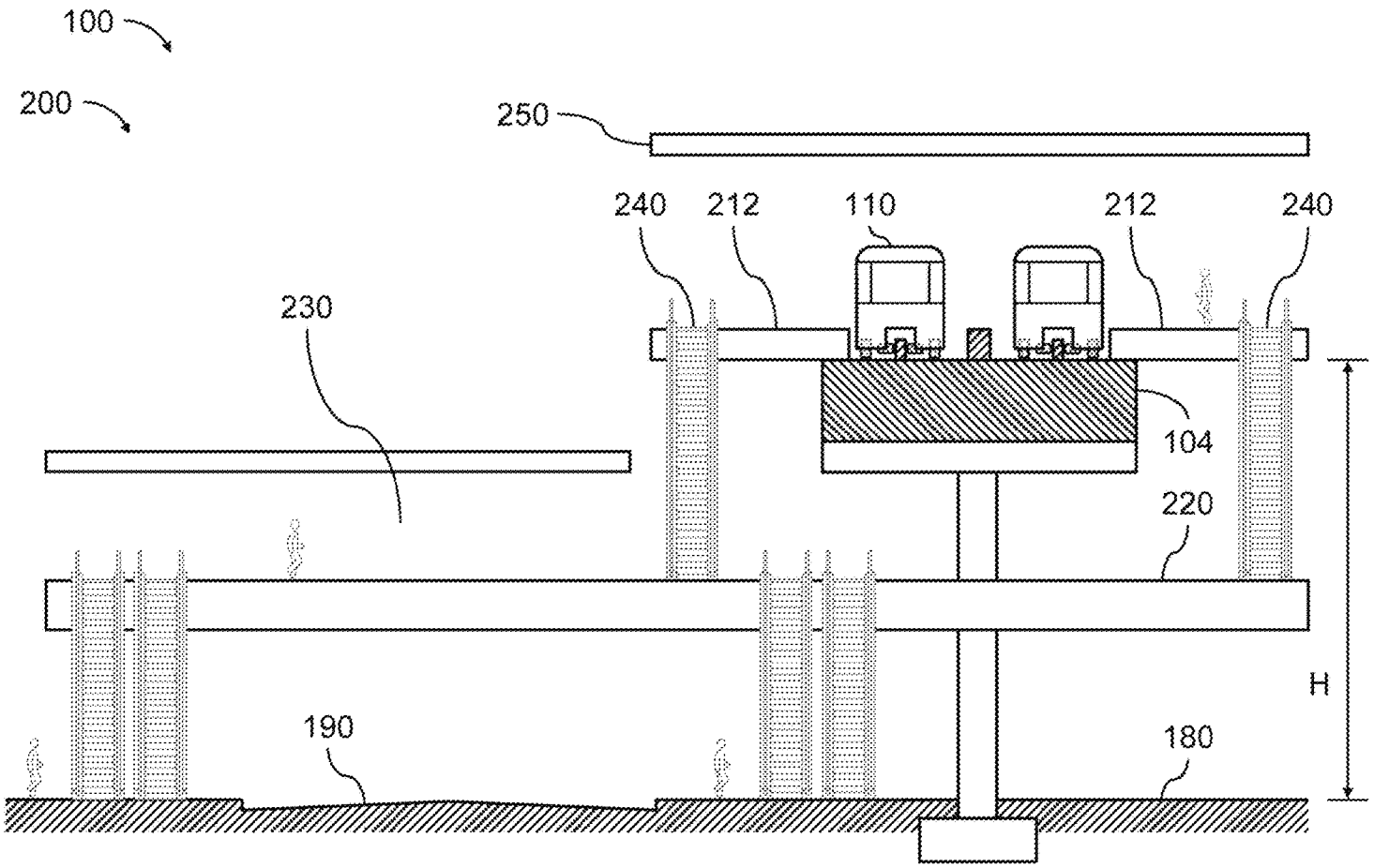
FIG. 8 (PRIOR ART)
FIG. 8 is a cross-sectional view of a station with side passenger platform that alternatively can be used for the prior art automated people mover system of FIG. 1.
Figure 9:
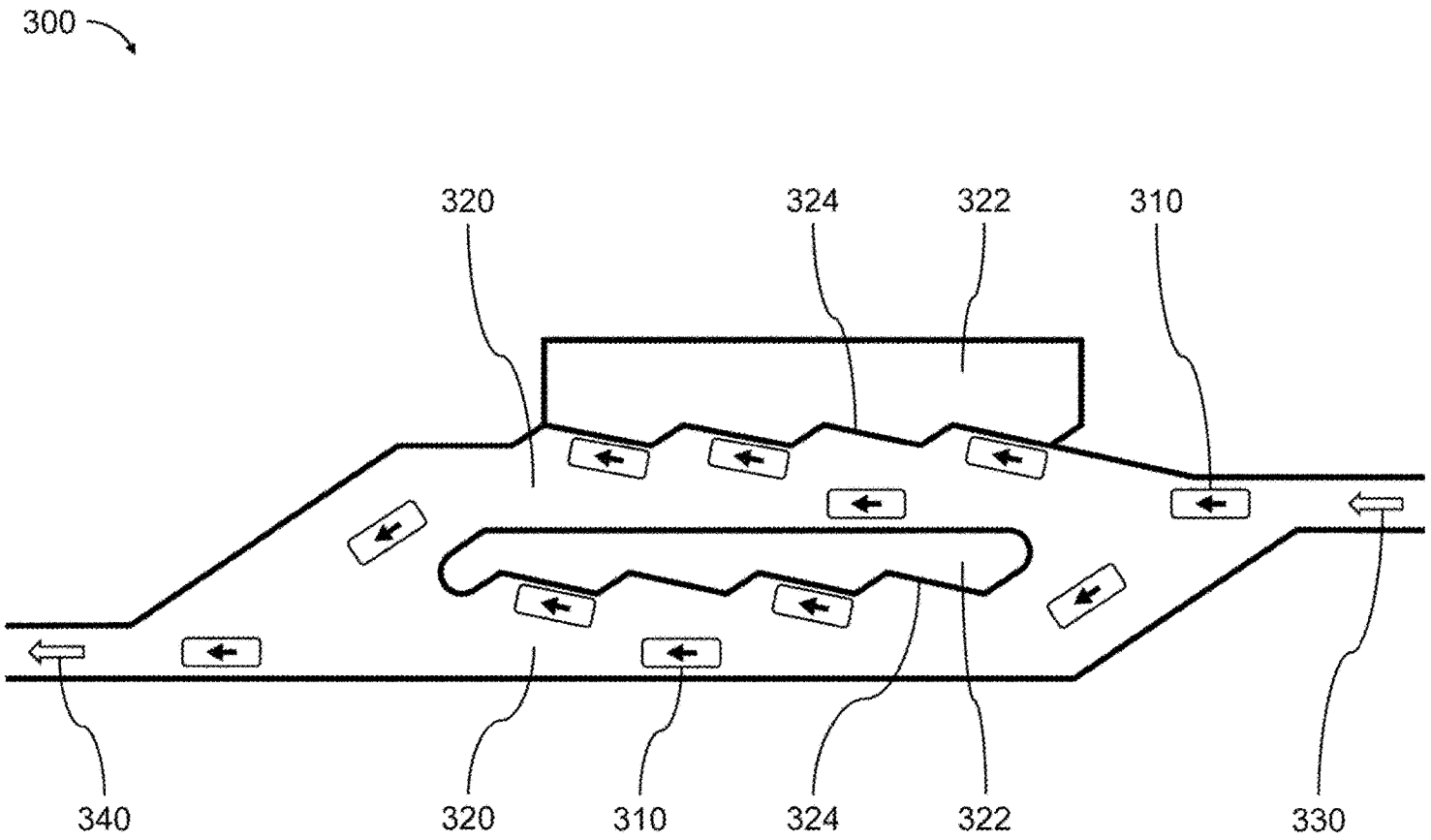
FIG. 9 (PRIOR ART)
FIG. 9 is a schematic plan view of an prior art sawtooth platform systems.

For the sawtooth station 500, the passenger waiting area 512 is on one side only, therefore sawtooth station 500 only require two stories as illustrated in FIG. 16, whereas the prior art automated people mover system 100 requires a three story station 200 (see FIGS. 6 and 8).

FIGS. 17 and 18 show the general layout of the sawtooth junction 502 and the sawtooth terminal 504 respectively. A passenger comes in at the passenger waiting area 512. The autonomous vehicles 410 enters at entry 550 the bidirectional sawtooth platform 510 and continue to the sawtooth berth 514. In the embodiment shown, there are four sawtooth berths 514, numbered 1, 2, 3 and 4, where the passengers can embark and disembark the autonomous vehicles 410. Following embarking and disembarking, the autonomous vehicles 410 continues to an exit 560. An optional partition can be used at the sawtooth berth 514, with automatic doors that open when embarking and disembarking the autonomous vehicles. The partition can be transparent to allow passengers in the passenger waiting area 512 to observe when the autonomous vehicle 410 arrive.

As illustrated in FIGS. 17 and 18, several autonomous vehicles 410 can utilize the bidirectional sawtooth platform 510 simultaneously.

FIGS. 19 through 45 illustrate exemplary movement(s) of the autonomous vehicle 410 within the sawtooth junction 502. The movements within the sawtooth terminal 504 are similar to the sawtooth junction 502 of FIGS. 19 through 45, but there is no entry at A nor exit at C. If sawtooth terminal 504 have the entry and exit at the opposite side, there is no entry at B nor exit at D.

In embodiment(s) of sawtooth station 500 and exemplary methods of use of FIGS. 19 through 45: an autonomous vehicle 410 enters at entry A and stops at sawtooth berth 3 (FIG. 19); an autonomous vehicle 410 enters at entry A and exits at exit B (FIG. 20); an autonomous vehicle 410 enters at entry A, turns around just proximal to exit B, and exits at exit C (FIG. 21); an autonomous vehicle 410 enters at entry D, turns around adjacent to sawtooth berth 2 and stops at sawtooth berth 3 (option 1) (FIG. 22); an autonomous vehicle 410 enters at entry D, turns around adjacent to sawtooth berth 1 and stops at sawtooth berth 3 (option 2) (FIG. 23); an autonomous vehicle 410 enters at entry D, turns around just proximal to exit C and stops at sawtooth berth 3 (option 3) (FIG. 24); an autonomous vehicle 410 enters at entry D and exits at exit C (FIG. 25); an autonomous vehicle 410 enters at entry D, turns around adjacent to sawtooth berth 4 and exits at exit B (option 1) (FIG. 26); an autonomous vehicle 410 enters at entry D, turns around adjacent to sawtooth berth 3 and exits at exit B (option 2) (FIG. 27); an autonomous vehicle 410 enters at entry D, turns around adjacent to sawtooth berth 2 and exits at exit B (option 3) (FIG. 28); an autonomous vehicle 410 enters at entry D, turns around adjacent to sawtooth berth 1 and exits at exit B (option 4) (FIG. 29); an autonomous vehicle 410 enters at entry D, turns around adjacent to exit C and exits at exit B (option 5) (FIG. 30); an autonomous vehicle 410 leaving sawtooth berth 3 and exits at exit B (FIG. 31); an autonomous vehicle 410 leaving sawtooth berth 3, immediately turns around, and exits at exit C (option 1) (FIG. 32); an autonomous vehicle 410 leaving sawtooth berth 3, turns around adjacent to exit B, and exits at exit C (option 2) (FIG. 33); an autonomous vehicle 410 leaving sawtooth berth 3, immediately turns around, turns around again adjacent to sawtooth berth 1, and stops at sawtooth berth 2 (option 1) (FIG. 34); an autonomous vehicle 410 leaves sawtooth berth 3, immediately turns around, turns around again just proximal to exit C, and stops at sawtooth berth 2 (option 2) (FIG. 35); an autonomous vehicle 410 leaves sawtooth berth 3, immediately turns around, turns around again adjacent to sawtooth berth 1, and stops at sawtooth berth 2 (option 3) (FIG. 36); an autonomous vehicle 410 leaves sawtooth berth 3, turns around, turns around just proximal to exit B, turns around again just proximal to exit C, and stops at sawtooth berth 2 (option 4) (FIG. 37); an autonomous vehicle 410 leaves sawtooth berth 3, and stops at sawtooth berth 4 (option 1) (FIG. 38); an autonomous vehicle 410 leaves sawtooth berth 3, immediately turns around, turns around again adjacent to sawtooth berth 2, and stops at sawtooth berth 4 (option 2) (FIG. 39); an autonomous vehicle 410 leaves sawtooth berth 3, immediately turns around, turns around again adjacent to sawtooth berth 1, and stops at sawtooth berth 4 (option 3) (FIG. 40); an autonomous vehicle 410 leaving sawtooth berth 3, immediately turns around, turns around again just proximal to exit C, and stops at sawtooth berth 4 (option 4) (FIG. 41); an autonomous vehicle 410 leaves sawtooth berth 3, turns around just proximal to exit B, turns around again adjacent to sawtooth berth 3, and stops at sawtooth berth 4 (option 5) (FIG. 42); an autonomous vehicle 410 leaves sawtooth berth 3, turns around just proximal to exit B, turns around again adjacent to sawtooth berth 2, and stops at sawtooth berth 4 (option 6) (FIG. 43); an autonomous vehicle 410 leaves sawtooth berth 3, turns around just proximal to exit B, turns around again adjacent to sawtooth berth 1, and stops at sawtooth berth 4 (option 7) (FIG. 44); an autonomous vehicle 410 leaves sawtooth berth 3, turns around just proximal to exit B, turns around again just proximal to exit C, and stops at sawtooth berth 4 (option 8) (FIG. 45).

Car Tether

With reference to FIGS. 46 through 52, an embodiment of a car tether system 600 and method for controlling autonomous vehicle operation in an Elevated Autonomously People Mover System 400 will be described.

FIG. 46. shows a car tether system 600 control all autonomous vehicle(s) 410 within a predetermined control area 610. For the Autonomously People Mover System 400, each sawtooth station 500 is within one predetermined control area 610. Therefore, several car tether systems 600 will be utilized to control all sawtooth station(s) 500 within one Autonomously People Mover System 400.

FIGS. 47 and 48 shows the general layout of the predetermined control area 610 utilized for the sawtooth junction 502 and the sawtooth terminal 504 respectively.

The car tether system 600 controls the interaction between the autonomous vehicle 410 used in the predetermined control area 610. The car tether system 600 establishes an environment within the predetermined control area 610 where each autonomous vehicle 410 is constantly moving towards its destination without interruptions. When the autonomous vehicle 410 has to interact with another autonomous vehicle 410, the car tether system 600 controls the interaction to optimize the driving condition for both autonomous vehicle 410 and provides a seamless interaction between the two autonomous vehicles 410. The autonomous vehicles 410 will continuously and smoothly move towards their respective destinations without any stoppages.

The car tether system 600 controls the autonomous vehicle(s) 410 global position, acceleration, speed, and direction to create a seamless interaction between all autonomous vehicle(s) 410 within the predetermined control area 610.

The car tether system 600 will take over the control of the autonomous vehicle 410 when it enters at an entry 620 of the predetermined control area 610, and the control will be returned to the autonomous vehicle 410 when it exits at an exit 630 of the predetermined control area 610.

The car tether system 600 controls the movement of the autonomous vehicle 410 to a desired location within the predetermined control area 610 or to the exit 630.

The car tether 600 system controls interactions between all the autonomous vehicles 410 in the predetermined control area 610.

The car tether 600 system controls the right-of-way for all autonomous vehicles 410 in the predetermined control area 610 to create a smooth traffic flow.

FIGS. 49 through 52 show the sawtooth junction 502 and movement flow of two autonomous vehicles 410 that merge into the same directional flow. During movement of the autonomous vehicles 410, the car tether system 600 controls the autonomous vehicles 410 to create a smooth transition. The car tether 600 system 600 controls the autonomous vehicles 410 to provide relative distance between the autonomous vehicles 410 to create a seamless merger of the two directional flows. The relative distance between the autonomous vehicles 410 can also be expressed as an area or volume around the autonomous vehicles 410 or other means of expression. The car tether system 600 can control movement flow of any number of autonomous vehicles 410 that are merging into the same directional flow. The car tether control within the sawtooth terminal 504 is similar to the control within the sawtooth junction 502.

System Overview

With reference to FIG. 53, an example infrastructure, in which one or more of the processes described herein, may be implemented, according to an embodiment, will be described, and, with reference to FIG. 54, an example processing system, by which one or more of the processes described herein, may be executed, according to an embodiment, will be described.

For example, but not by way of limitation, the example infrastructure and/or example processing system may be used with respect to the control, operation, and/or charging of the autonomous vehicle(s) 410 as described herein.

Infrastructure

FIG. 53 illustrates an example system 700 that may be used, for example, but not by way of limitation, for the c control, operation, and/or charging of the autonomous vehicle(s) 300 as described herein, according to an embodiment. The infrastructure may comprise a platform 710 (e.g., one or more servers) which hosts and/or executes one or more of the various functions, processes, methods, and/or software modules described herein. Platform 710 may comprise dedicated servers, or may instead comprise cloud instances, which utilize shared resources of one or more servers. These servers or cloud instances may be collocated and/or geographically distributed. Platform 710 may also comprise or be communicatively connected to a server application 712 and/or one or more databases 714. In addition, platform 710 may be communicatively connected to one or more user systems 730 via one or more networks 720. Platform 710 may also be communicatively connected to one or more external systems 740 (e.g., other platforms, websites, etc.) via one or more networks 720.

Network(s) 720 may comprise the Internet, and platform 710 may communicate with user system(s) 730 through the Internet using standard transmission protocols, such as Hypertext Transfer Protocol (HTTP), HTTP Secure (HTTPS), File Transfer Protocol (FTP), FTP Secure (FTPS), Secure Shell FTP (SFTP), and the like, as well as proprietary protocols. While platform 710 is illustrated as being connected to various systems through a single set of network(s) 720, it should be understood that platform 710 may be connected to the various systems via different sets of one or more networks. For example, platform 710 may be connected to a subset of user systems 730 and/or external systems 740 via the Internet, but may be connected to one or more other user systems 730 and/or external systems 740 via an intranet. Furthermore, while only a few user systems 730 and external systems 740, one server application 712, and one set of database(s) 714 are illustrated, it should be understood that the infrastructure may comprise any number of user systems, external systems, server applications, and databases.

User system(s) 730 may comprise any type or types of computing devices capable of wired and/or wireless communication, including without limitation, desktop computers, laptop computers, tablet computers, smart phones or other mobile phones, servers, game consoles, televisions, set-top boxes, electronic kiosks, point-of-sale terminals, Automated Teller Machines, autonomous vehicle system, and/or the like.

Platform 710 may comprise web servers which host one or more websites and/or web services. In embodiments in which a website is provided, the website may comprise a graphical user interface, including, for example, one or more screens (e.g., webpages) generated in Hypertext Markup Language (HTML) or other language. Platform 710 transmits or serves one or more screens of the graphical user interface in response to requests from user system(s) 730. In some embodiments, these screens may be served in the form of a wizard, in which case two or more screens may be served in a sequential manner, and one or more of the sequential screens may depend on an interaction of the user or user system 730 with one or more preceding screens. The requests to platform 710 and the responses from platform 710, including the screens of the graphical user interface, may both be communicated through network(s) 720, which may include the Internet, using standard communication protocols (e.g., HTTP, HTTPS, etc.). These screens (e.g., webpages) may comprise a combination of content and elements, such as text, images, videos, animations, references (e.g., hyperlinks), frames, inputs (e.g., textboxes, text areas, checkboxes, radio buttons, drop-down menus, buttons, forms, etc.), scripts (e.g., JavaScript), and the like, including elements comprising or derived from data stored in one or more databases (e.g., database(s) 714) that are locally and/or remotely accessible to platform 710. Platform 710 may also respond to other requests from user system(s) 730.

Platform 710 may further comprise, be communicatively coupled with, or otherwise have access to one or more database(s) 714. For example, platform 710 may comprise one or more database servers which manage one or more databases 714. A user system 730 or server application 712 executing on platform 710 may submit data (e.g., user data, form data, etc.) to be stored in database(s) 714, and/or request access to data stored in database(s) 714. Any suitable database may be utilized, including without limitation MySQL™, Oracle™, IBM™, Microsoft SQL™, Access™, and the like, including cloud-based databases and proprietary databases. Data may be sent to platform 710, for instance, using the well-known POST request supported by HTTP, via FTP, and/or the like. This data, as well as other requests, may be handled, for example, by server-side web technology, such as a servlet or other software module (e.g., comprised in server application 712), executed by platform 710.

In embodiments in which a web service is provided, platform 710 may receive requests from external system(s) 740, and provide responses in eXtensible Markup Language (XML), JavaScript Object Notation (JSON), and/or any other suitable or desired format. In such embodiments, platform 710 may provide an application programming interface (API) which defines the manner in which user system(s) 730 and/or external system(s) 740 may interact with the web service. Thus, user system(s) 730 and/or external system(s) 740 (which may themselves be servers), can define their own user interfaces, and rely on the web service to implement or otherwise provide the backend processes, methods, functionality, storage, and/or the like, described herein. For example, in such an embodiment, a client application 732 executing on one or more user system (s) 730 may interact with a server application 712 executing on platform 710 to execute one or more or a portion of one or more of the various functions, processes, methods, and/or software modules described herein. Client application 732 may be "thin," in which case processing is primarily carried out server-side by server application 712 on platform 710. A basic example of a thin client application is a browser application, which simply requests, receives, and renders webpages at user system(s) 730, while the server application on platform 710 is responsible for generating the webpages and managing database functions. Alternatively, the client application may be "thick," in which case processing is primarily carried out client-side by user system(s) 730. It should be understood that client application 732 may perform an amount of processing, relative to server application 712 on platform 710, at any point along this spectrum between "thin" and "thick," depending on the design goals of the particular implementation. In any case, the application described herein, which may wholly reside on either platform 710 (e.g., in which case server application 712 performs all processing) or user system(s) 730 (e.g., in which case client application 732 performs all processing) or be distributed between platform 710 and user system(s) 730 (e.g., in which case server application 712 and client application 732 both perform processing), can comprise one or more executable software modules that implement one or more of the functions, processes, or methods of the application described herein.

Example Processing Device

FIG. 54 is a block diagram illustrating an example wired or wireless system 800 that may be used in connection with various embodiments described herein. The system 800 may be used, for example, but not by way of limitation, in conjunction with one or more of the functions, processes, or methods (e.g., to store and/or execute the application or one or more software modules of the application) described herein (e.g., for the control, operation, and/or charging of the autonomous vehicle(s) 300), and may represent components of platform 710, user system(s) 730, external system(s) 740, and/or other processing devices described herein. System 800 can be a server or any conventional personal computer, or any other processor-enabled device that is capable of wired or wireless data communication. Other computer systems and/or architectures may be also used, as will be clear to those skilled in the art.

System 800 preferably includes one or more processors, such as processor 810. Additional processors may be provided, such as an auxiliary processor to manage input/output, an auxiliary processor to perform floating-point mathematical operations, a special-purpose microprocessor having an architecture suitable for fast execution of signal-processing algorithms (e.g., digital-signal processor), a slave processor subordinate to the main processing system (e.g., back-end processor), an additional microprocessor or controller for dual or multiple processor systems, and/or a coprocessor. Such auxiliary processors may be discrete processors or may be integrated with processor 810. Examples of processors which may be used with system 800 include, without limitation, the Pentium® processor, Core i7® processor, and Xeon® processor, all of which are available from Intel Corporation of Santa Clara, California.

Processor 810 is preferably connected to a communication bus 805. Communication bus 805 may include a data channel for facilitating information transfer between storage and other peripheral components of system 800. Furthermore, communication bus 805 may provide a set of signals used for communication with processor 810, including a data bus, address bus, and/or control bus (not shown). Communication bus 805 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, standards promulgated by the Institute of Electrical and Electronics Engineers (IEEE) including IEEE 488 general-purpose interface bus (GPIB), IEEE 696/S-100, and/or the like.

System 800 preferably includes a main memory 815 and may also include a secondary memory 820. Main memory 815 provides storage of instructions and data for programs executing on processor 810, such as one or more of the functions and/or modules discussed herein. It should be understood that programs stored in the memory and executed by processor 810 may be written and/or compiled according to any suitable language, including without limitation C/C++, Java, JavaScript, Perl, Visual Basic, .NET, and the like. Main memory 815 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

Secondary memory 820 may optionally include an internal medium 825 and/or a removable medium 830. Removable medium 830 is read from and/or written to in any well-known manner. Removable storage medium 830 may be, for example, a magnetic tape drive, a compact disc (CD) drive, a digital versatile disc (DVD) drive, other optical drive, a flash memory drive, and/or the like.

Secondary memory 820 is a non-transitory computer-readable medium having computer-executable code (e.g., disclosed software modules) and/or other data stored thereon. The computer software or data stored on secondary memory 820 is read into main memory 815 for execution by processor 810.

In alternative embodiments, secondary memory 820 may include other similar means for allowing computer programs or other data or instructions to be loaded into system 800. Such means may include, for example, a communication interface 840, which allows software and data to be transferred from external storage medium 845 to system 800. Examples of external storage medium 845 may include an external hard disk drive, an external optical drive, flash memory, an external magneto-optical drive, and/or the like. Other examples of secondary memory 820 may include semiconductor-based memory, such as programmable read-only memory (PROM), erasable programmable read-only memory (EPROM), electrically erasable read-only memory (EEPROM), and flash memory (block-oriented memory similar to EEPROM).

Memory 815, 820 may store data related to insight into emergency progress and/or situation status data, which could be used as a research tool.

As mentioned above, system 800 may include a communication interface 840. Communication interface 840 allows software and data to be transferred between system 800 and external devices (e.g. printers), networks, or other information sources. For example, computer software or executable code may be transferred to system 800 from a network server (e.g., platform 710) via communication interface 840. Examples of communication interface 840 include a built-in network adapter, network interface card (NIC), Personal Computer Memory Card International Association (PCMCIA) network card, card bus network adapter, wireless network adapter, Universal Serial Bus (USB) network adapter, modem, a wireless data card, a communications port, an infrared interface, an IEEE 1394 fire-wire, and any other device capable of interfacing system 800 with a network (e.g., network(s) 720) or another computing device. Communication interface 840 preferably implements industry-promulgated protocol standards, such as Ethernet IEEE 802 standards, Fiber Channel, digital subscriber line (DSL), asynchronous digital subscriber line (ADSL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on, but may also implement customized or non-standard interface protocols as well.

Software and data transferred via communication interface 840 are generally in the form of electrical communication signals 855. These signals 855 may be provided to communication interface 840 via a communication channel 850. In an embodiment, communication channel 850 may be a wired or wireless network (e.g., network(s) 720), or any variety of other communication links. Communication channel 850 carries signals 855 and can be implemented using a variety of wired or wireless communication means including wire or cable, fiber optics, conventional phone line, cellular phone link, wireless data communication link, radio frequency ("RF") link, or infrared link, satellite link, just to name a few.

Computer-executable code (e.g., computer programs, such as the disclosed application, or software modules) is stored in main memory 815 and/or secondary memory 820. Computer programs can also be received via communication interface 840 and stored in main memory 815 and/or secondary memory 820. Such computer programs, when executed, enable system 800 to perform the various functions of the disclosed embodiments as described elsewhere herein.

In this description, the term "computer-readable medium" is used to refer to any non-transitory computer-readable storage media used to provide computer-executable code and/or other data to or within system 800. Examples of such media include main memory 815, secondary memory 820 (including internal memory 825, removable medium 830, and external storage medium 845), and any peripheral device communicatively coupled with communication interface 840 (including a network information server or other network device). These non-transitory computer-readable media are means for providing executable code, programming instructions, software, and/or other data to system 800.

In an embodiment that is implemented using software, the software may be stored on a computer-readable medium and loaded into system 800 by way of removable medium 830, I/O interface 835, or communication interface 840. In such an embodiment, the software is loaded into system 800 in the form of electrical communication signals 855. The software, when executed by processor 810, preferably causes processor 810 to perform one or more of the processes and functions described elsewhere herein.

In an embodiment, I/O interface 835 provides an interface between one or more components of system 800 and one or more input and/or output devices. Example input devices include, without limitation, sensors, keyboards, touch screens or other touch-sensitive devices, biometric sensing devices, computer mice, trackballs, pen-based pointing devices, and/or the like. Examples of output devices include, without limitation, other processing devices, cathode ray tubes (CRTs), plasma displays, light-emitting diode (LED) displays, liquid crystal displays (LCDs), printers, vacuum fluorescent displays (VFDs), surface-conduction electron-emitter displays (SEDs), field emission displays (FEDs), and/or the like. In some cases, an input and output device may be combined, such as in the case of a touch panel display (e.g., in a smartphone, tablet, or other mobile device).

System 800 may also include one or more optional wireless communication components that facilitate wireless communication over a voice network and/or a data network (e.g., in the case of user system 730). The wireless communication components comprise an antenna system 870, a radio/satellite system 865, and a baseband system 860. In system 800, radio frequency (RF) and/or Satellite signals are transmitted and received over the air by antenna system 870 under the management of radio/satellite system 865.

In an embodiment, antenna system 870 may comprise one or more antennae and one or more multiplexors (not shown) that perform a switching function to provide antenna system 870 with transmit and receive signal paths. In the receive path, received RF and/or Satellite signals can be coupled from a multiplexor to a low noise amplifier (not shown) that amplifies the received RF and/or Satellite signal and sends the amplified signal to radio/satellite system 865.

In an alternative embodiment, radio system 865 may comprise one or more radios that are configured to communicate over various frequencies. In an embodiment, radio system 865 may combine a demodulator (not shown) and modulator (not shown) in one integrated circuit (IC). The demodulator and modulator can also be separate components. In the incoming path, the demodulator strips away the RF carrier signal leaving a baseband receive audio signal, which is sent from radio system 865 to baseband system 860.

If the received signal contains audio information, then baseband system 860 decodes the signal and converts it to an analog signal. Then the signal is amplified and sent to a speaker. Baseband system 860 also receives analog audio signals from a microphone. These analog audio signals are converted to digital signals and encoded by baseband system 860. Baseband system 860 also encodes the digital signals for transmission and generates a baseband transmit audio signal that is routed to the modulator portion of radio system 865. The modulator mixes the baseband transmit audio signal with an RF carrier signal, generating an RF transmit signal that is routed to antenna system 870 and may pass through a power amplifier (not shown). The power amplifier amplifies the RF transmit signal and routes it to antenna system 870, where the signal is switched to the antenna port for transmission.

Baseband system 860 is also communicatively coupled with processor 810, which may be a central processing unit (CPU). Processor 810 has access to data storage areas 815 and 820. Processor 810 is preferably configured to execute instructions (i.e., computer programs, such as the disclosed application, or software modules) that can be stored in main memory 815 or secondary memory 820. Computer programs can also be received from baseband processor 860 and stored in main memory 810 or in secondary memory 820, or executed upon receipt. Such computer programs, when executed, enable system 800 to perform the various functions of the disclosed embodiments.

Process Overview

Embodiment(s) of processes for the control and/or operation of the autonomous vehicle(s) 410 will now be described in detail. It should be understood that the described processes may be embodied in one or more software modules that are executed by one or more hardware processors (e.g., processor 810), e.g., as the application discussed herein (e.g., server application 712, client application 732, and/or a distributed application comprising both server application 712 and client application 732), which may be executed wholly by processor(s) of platform 710, wholly by processor (s) of user system(s) 730, or may be distributed across platform 710 and user system(s) 730, such that some portions or modules of the application are executed by platform 710 and other portions or modules of the application are executed by user system(s) 730. The described processes may be implemented as instructions represented in source code, object code, and/or machine code. These instructions may be executed directly by the hardware processor(s), or alternatively, may be executed by a virtual machine operating between the object code and the hardware processors. In addition, the disclosed application may be built upon or interfaced with one or more existing systems.

Alternatively, the described processes may be implemented as a hardware component (e.g., general-purpose processor, integrated circuit (IC), application-specific integrated circuit (ASIC), digital signal processor (DSP), field-programmable gate array (FPGA) or other programmable logic device, discrete gate or transistor logic, etc.), combination of hardware components, or combination of hardware and software components. To clearly illustrate the interchangeability of hardware and software, various illustrative components, blocks, modules, circuits, and steps are described herein generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a component, block, module, circuit, or step is for ease of description. Specific functions or steps can be moved from one component, block, module, circuit, or step to another without departing from the invention.

FIG. 55 is a flow chart illustrating an exemplary method 672 of using the car tether system 600 to control the autonomous vehicles 410. The method 672 is repeated for all autonomous vehicles 410 in the predetermined control area 610 until the autonomous vehicles 410 exit the predetermined control area 610 or are at their desired destination within the predetermined control area 610. In block 674, the autonomous vehicle 410 enters the predetermined control area 610, or the autonomous vehicle 410 is at its desired destination within the predetermined control area 610 and starts moving towards a new desired destination. In block 676, the cart tether system 600 utilizes the infrastructure 700 (including iterative processes) to take control of the autonomous vehicle 410, obtain the desired destination and other control parameters from the autonomous vehicle 410. In block 678, the car tether system 600 utilizes the infrastructure 700 (including iterative processes) to optimize travel route, speed and global positioning, etc. for the autonomous vehicle 410 at any time during its travel to its desired destination or exit point 630. Travel routes of other autonomous vehicles 410 are modified as required to provide a seamless interaction between all autonomous vehicles 410 within the predetermined control area 610. In block 680, the car tether system 600 determines if the autonomous vehicle 410 is at its desired destination or exit point 630. If no, then control is passed on to block 670. If yes, the control is passed on to block 682, where all controls are returned to the autonomous vehicle 410 at exit 630 as the autonomous vehicle 410 exits the predetermined control area 610 or is at its desired destination within the predetermined control area 610.

Additional Embodiments

Elevated Autonomous People Mover

FIG. 56 shows a plan view of an elevated autonomous people mover system 400 with a sawtooth junction 502 containing a bidirectional sawtooth platform 510 utilizing three sawtooth berths 514. FIG. 57 shows a plan view of a sawtooth junction 502 with a bidirectional sawtooth platform 510 utilizing two sawtooth berths 514. FIG. 58 shows a plan view of a sawtooth junction 502 with a bidirectional sawtooth platform 510 utilizing one sawtooth berth 514. In further embodiments, the sawtooth junction 502 and/or the sawtooth terminal 504 can have a bidirectional sawtooth platform 510 with any number of sawtooth berths 514.

The elevated autonomous people mover system 400 may be used for modified prior art automated people mover system 100 structures such as those shown in FIGS. 1 through 8 and/or new infrastructures could be put in place during new construction projects to accommodate the elevated autonomous people mover system 400.

In one or more embodiments, the elevated autonomous people mover system 400 and method includes one or more of the following: 1) autonomous vehicle(s) 410 with 1 person passenger capacity; 2) autonomous vehicle(s) 410 with 2 person passenger capacity; 3) autonomous vehicle(s) 410 with 3 person passenger capacity; 4) autonomous vehicle(s) 410 with 4 person passenger capacity; 5) autonomous vehicle(s) 410 with 5 to 9 person passenger capacity; 6) autonomous vehicle(s) 410 with 10 to 19 person passenger capacity; 7) autonomous vehicle(s) 410 with 20 to 29 person passenger capacity; 8) autonomous vehicle(s) 410 with 30 to 39 person passenger capacity; 9) autonomous vehicle(s) 410 with 40 to 49 person passenger capacity; 10) autonomous vehicle(s) 410 with 50 to 74 person passenger capacity; 11) autonomous vehicle(s) 410 with 75 to 99 person passenger capacity; 12) autonomous vehicle(s) 410 with 100 to 149 person passenger capacity; 13) autonomous vehicle(s) 410 with 150 to 199 person passenger capacity; 14) autonomous vehicle(s) 410 with 200 and above person passenger capacity;

In one or more embodiments, the elevated autonomous people mover system 400 and method includes one or more of the following: 1) autonomous vehicle(s) 410 is/are electric vehicle(s); and/or 2) autonomous vehicle(s) 410 is/are powered by rechargeable batteries.

The autonomous vehicle 410 can be connected to form longer units of autonomous vehicles 410 that travel as one unit. The connection can be physically or electronically.

The elevated autonomous people mover system 400 can utilize prior art sawtooth platform 320 instead of bidirectional sawtooth platforms 510.

Sawtooth Station and Bidirectional Sawtooth Platform

FIG. 59 illustrates an additional embodiment of a sawtooth station 500 and illustrates a general layout of sawtooth terminal 504 that is similar to the of FIG. 18, except that the entry A and exit point C is on the opposite side.

FIG. 60 illustrates an additional embodiment of a sawtooth station 500 and illustrates a general layout that is similar to the of FIG. 59, except there is a single entry/exit A.

FIG. 61 illustrates a further embodiment of a sawtooth station 500 and illustrates a general layout that is similar to the sawtooth station 500 of FIG. 60, except that the single entry/exit A can be located in a variety of locations (vehicles enter/exit in any direction/location).

FIG. 62 illustrates a further embodiment of a sawtooth station 500 and illustrates a general layout that is similar to the sawtooth station 500 of FIG. 61, except that instead of a single entry/exit A that can be located in a variety of locations (vehicles enter/exit in any direction), there are one or more separate entries/exits that allows vehicles to enter/exit in any direction (option 1).

FIG. 63 illustrates a further embodiment of a sawtooth station 500 and illustrates a general layout that is similar to the sawtooth station 500 of FIG. 62, except that there are one or more single entries/exits and one or more separate entries/exits that allows vehicles to enter/exit in any direction (option 2).

FIG. 64 illustrates a still further embodiment of a sawtooth station 500 that have a ramp 570 to ground 580. The ramp 570 enables the autonomous vehicles to move to the ground 580. The ramp 570 can be connected in any location. Although the sawtooth junction 502 is shown, in alternative embodiments, the sawtooth terminal 504 may include the ramp(s) 570.

FIG. 65 illustrates a further embodiment of a sawtooth station 500 and illustrates a general layout that is similar to the sawtooth station 500 of FIG. 64, except that there is one additional sawtooth station 500 located above the other sawtooth station 500. In the same way, several sawtooth stations can be located above each other, and entrance and exit can be wherever needed. Although the sawtooth junction 502 is shown, in alternative embodiments, the sawtooth terminal 504 may include these features.

FIG. 66 illustrates another embodiment of a sawtooth station 500 that is a combination of two or more individual sawtooth station 500, with the bidirectional sawtooth platform 510 on the inside (e.g., two or more that are perpendicular to each other) (option 1). Although the sawtooth junction 502 is shown, in alternative embodiments, the sawtooth terminal 504 may include these features.

FIG. 67 illustrates a further embodiment of a sawtooth station 500 and illustrates a general layout that is similar to the sawtooth station 500 of FIG. 66, except that the bidirectional sawtooth platform 510 is on the outside (e.g., two or more that are perpendicular to each other) (option 2). In general, two or more sawtooth stations 500 can be combined to form larger sawtooth stations 500. Although the sawtooth junction 502 is shown, in alternative embodiments, the sawtooth terminal 504 may include these features.

FIGS. 68 through 71 illustrate further embodiments of a sawtooth station 500 that having 3, 2, 1 and 5 sawtooth berths 514, respectively. A sawtooth station 500 can have any number of berths. Although the sawtooth junction 502 is shown, in alternative embodiments, the sawtooth terminal 504 may include these features.

FIG. 72 illustrate a further embodiment of a sawtooth station 500 where the bidirectional sawtooth platform 510 is no longer than the sawtooth berths 514. Although the sawtooth junction 502 is shown, in alternative embodiments, the sawtooth terminal 504 may include this feature In a further embodiment of a sawtooth station 500, the sawtooth station 500 is not elevated (e.g., the sawtooth station 500 is located on the ground or under the ground)

In a further embodiment of a sawtooth station 500, some the vehicle(s) are not an autonomous vehicle 410.

In a further embodiment of a sawtooth station 500, all the vehicle(s) are not autonomous vehicle 410.

In a further embodiment of a sawtooth station 500, the sawtooth station 500 is used in a system that is not an elevated autonomous people mover system 400.

In a further embodiment of a sawtooth station 500, the bidirectional sawtooth platform 510 is used in a system that is not a sawtooth station system.

Car Tether

In a further embodiment, the car tether system 600 controls more than one sawtooth station 500 in an elevated automated people mover system 400, including controlling autonomous vehicle9*s*) 410 on the elevated guideway structure 402, 404.

In a further embodiment, the car tether system 600 is used in a system that is not an elevated automated people mover system 400.

In a further embodiment of the car tether system 600, the predetermined control area 610 is a non-predetermined control area;

In further embodiments, the car tether system 600 is used in a predetermined control area 610 where some of the autonomous vehicles 410 are not autonomous, In further embodiments, the car tether system 600 is used in a predetermined control area 610 where all vehicles are not autonomous vehicles 410

In further embodiments, the car tether system 600 is used to control one or more functions of the autonomous vehicle 610 other than global position, acceleration, speed, and direction.

In further embodiments, the car tether system 600 is used to control one or more function of the autonomous vehicle 410.

In further embodiments, the number of individual autonomous vehicles 410 controlled by the car tether system 600 can be of any size.

In further embodiments, the car tether system 600 stops (e.g., preferably for a short duration) some autonomous vehicle(s) 410 if such provides an improved overall traffic flow.

With reference to FIGS. 73 and 74, where two traffic lanes 640 merge into one lane 640, the car tether system 600 controls the autonomous vehicles 410 to create a smooth transition when the two traffic lanes 640 are merged into one traffic lane 650. The car tether system 600 controls the autonomous vehicles 410 to provide relative distance D between the autonomous vehicles 410 to create a seamless merger of the two traffic lanes 640. The relative distance between the autonomous vehicles 410 can also be expressed as an area or volume around the autonomous vehicles 410 or other means of expression.

With reference to FIGS. 75 and 76, which show a four-way intersection 660 and a three-way intersection 670, at the intersection(s) 660, 670 between traffic lanes 640, the car tether system 600 controls the autonomous vehicles 410 to create a smooth transition between the different traffic lanes 640 to provide a seamless traffic flow where all autonomous vehicles 410 are moving continuously toward their destination. The car tether system 600 controls the autonomous vehicle 410 to provide relative distance between the autonomous vehicles 410 to create a seamless traffic flow for all autonomous vehicles 410 going through the intersection(s) 660, 670.

A further embodiment the car tether system 600 is used in the control of an intersection 660, 670 of any size including roundabouts.

Additional Embodiments: Sawtooth Station and Bidirectional Sawtooth Platform

FIGS. 77 and 78 illustrate a further embodiment of a sawtooth station 500 where the bidirectional sawtooth platform 510 at one end is no longer than the sawtooth berths 514. Although the sawtooth junction 502 is shown, in alternative embodiments, the sawtooth terminal 504 may include these features.

FIGS. 79 and 80 illustrate a further embodiment of a sawtooth station 500 where the sawtooth berths 514 are located in the opposite direction and thereby are the autonomous vehicles 410 entering the sawtooth berth 514 from the opposite direction compared with FIG. 17 and FIG. 18;

FIG. 81 illustrates a further embodiment of a sawtooth station 500 and illustrates a general layout that is similar to the sawtooth station 500 of FIG. 63, except that the single entries/exits are curved that allows vehicles to enter/exit on a curve in any direction.

FIG. 82 illustrates a further embodiment of a sawtooth station 500 and illustrates a general layout that is similar to the sawtooth station 500 of FIG. 17, except that there are two sawtooth berths 514 located on opposite sides of the bidirectional sawtooth platform 510 that allows vehicles to enter the sawtooth berth 514 on both sides.

General

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

The invention claimed is:

1. A sawtooth station, comprising:

a passenger waiting area;

an autonomous vehicle area sized to allow autonomous vehicles to simultaneously travel in opposite directions of travel and turn around;

one or more sawtooth berths separating the passenger waiting area from the autonomous vehicle area, whereby in a first configuration a first autonomous vehicle closest to the one or more sawtooth berths pulls straight into the one or more sawtooth berths and in a second configuration a second autonomous vehicle simultaneously traveling in an opposite direction of travel from the first autonomous vehicle and farthest from the one or more sawtooth berths turns around in the autonomous vehicle area and stops at the one or more sawtooth berth.

2. The sawtooth station of claim 1, wherein the autonomous vehicle area is a bidirectional sawtooth platform along a single side of the sawtooth station.

3. The sawtooth station of claim 1, further including one or more entries and one or more exits that may be the same or different from the one or more entries, whereby an autonomous vehicle enters the sawtooth station at the one or more entries and exits the sawtooth station at the one or more exits.

4. The sawtooth station of claim 3, wherein the sawtooth station is a sawtooth terminal including an end with the one or more entries and exits.

5. The sawtooth station of claim 3, wherein the sawtooth station is a sawtooth junction including opposite ends with the one or more entries and exits.

6. A method of using a sawtooth station, comprising:

providing the sawtooth station of claim 1;

receiving autonomous vehicles traveling in opposite directions within the sawtooth station;

allowing the autonomous vehicles to turn around within the sawtooth station;

receiving the autonomous vehicles at the one or more sawtooth berths.

7. An autonomous vehicle tether system for controlling interaction between a plurality of autonomous vehicles located in a control area, the plurality of autonomous vehicles each having control parameters and respective desired destinations or exit points, wherein the control area includes one or more sawtooth berths separating a passenger waiting area from a autonomous vehicle area, whereby in a first configuration a first autonomous vehicle closest to the one or more sawtooth berths pulls straight into the one or more sawtooth berths and in a second configuration a second autonomous vehicle simultaneously traveling in an opposite direction of travel from the first autonomous vehicle and farthest from the one or more sawtooth berths turns around in the autonomous vehicle area and stops at the one or more sawtooth berths comprising:

at least one hardware processor; and one or more software modules that are configured to, when executed by the at least one hardware processor:

take control of the plurality of autonomous vehicles in the control area;

obtain the control parameters and desired destination or exit point for each autonomous vehicle;

optimize control parameters of each autonomous vehicle to optimize travel through the control area to the respective desired destinations or exit points;

determine if the autonomous vehicle is at its desired destination or exit point;

return control of the autonomous vehicle back to the autonomous vehicle after determining that the autonomous vehicle is at its desired destination or exit point, control in the first configuration the first autonomous vehicle closest to the one or more sawtooth berths to pull straight into the one or more sawtooth berths and control in the second configuration the second autonomous vehicle simultaneously traveling in an opposite direction of travel from the first autonomous vehicle and farthest from the one or more sawtooth berths to turn around in the autonomous vehicle area and stop at the one or more sawtooth berths.

8. The autonomous vehicle tether system of claim 7, wherein the autonomous vehicle tether system controls interactions between all of the plurality of autonomous vehicles located in the control area.

9. The autonomous vehicle tether system of claim 7, wherein when traffic lanes merge the autonomous vehicle tether system controls interactions between the control of the autonomous vehicles to provide relative distance between the autonomous vehicles to create a seamless merger.

10. The autonomous vehicle tether system of claim 7, wherein at intersections the autonomous vehicle tether system controls interactions between the control of the autonomous vehicles to provide relative distance between the autonomous vehicles to create a seamless traffic flow for all autonomous vehicles going through the intersection.

11. The autonomous vehicle tether system of claim 10, wherein the intersections may be any size intersection that the autonomous vehicle tether system controls.

12. The autonomous vehicle tether system of claim 7, wherein the control area is a predetermined control area.

13. The autonomous vehicle tether system of claim 7, wherein the control area is a non-predetermined control area.

14. The autonomous vehicle tether system of claim 7, wherein autonomous vehicle tether system controls interaction between autonomous vehicles in an elevated autonomous people mover system.

15. The autonomous vehicle tether system of claim 7, wherein the control area includes the autonomous vehicles and also non-autonomous vehicles.

16. The autonomous vehicle tether system of claim 7, wherein all of the vehicles in the control area are autonomous.

17. The autonomous vehicle tether system of claim 7, wherein the control parameters are at least travel route, speed, acceleration, and global positioning.

18. The autonomous vehicle tether system of claim 7, wherein the control parameters are other than travel route, speed, acceleration, and global positioning.

19. The autonomous vehicle tether system of claim 7, wherein autonomous vehicle tether system controls one or more autonomous vehicles to stop if stopping provides an improved overall traffic flow.

20. A method of controlling interaction between a plurality of autonomous vehicles located in a control area, the plurality of autonomous vehicles each having control parameters and respective desired destinations or exit points, wherein the control area includes one or more sawtooth berths separating a passenger waiting area from a autonomous vehicle area, whereby in a first configuration a first autonomous vehicle closest to the one or more sawtooth berths pulls straight into the one or more sawtooth berths and in a second configuration a second autonomous vehicle simultaneously traveling in an opposite direction of travel from the first autonomous vehicle and farthest from the one or more sawtooth berths turns around in the autonomous vehicle area and stops at the one or more sawtooth berths, comprising:

taking control of the plurality of autonomous vehicles in the control area;

obtaining the control parameters and desired destination or exit point for each autonomous vehicle;

optimizing control parameters of each autonomous vehicle to optimize travel through the control area to the respective desired destinations or exit points;

determining if the autonomous vehicle is at its desired destination or exit point;

returning control of the autonomous vehicle back to the autonomous vehicle after determining that the autonomous vehicle is at its desired destination or exit point, controlling in the first configuration the first autonomous vehicle closest to the one or more sawtooth berths to pull straight into the one or more sawtooth berths and controlling in the second configuration the second autonomous vehicle simultaneously traveling in an opposite direction of travel from the first autonomous vehicle and farthest from the one or more sawtooth berths to turn around in the autonomous vehicle area and stop at the one or more sawtooth berths.

21. An elevated autonomous people mover system, comprising:

an elevated guideway structure with a running surface;

a plurality of autonomous vehicles;

a plurality of elevated stations along the guideway structure for passengers to enter and exit the autonomous vehicles, whereby the elevated autonomous people mover system does not include a third rail for supplying electric power to the vehicles nor a guidance structure to guide the vehicles, wherein the plurality of elevated stations include one or more sawtooth berths separating a passenger waiting area from a autonomous vehicle area, whereby in a first configuration a first autonomous vehicle closest to the one or more sawtooth berths pulls straight into the one or more sawtooth berths and in a second configuration a second autonomous vehicle simultaneously traveling in an opposite direction of travel from the first autonomous vehicle and farthest from the one or more sawtooth berths turns around in the autonomous vehicle area and stops at the one or more sawtooth berths.

22. The elevated autonomous people mover system of claim 21, wherein the plurality of elevated stations include sawtooth stations configured to allow the autonomous vehicles to turn around therein.

23. The elevated autonomous people mover system of claim 22, wherein the plurality of elevated stations include sawtooth junctions and sawtooth terminals.

24. The elevated autonomous people mover system of claim 21, wherein the plurality of autonomous vehicles include self-powered and self-guided autonomous vehicles.

25. A method of using an elevated autonomous people mover system, comprising:

providing the elevated autonomous people mover system of claim 21;

receiving the plurality of autonomous vehicles on the running surface of the elevated guideway structure without a third rail for supplying electric power to the vehicles nor a guidance structure to guide the vehicles;

receiving the plurality of autonomous vehicles at the plurality of elevated stations for passengers to enter and exit the autonomous vehicles.

* * * * *